US010694821B2

(12) United States Patent
Minato et al.

(10) Patent No.: US 10,694,821 B2
(45) Date of Patent: Jun. 30, 2020

(54) FASTENING TAPE

(71) Applicant: YKK Corporation, Tokyo (JP)

(72) Inventors: Tsuyoshi Minato, Kurobe (JP); Zhiyu Ren, Kurobe (JP); Atsushi Nakaya, Macon, GA (US); Michael Fleming, Macon, GA (US); Keith Kratz, Macon, GA (US); Wolfgang Coronel, Macon, GA (US); Takayuki Matsui, Kurobe (JP); Tetsuya Yoshino, Novi, MI (US)

(73) Assignee: YKK Corporation (JP)

( * ) Notice: Subject to any disclaimer, the term of this patent is extended or adjusted under 35 U.S.C. 154(b) by 266 days.

(21) Appl. No.: 15/833,687

(22) Filed: Dec. 6, 2017

(65) Prior Publication Data

US 2018/0168290 A1 Jun. 21, 2018

Related U.S. Application Data

(60) Provisional application No. 62/482,310, filed on Apr. 6, 2017, provisional application No. 62/437,376, filed on Dec. 21, 2016.

(51) Int. Cl.
*A44B 18/00* (2006.01)

(52) U.S. Cl.
CPC ..... *A44B 18/0069* (2013.01); *A44B 18/0049* (2013.01); *A44B 18/0076* (2013.01)

(58) Field of Classification Search
CPC ..... A44B 18/0069; A44B 18/0076; A44B 18/0049; A44B 17/008; B60R 22/12; B60N 2/5833; B60N 2/5825
See application file for complete search history.

(56) References Cited

U.S. PATENT DOCUMENTS

| | | | | |
|---|---|---|---|---|
| 5,061,540 | A | 10/1991 | Cripps et al. | |
| 5,972,465 | A | 10/1999 | Ohno et al. | |
| 6,460,230 | B2 * | 10/2002 | Shimamura | A44B 18/0076 24/306 |
| 6,896,759 | B2 * | 5/2005 | Fujisawa | A44B 18/0049 156/244.18 |
| 7,431,976 | B2 | 10/2008 | Hermann et al. | |
| 8,795,564 | B2 | 8/2014 | Murasaki et al. | |

(Continued)

FOREIGN PATENT DOCUMENTS

| | | | |
|---|---|---|---|
| CN | 1305759 | A | 8/2001 |
| CN | 102729948 | A | 10/2012 |

(Continued)

OTHER PUBLICATIONS

Office Action, Japanese Patent Application No. 2017-242359, dated Nov. 27, 2018.

(Continued)

*Primary Examiner* — Robert Sandy
*Assistant Examiner* — Louis A Mercado
(74) *Attorney, Agent, or Firm* — Kilpatrick Townsend & Stockton LLP

(57) ABSTRACT

A fastening tape with a flange is provided. The fastening tape includes a body and a plurality of fasteners positioned on the body. The flange is between the plurality of fasteners and an edge of the body. In some cases, the flange increases the "hook to foam strength" of the fastening tape when the fastening tape is within foam.

12 Claims, 47 Drawing Sheets

(56) References Cited

U.S. PATENT DOCUMENTS

| | | | | |
|---|---|---|---|---|
| 9,034,452 | B2 * | 5/2015 | Cina | B32B 3/30 428/100 |
| 9,138,032 | B1 * | 9/2015 | Cina | A44B 18/0076 |
| 9,271,546 | B2 * | 3/2016 | Terada | A44B 18/0065 |
| 9,271,547 | B2 * | 3/2016 | Terada | A44B 18/0049 |
| 9,357,815 | B2 * | 6/2016 | Minato | A44B 18/0049 |
| 9,399,333 | B2 * | 7/2016 | Medina | A44B 18/0069 |
| 9,433,262 | B2 * | 9/2016 | Okuda | A44B 18/0049 |
| 9,504,296 | B2 | 11/2016 | Cina et al. | |
| 9,635,910 | B2 * | 5/2017 | Cina | A44B 18/0003 |
| 9,826,801 | B2 * | 11/2017 | Mascarenhas | A44B 18/0076 |
| 9,924,765 | B1 * | 3/2018 | Coronel | A44B 18/0069 |
| 9,936,773 | B2 * | 4/2018 | Okuda | A44B 18/0076 |
| 2001/0007166 | A1 | 7/2001 | Shimamura et al. | |
| 2006/0269634 | A1 | 11/2006 | Westeel | |
| 2010/0181695 | A1 | 7/2010 | Murasaki et al. | |
| 2015/0164186 | A1 | 6/2015 | Cina et al. | |
| 2016/0366992 | A1 | 12/2016 | Mascarenhas et al. | |
| 2017/0008435 | A1 * | 1/2017 | Murasaki | B60N 2/5891 |
| 2019/0090595 | A1 * | 3/2019 | Fleming | A44B 18/0061 |
| 2020/0047650 | A1 * | 2/2020 | Cheng | B60N 2/5833 |

FOREIGN PATENT DOCUMENTS

| | | | |
|---|---|---|---|
| JP | H01-071599 | U | 5/1989 |
| JP | 2003-019006 | A | 1/2003 |
| JP | 2010-162339 | A | 7/2010 |
| WO | 2013-061423 | A1 | 5/2013 |

OTHER PUBLICATIONS

Office Action, Chinese Patent Application No. 201711392523.5, dated Nov. 27, 2019.

* cited by examiner

FASTENING TAPE

REFERENCE TO RELATED APPLICATIONS

This application claims the benefit of U.S. Provisional Application No. 62/437,376, filed Dec. 21, 2016 and entitled FLANGE FOR FASTENING TAPE, and the benefit of U.S. Provisional Application No. 62/482,310, filed Apr. 6, 2017 and entitled FLANGE FOR FASTENING TAPE, which are both incorporated herein in their entireties by this reference.

FIELD OF THE INVENTION

This application relates to fastening tape and methods of forming fastening tape.

BACKGROUND

Fastening tape used in automotive and other applications may be installed on a seat cushion or other component by first placing the fastening tape on a trench within a mold. After the fastening tape has been situated, urethane foam is introduced, which forms the seat cushion or other component around the fastening tape. If foam intrudes into the fastening tape, the fasteners, such as hooks, of the fastening tape are more prone to failure. If the trench surface on which the fastening tape is positioned is curved instead of planar, foam intrusion is more likely.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings, and each claim.

According to certain examples, a fastening tape includes a body having a first edge, a second edge opposite the first edge, and a top surface extending between the first edge and the second edge. In some examples, the body defines a lateral direction from the first edge to the second edge and a longitudinal direction transverse to the lateral direction. In various examples, the fastening tape includes a plurality of fasteners extending in an upward direction from the top surface of the body and positioned between the first edge and the second edge. In certain cases, the fastening tape includes a flange arranged between the plurality of fasteners and the first edge. In some aspects, the flange includes a groove defined in the top surface of the body and extending in the longitudinal direction between the plurality of fasteners and the first edge. In some examples, the flange defines a folding portion arranged between the groove and the first edge and a non-folding portion arranged between the groove and the plurality of fasteners. In certain examples, the folding portion is positionable relative to the non-folding portion. In various cases, the fastening tape also includes a plurality of lateral slits extending from proximate the first edge to proximate the plurality of fasteners in the lateral direction. In some aspects, a width of each lateral slit of the plurality of lateral slits is approximately the same as a distance between adjacent edges of adjacent lateral slits.

According to certain examples, a fastening tape includes a body having a first edge, a second edge opposite the first edge, and a top surface extending between the first edge and the second edge. In various examples, the body defines a lateral direction from the first edge to the second edge and a longitudinal direction transverse to the lateral direction. In some aspects, the fastening tape includes a plurality of fasteners extending in an upward direction from the top surface of the body and positioned between the first edge and the second edge. In certain examples, the fastening tape includes a first flange arranged between the plurality of fasteners and the first edge. In some cases, the first flange includes a first groove extending in the longitudinal direction and a plurality of first lateral slits extending in the lateral direction. In some aspects, the first flange defines a first folding portion arranged between the first groove and the first edge and a first non-folding portion arranged between the first groove and the plurality of fasteners. In various examples, the fastening tape includes a second flange arranged between the plurality of fasteners and the second edge. In certain examples, the second flange includes a second groove extending in the longitudinal direction. In various aspects, the second flange defines a second folding portion arranged between the second groove and the second edge and a second non-folding portion arranged between the second groove and the plurality of fasteners. In various cases, the second flange includes a plurality of second lateral slits extending in the lateral direction, and the second lateral slits are offset from the first lateral slits in the lateral direction.

According to certain examples, a fastening tape includes a body having a first edge, a second edge opposite the first edge, and a top surface extending between the first edge and the second edge. In some cases, the body defines a lateral direction from the first edge to the second edge and a longitudinal direction transverse to the lateral direction. In various examples, the fastening tape includes a plurality of fasteners extending in an upward direction from the top surface of the body and positioned between the first edge and the second edge. In some examples, the fastening tape also includes a first flange and a second flange. According to certain examples, the first flange is arranged between the plurality of fasteners and the first edge. In some aspects, the first flange includes a first groove extending in the longitudinal direction and a plurality of first lateral slits extending in the lateral direction. In certain examples, the first flange defines a first folding portion arranged between the first groove and the first edge and a first non-folding portion arranged between the first groove and the plurality of fasteners. In various aspects, the second flange is arranged between the plurality of fasteners and the second edge. In some examples, the second flange includes a second groove extending in the longitudinal direction and a plurality of second lateral slits extending in the lateral direction. In certain cases, the second flange defines a second folding portion arranged between the second groove and the second edge and a second non-folding portion arranged between the second groove and the plurality of fasteners. In various examples, the second lateral slits are aligned with the first lateral slits in the lateral direction.

According to certain examples, a fastening tape includes a body having a first edge, a second edge opposite the first edge, and a top surface. In some cases, the body defines a lateral direction from the first edge to the second edge and a longitudinal direction transverse to the lateral direction. In various examples, the fastening tape includes a plurality of fasteners positioned between the first edge and the second edge on the top surface of the body. In some examples, the fastening tape includes a first flange arranged between the plurality of fasteners and the first edge. In some examples, the fastening tape includes a first sidewall arranged between the plurality of fasteners and the first flange. In certain cases, the first flange includes a plurality of first lateral slits extending in the lateral direction. In some examples, each first lateral slit of the plurality of first lateral slits includes an inner end and an outer end. In some examples, the first flange includes a protrusion arranged between the first edge and the first sidewall at a position close to the first edge relative to the inner end of each first lateral slit.

Various implementations described in the present disclosure can include additional systems, methods, features, and advantages, which cannot necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize general principles of the present disclosure. Corresponding features and components throughout the figures can be designated by matching reference characters for the sake of consistency and clarity.

DETAILED DESCRIPTION

Figure 1:
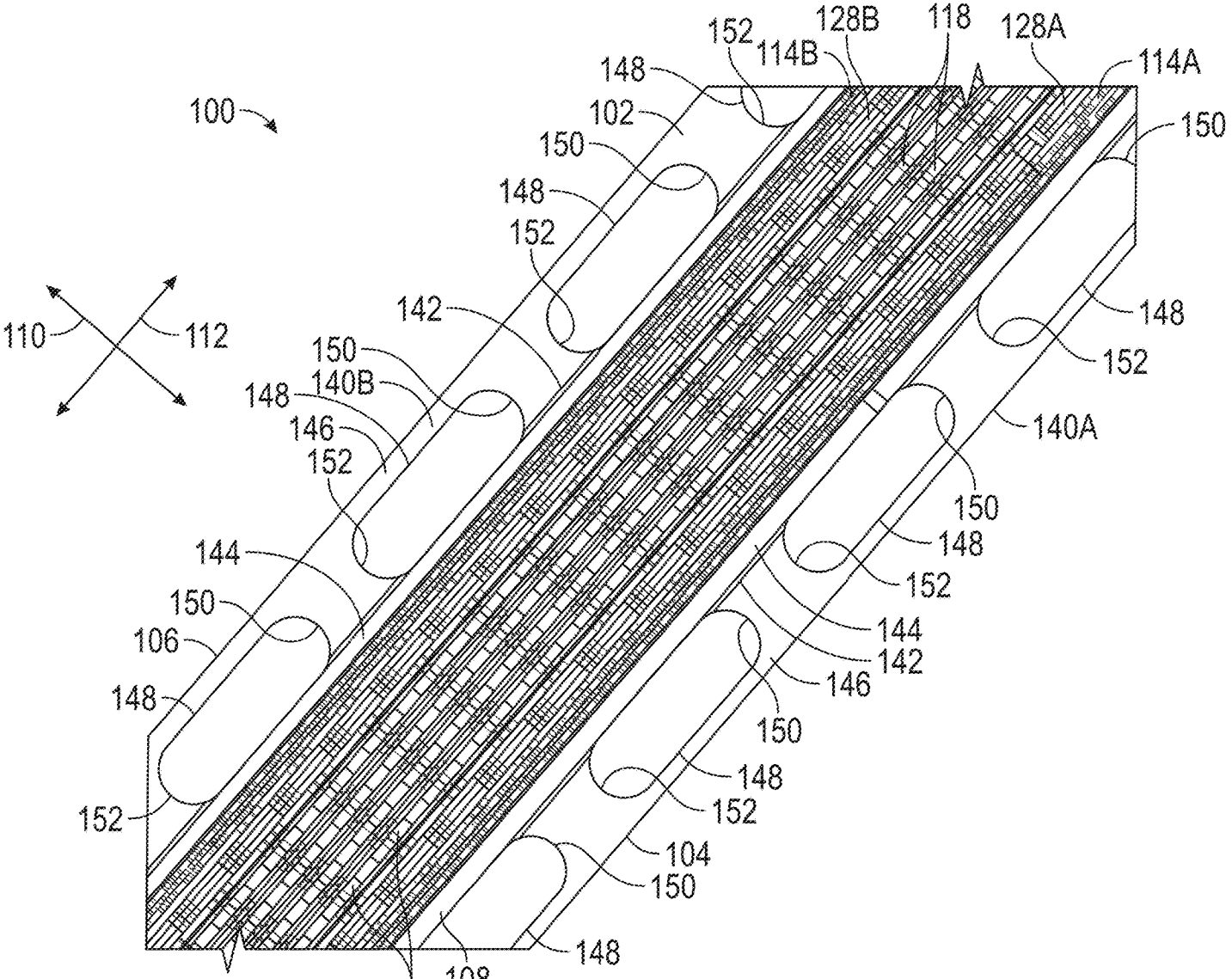
FIG. 1 is a top view of a segment of fastening tape according to aspects of the current disclosure.

The subject matter of aspects and examples of the present invention is described here with specificity to meet statutory requirements, but this description is not necessarily intended to be limiting. The described subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

The following description is provided as an enabling teaching of the invention. To this end, those of ordinary skill in the relevant art will recognize and appreciate that many changes can be made to the various aspects of the invention described herein, while still obtaining the beneficial results of the invention. It will also be apparent that some of the desired benefits can be obtained by selecting some of the features of the invention without utilizing other features. Accordingly, those who work in the art will recognize that many modifications and adaptations to the invention are possible and can even be desirable in certain circumstances and are a part of the invention. Thus, the following description is provided as illustrative of the principles of the invention and not in limitation thereof.

As used throughout, the singular forms "a," "an" and "the" include plural referents unless the context clearly dictates otherwise. Thus, for example, reference to "a fastener" can include two or more such fasteners unless the context indicates otherwise. Ranges can be expressed herein as from "about" one particular value and/or to "about" another particular value. When such a range is expressed, another aspect includes from the one particular value and/or to the other particular value. Similarly, when values are expressed as approximations, by use of the antecedent "about," the particular value forms another aspect. Moreover, the endpoints of each of the ranges are significant both in relation to the other endpoint, and independently of the other endpoint.

As used herein, the terms "optional" or "optionally" mean that the subsequently described feature may or may not be present, and that the description includes instances where said feature is present and instances where it is not. The word "or" as used herein means any one member of a particular list and includes any combination of members of that list. Further, conditional language, such as, among others, "can," "could," "might," or "can," unless specifically stated otherwise, or otherwise understood within the context as used, is generally intended to convey that certain aspects include, while other aspects do not include, certain features, elements, and/or steps. Thus, such conditional language is not generally intended to imply that features, elements, and/or steps are in any way required for one or more particular aspects. Directional references such as "up," "down," "top," "bottom," "left," "right," "front," and "back," among others, are intended to refer to the orientation as illustrated and described in the figure (or figures) to which the components and directions are referencing.

Disclosed are fastening tapes and associated methods, systems, devices, and apparatuses. In one aspect, a fastening tape has a body, sidewalls, a plurality of fasteners such as hooks, and flanges. One of ordinary skill in the art will understand that the disclosed fastening tapes are described in but a few exemplary aspects among many.

Referring to FIGS. 1-10, a fastening tape 100 includes a body 102 having a first edge 104 and a second edge 106 opposite the first edge 104. The body 102 further includes a top surface 108 and a bottom surface 302 (FIGS. 3A-3B), each extending between the first edge 104 and the second edge 106. The body 102 defines a lateral direction 110, which is a direction extending from the first edge 104 to the second edge 106, and a longitudinal direction 112, which extends transversely to the lateral direction 110.

Figure 2:
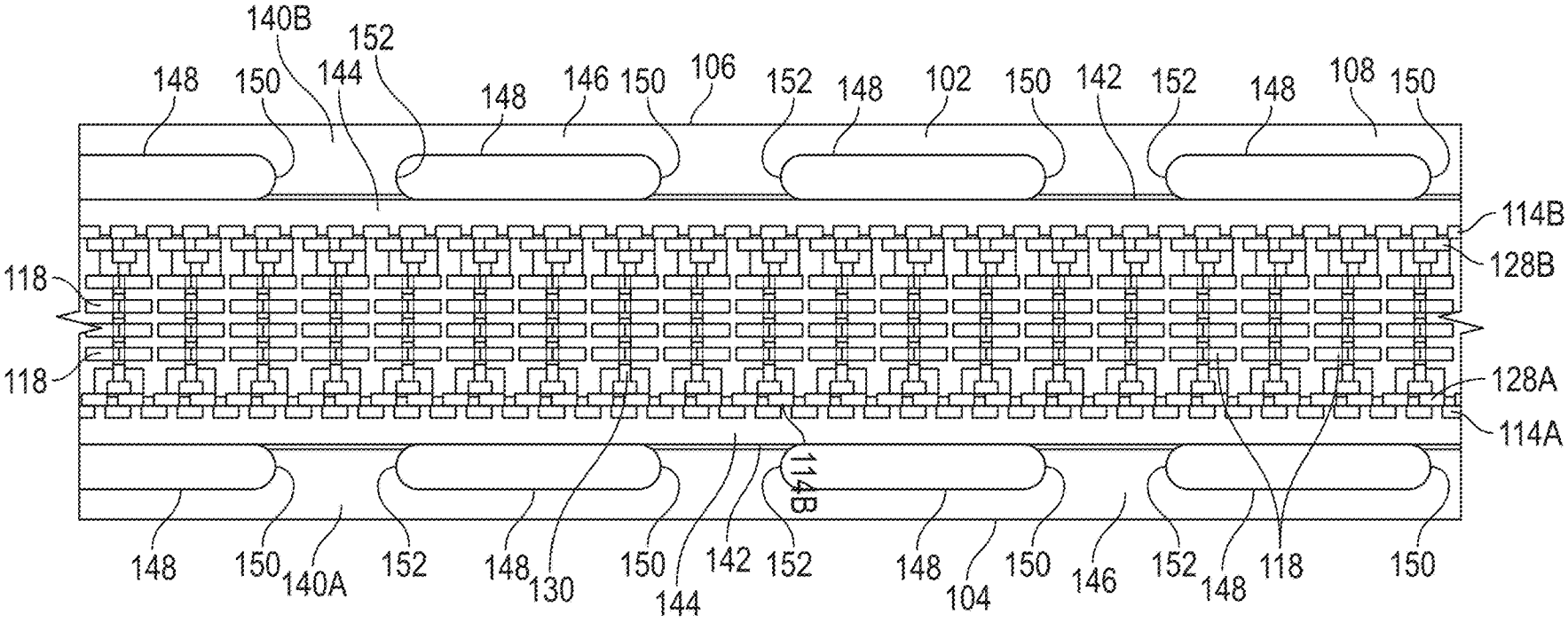
FIG. 2 is another top view of the segment of fastening tape of FIG. 1.
Figure 3A:
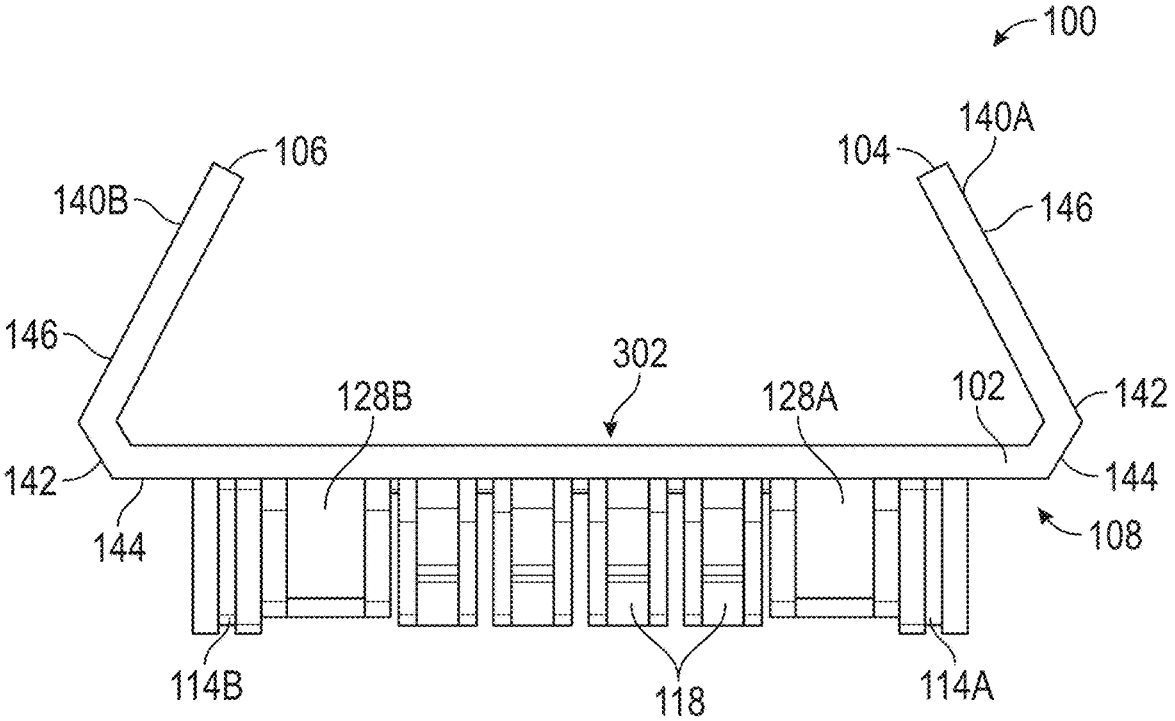
FIG. 3A is an end view of the segment of fastening tape of FIG. 1 with folding portions of flanges of the fastening tape in a folded configuration.
Figure 3B:
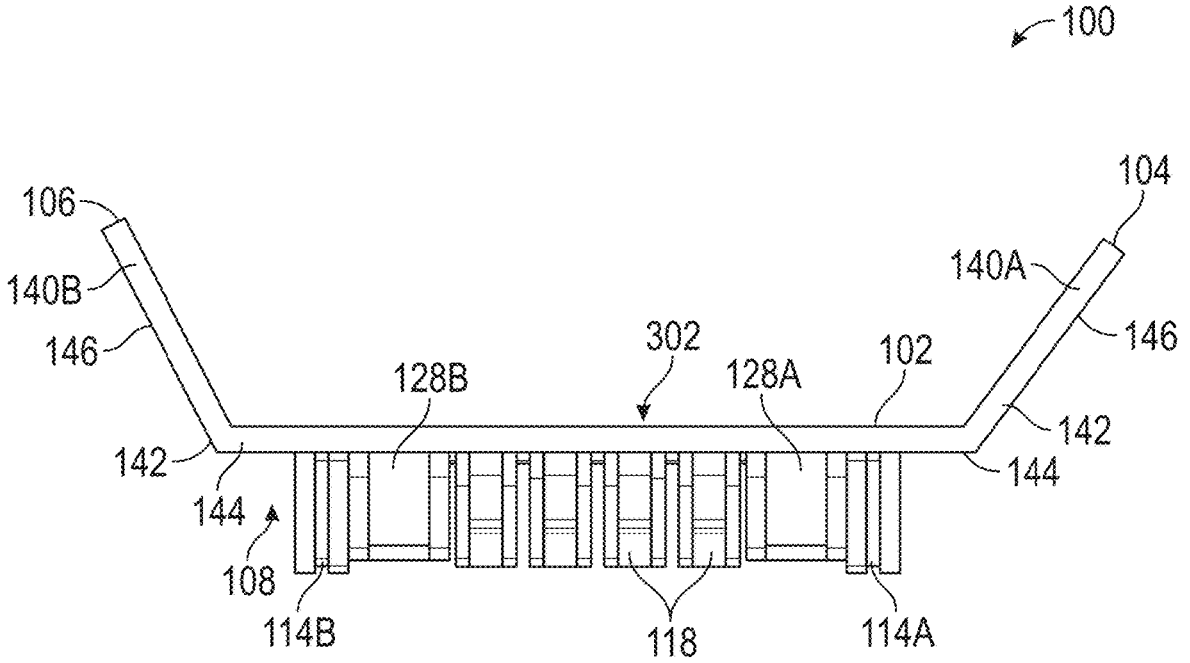
FIG. 3B is an end view of the segment of fastening tape of FIG. 1 with folding portions of flanges of the fastening tape in another folded configuration.
Figure 4:
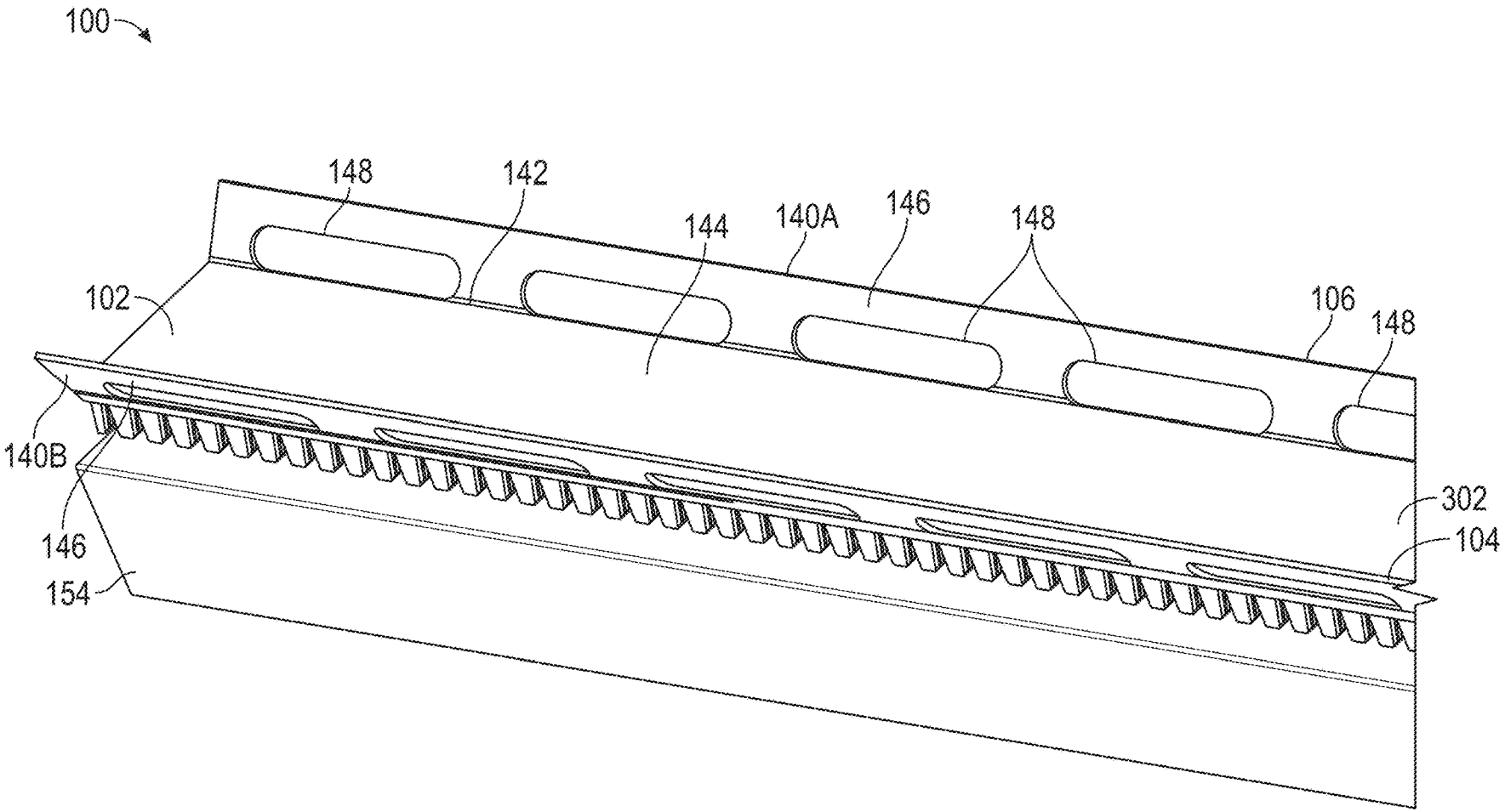
FIG. 4 is a perspective view of the segment of fastening tape of FIG. 1 positioned on a trench.

The fastening tape 100 includes a first sidewall 114A and a second sidewall 114B. The first sidewall 114A and the second sidewall 114B extend in an upward direction from the top surface 108, and extend along the top surface 108 of the body 102 in the longitudinal direction 112. As illustrated in FIGS. 1 and 2, in one non-limiting example, the first sidewall 114A is positioned between the first edge 104 and the second sidewall 114B, and the second sidewall 114B is positioned between the first sidewall 114A and the second edge 106.

Each of the first sidewall 114A and the second sidewall 114B can include any number of sidewall components. The first sidewall 114A and the second sidewall 114B can have various-shaped profiles and are not limited to the illustrated arrangement. The first sidewall 114A and the second sidewall 114B are arranged to act as a barrier to reduce the amount of foam intrusion into the space between the first sidewall 114A and the second sidewall 114B during a molding process.

As illustrated in FIGS. 1 and 2, the fastening tape 100 also includes a plurality of fasteners 118 extending in the upward direction from the top surface 108 of the body 102. The fasteners 118 are positioned between the first sidewall 114A and the second sidewall 114B. Any suitable number of fasteners 118, including at least one fastener, may extend from the fastening tape 100. Fasteners 118 can have any suitable shape and configuration, including generally Y-shaped, J-shaped, etc. As illustrated in FIGS. 1 and 2, the fasteners 118 are arranged in rows that extend in the lateral direction 110 between the first sidewall 114A and the second sidewall 114B. In the illustrated example, each row of fasteners 118 includes four fasteners 118; however, any suitable number of fasteners 118 can be present per row. Moreover, a width of the fastening tape 100, which is a distance from the first edge 104 to the second edge 106, can be adjusted as desired. For example, additional or fewer fasteners 118 may be present across the width of the fastening tape 100 depending on the width of the fastening tape 100 and/or the dimensions of the fasteners 118.

Referring to FIGS. 1-10, the fastening tape 100 includes magnetic material 128A, 128B, such as, but not limited to, iron or a ferrous alloy. In some examples, the magnetic material 128A, 128B can be positioned between the first sidewall 114A and the second sidewall 114B, although it need not. In one non-limiting example, the magnetic material 128 is iron monofilament, but any other suitable magnetic material can be present. In the example illustrated in FIGS. 1 and 2, the magnetic material 128 extends in the longitudinal direction 112 and is generally parallel to the first sidewall 114A and the second sidewall 114B.

Referring to FIGS. 1-10, in various examples, the fastening tape 100 includes a first flange 140A arranged between the plurality of fasteners 118 and the first edge 104, and a second flange 140B arranged between the plurality of fasteners 118 and the second edge 106. The first flange 140A is arranged between the first edge 104 and the first sidewall 114A and the second flange 140B is arranged between the second edge 106 and the second sidewall 114B. Although the following discussion refers to the first flange 140A, the following discussion is equally applicable to the second flange 140B. In various examples, a distance from the first sidewall 114A to the first edge 104 defines a flange width. In some examples, the flange width may be about half the distance between the first sidewall 114A and the second sidewall 114B. However, in various other examples, the flange width may be greater than about half the distance between the first sidewall 114A and the second sidewall 114B, or less than about half the distance between the first sidewall 114A and the second sidewall 114B. The flanges 140A, 140B are fin-shaped parts positioned below the top surfaces of the sidewalls 114A, 114B and configured to be embedded in the foam 160 after the molding process. Increasing the width of the flanges 140A, 140B may help further position the flanges 140A, 140B into the foam 160 such that an increased amount of foam 160 engages the flanges 140A, 140B (see FIGS. 7-8 and 10). Increasing the width of the flanges 140A, 140B also helps retain the fastening tape 100 within the foam 160 in automotive and other applications as the amount of adhesion between the fastening tape 100 and the foam 160, or the "hook to foam strength," is increased compared to fastening tape without flanges or with flanges having a narrower width.

As illustrated in FIGS. 1 and 2, in some examples, the first flange 140A includes a first groove 142 defined in the top surface 108 and extending in the longitudinal direction 112 between the first sidewall 114A and the first edge 104. A non-folding portion 144 of the first flange 140A is between the first sidewall 114A and the first groove 142, and a folding portion 146 of the first flange 140A is between the first groove 142 and the first edge 104. The folding portion 146 may be folded around the first groove 142 and positioned at various folding angles relative to the non-folding portion 144. For example, the folding portion 146 may be positioned at a substantially zero angle relative to the non-folding portion 144 (see FIGS. 1, 2, 5, and 7) or at a non-zero angle relative to the non-folding portion 144 (see FIGS. 3A, 3B, 4, 6, 9, and 10). The non-zero angle can be any suitable angle such as 45°, 90°, or any other desired angle. In some examples, the folding portion 146 of the first flange 140A may be at the same angle as the folding portion 146 of the second flange 140B (see FIGS. 1, 3A, and 3B) or at a different angle than the angle of the folding portion of the second flange 140B (see FIG. 6). In some examples, the first groove 142 is dimensioned to allow for bending of the folding portion 146 by hand, although it need not be.

In various examples, the first flange 140A defines a plurality of apertures 148 that extend in the longitudinal direction 112 and that are positioned between the first sidewall 114A and the first edge 104. The apertures 148 are configured to allow liquid urethane (or other materials in which the fastening tape 100 is set) to penetrate through the first flange 140A and form foam 160 (see FIGS. 7-8 and 10) that cures at least partially within the apertures 148. Allowing the foam 160 to penetrate through the apertures 148 may aid in retaining the fastening tape 100 within the foam 160 in automotive seats and other applications as the amount of adhesion between fastening tape 100 and the foam 160, or the "hook to foam strength," is increased compared to fastening tape without apertures 148.

In the present example, the apertures 148 are elongated in the longitudinal direction 112 such that each aperture 148 has a first end 150 and a second end 152. In some examples, a distance from the first end 150 to the second end 152, or a length of the aperture 148, is greater than the flange width, although it need not be. The shape, dimensions and number of the apertures 148 should not be considered limiting on the current disclosure as in various other examples, the apertures 148 may have various shapes/dimensions or any suitable number of apertures 148 may be present as desired. As illustrated in FIG. 1, in some examples, when the apertures 148 are present, the first groove 142 intersects each aperture 148. In some cases, the apertures 148 of the first flange 140A are aligned with the apertures 148 of the second flange 140B in the lateral direction 110. In various other examples, the apertures 148 of the first flange 140A are offset relative to the apertures 148 of the second flange 140B in the lateral direction 110.

Figure 5:
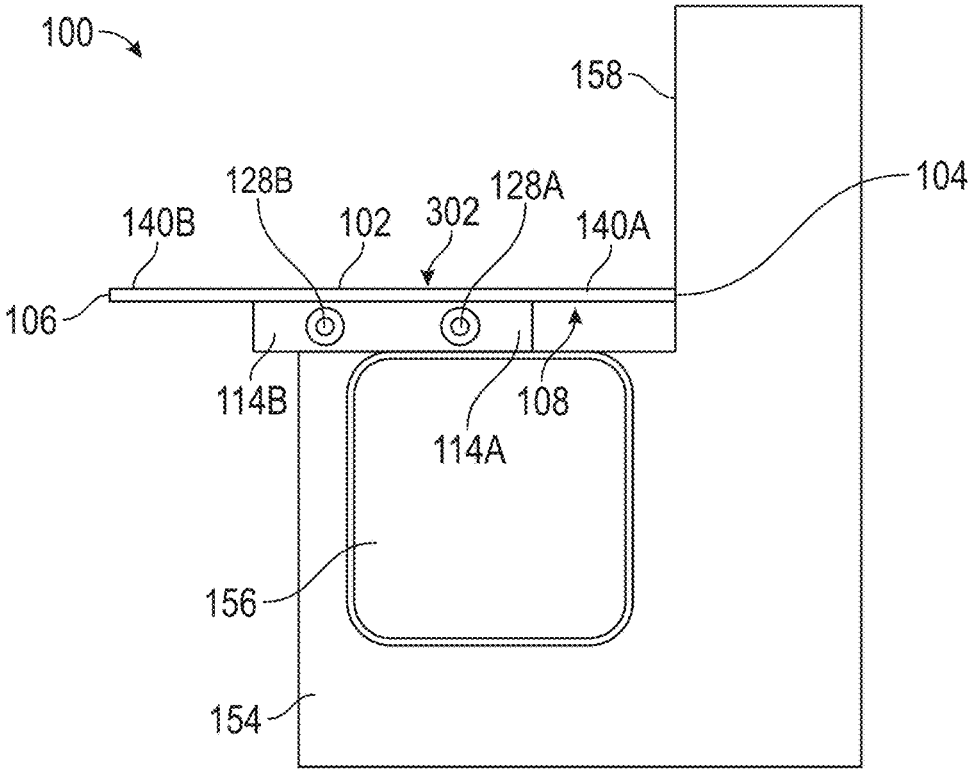
FIG. 5 is an end view of the segment of fastening tape of FIG. 1 positioned on the trench of FIG. 4 with folding portions of flanges of the fastening tape in an unfolded configuration.
Figure 6:
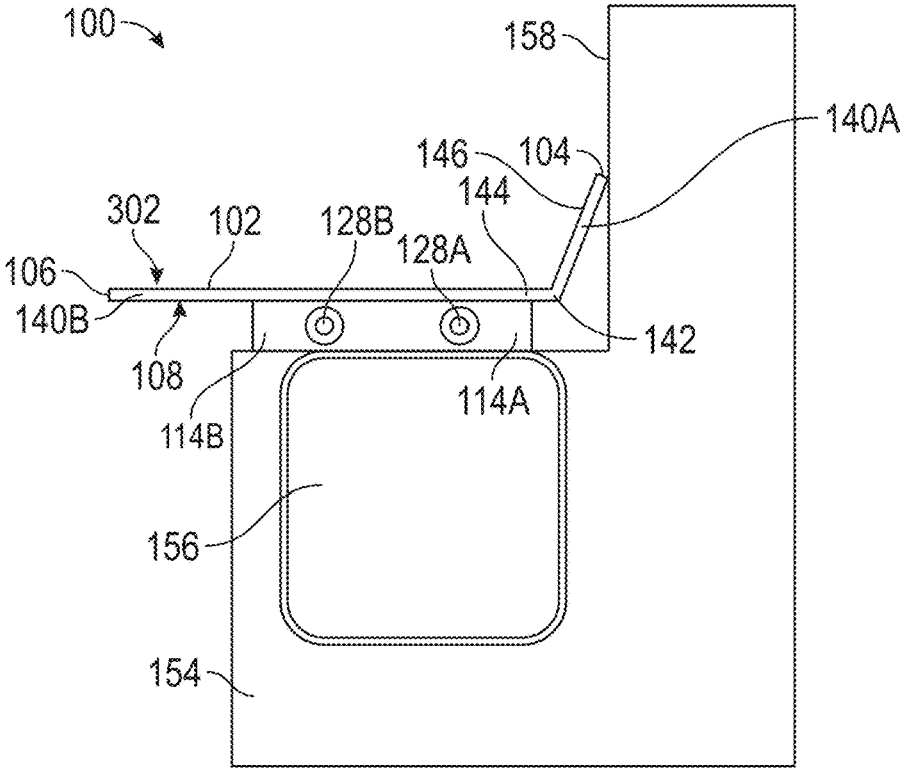
FIG. 6 is an end view of the segment of fastening tape of FIG. 1 positioned on the trench of FIG. 4 with folding portions of flanges of the fastening tape in a folded configuration.
Figure 7:
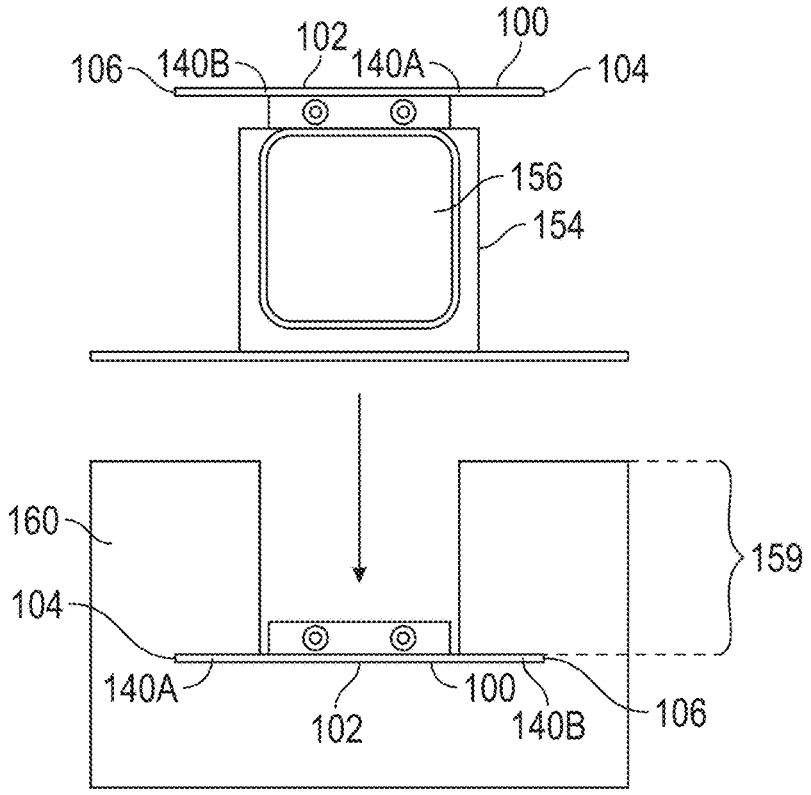
FIG. 7 is an end view of the segment of fastening tape of FIG. 1 on a step trench.
Figure 8:
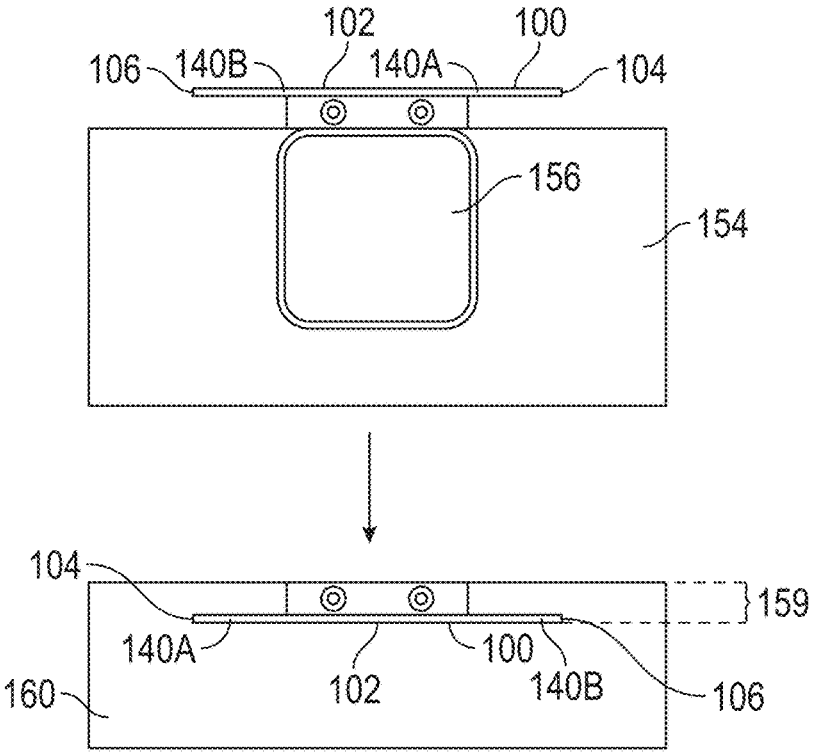
FIG. 8 is an end view of the segment of fastening tape of FIG. 1 on a flat trench.
Figure 9:
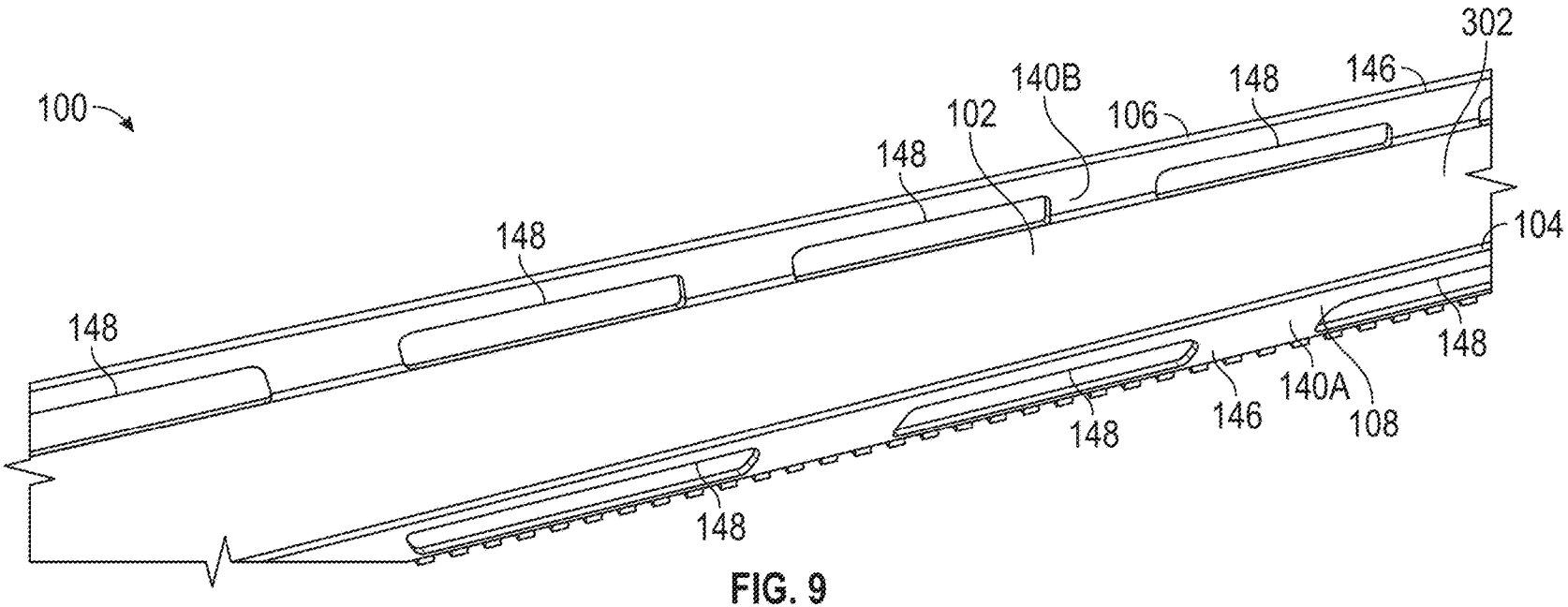
FIG. 9 is a top perspective view of the segment of fastening tape of FIG. 1 with folding portions of flanges of the fastening tape in a folded configuration.
Figure 10:
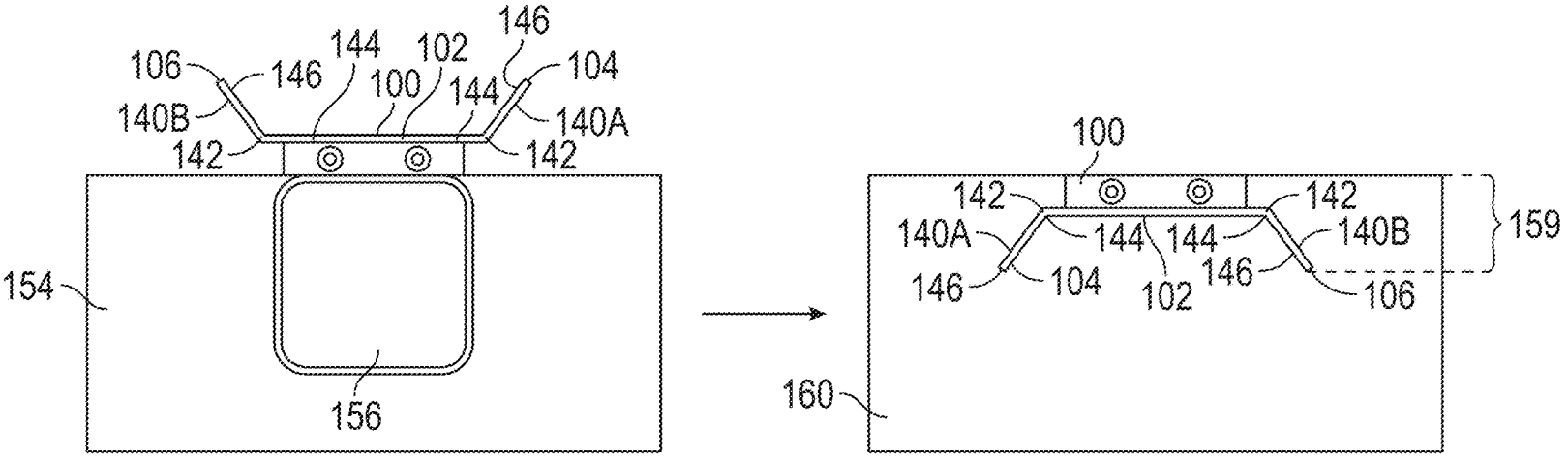
FIG. 10 is an end view of the segment of fastening tape of FIG. 1 positioned on a flat trench with folding portions of flanges of the fastening tape in a folded configuration.

Referring to FIGS. 4-10, during a process of forming various articles and components, such as automotive seats, the fastening tape 100 is positioned on a trench 154 within a mold. A magnet 156 (FIGS. 5-8 and 10) of the trench 154 cooperates with the magnetic material 128 of the fastening tape 100 to hold the fastening tape 100 in place as the urethane (or other material) is injected around the fastening tape 100. As shown in FIGS. 7-8 and 10, once the urethane cures, the fastening tape 100 is retained within the foam 160 forming the seat cushion or other desired product. As described in detail below, the shape of the trench 154 may vary depending on manufacturer, component being formed, or various other factors.

An important consideration of the forming process is having the fastening tape 100 properly positioned on the trench 154 prior to injection of the urethane. Misalignment of the fastening tape 100 on the trench 154 may result in the fastening tape 100 being improperly set within the foam 160 and may lead to foam intrusion. In some cases, as illustrated in FIGS. 5-6, the trench 154 may include a wall 158 or other obstacle that may prevent a fastening tape from being properly positioned on the trench 154. As illustrated in FIG. 6, with the fastening tape 100, the folding portion 146 of the first flange 140A (and/or the second flange 140B) may be folded at the first groove 142 to a desired angle relative to the non-folding portion 144 such that the fastening tape 100 may be properly positioned relative to the wall 158.

Another important consideration is the hook to foam strength for retaining the fastening tape 100 within the foam 160. In various cases, it may be desirable for the fastening tape 100 to have a relatively strong adhesion between the fastening tape 100 and the foam 160 such that the fastening tape 100 may resist various peeling forces or other forces that may be applied to the fastening tape 100. Without a sufficient hook to foam strength, these peeling or other forces may undesirably cause the fastening tape 100 to separate from the foam 160. In some cases, a peeling force may be applied to the fastening tape 100 during the forming process or during use.

As illustrated in FIG. 7, in some cases, the trench 154 is a step trench, and when urethane is introduced, a thickness 159 between the fastening tape 100 and the top of the foam 160 creates a strong undercut effect that helps retain the fastening tape 100 within the foam 160 (i.e. the hook to foam strength is generally strong for retaining the fastening tape 100 within the foam 160). In other examples, as illustrated in FIG. 8, the trench 154 is a flat trench with no step. In the example illustrated in FIG. 8, the thickness 159 between the fastening tape 100 and the top of the foam 160 retaining the fastening tape 100 within the foam 160 is less than that illustrated in FIG. 7. This reduced thickness 159 of foam 160 illustrated in FIG. 8 creates a relatively weak undercut effect for retaining the fastening tape 100 (i.e. the hook to foam strength is generally weaker in the flat trench).

Referring to FIGS. 9 and 10, to increase the undercut effect of the fastening tape 100 within the foam 160 (and accordingly to increase the hook to foam strength), the folding portions 146 of the first flange 140A and the second flange 140B are angled at non-zero angles relative to the non-folding portions 144 of the first flange 140A and the second flange 140B via the first grooves 142. As illustrated in FIG. 10, angling of the folding portions 146 aids in increasing the thickness 159 of the foam 160 between the flanges 140A and 140B of the fastening tape 100 and the top of the foam 160. Increasing the thickness 159 of the foam 160 in turn increases the undercut effect and increases the hook to foam strength. Angling the folding portions 146 via the first grooves 142 may be used to increase the hook to foam strength in both the step trenches and trenches with no step, among various other types of trenches 154.

Figure 11:
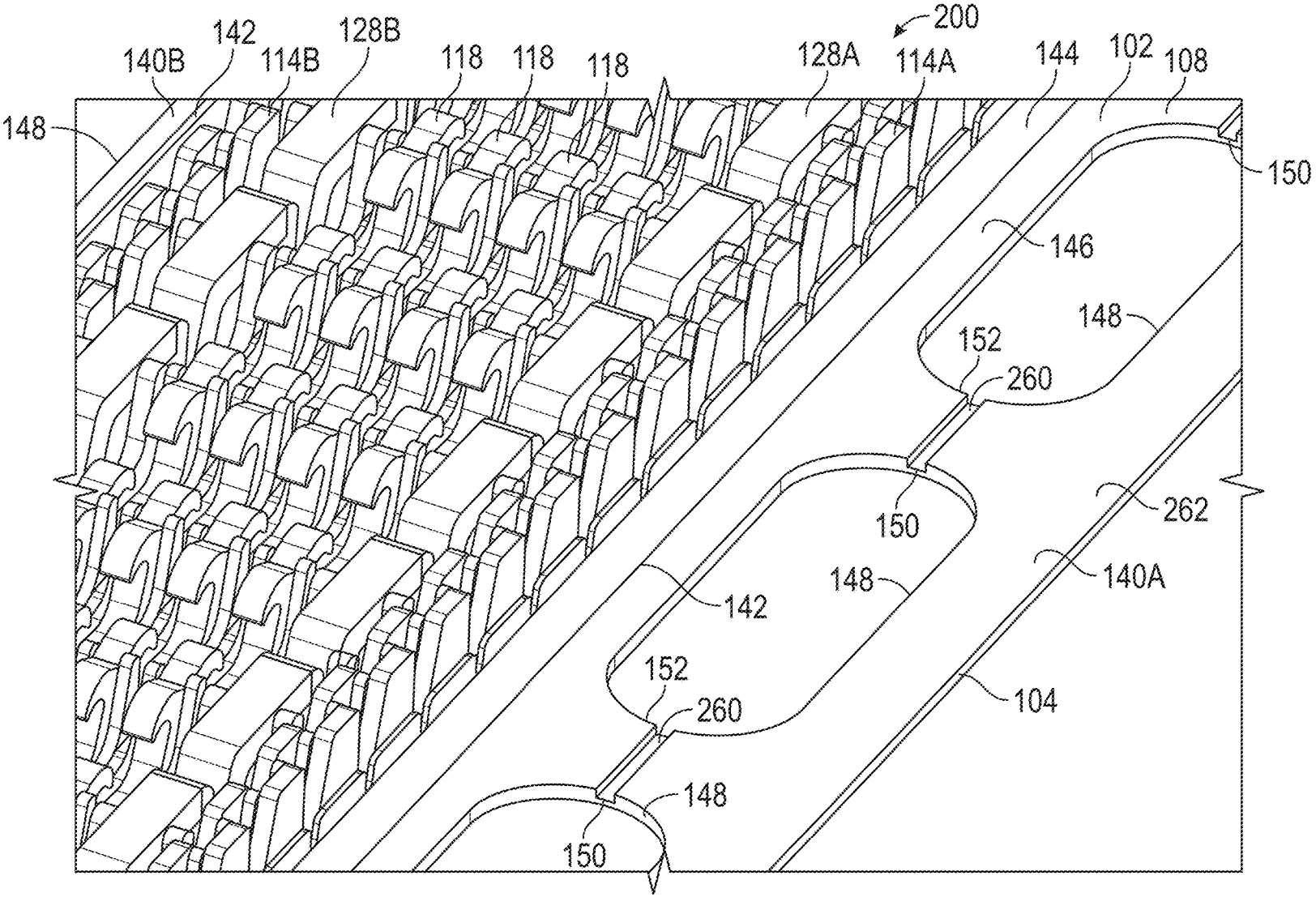
FIG. 11 is a top perspective view of a portion of a segment of a fastening tape according to aspects of the present disclosure.
Figure 12:
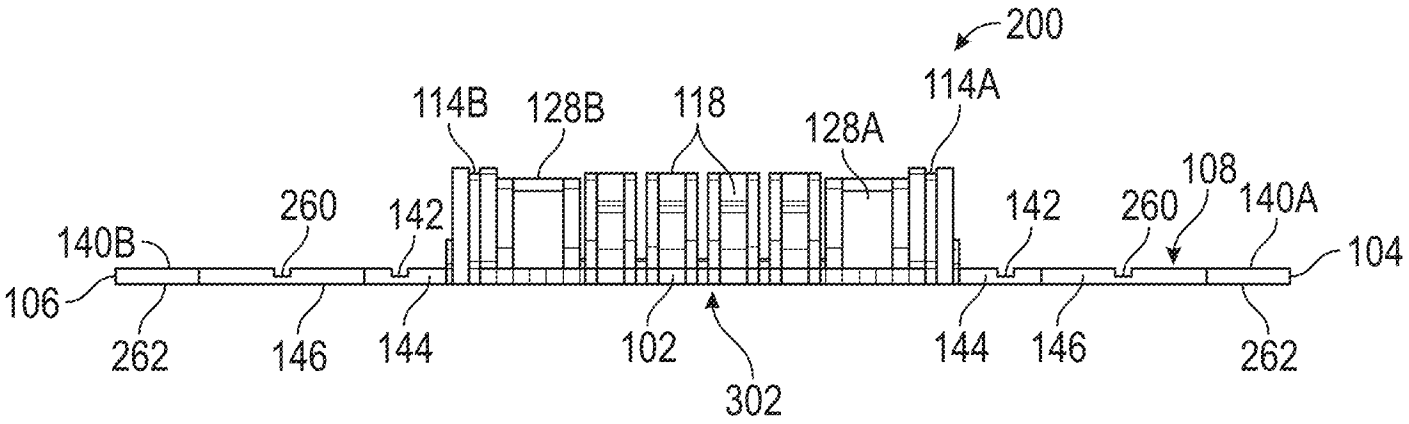
FIG. 12 is an end view of the segment of fastening tape of FIG. 11.

FIGS. 11 and 12 illustrate an example of a fastening tape 200 that is substantially similar to the fastening tape 100, except that the first flange 140A of the fastening tape 200 (and optionally the second flange 140B) includes the first groove 142 and a second groove 260 defined in the top surface 108. Similar to the first groove 142, the second groove 260 extends in the longitudinal direction 112 between the first sidewall 114A and the first edge 104. As illustrated in FIGS. 11 and 12, in some examples, the second groove 260 is between the first groove 142 and the first edge 104. As illustrated, the second groove 260 extends between an end 150 of an aperture 148 and an end 152 of an adjacent aperture 148 in various examples. The second groove 260 is positioned approximately midway along the length of the aperture 148 in the lateral direction 110, although it need not be. In the illustrated example, the first groove 142 does not intersect the apertures 148.

In various examples, the non-folding portion 144 of the first flange 140A is between the first sidewall 114A and the first groove 142, the folding portion 146 is between the first groove 142 and the second groove 260, and a second folding portion 262 is between the second groove 260 and the first edge 104. In these examples, the second folding portion 262 may be positioned at various folding angles relative to the non-folding portion 144 and the folding portion 146. In a similar manner, the folding portion 146 may be positioned at various folding angles relative to the non-folding portion 144 and the second folding portion 262. In various other examples, additional grooves extending in the longitudinal direction 112 may be provided such that additional folding portions may be defined.

FIGS. 13-15 and 17 illustrate an example of a fastening tape 300 that is substantially similar to the fastening tape 100, except that the apertures 148 are omitted, and the first flange 140A of the fastening tape 300 (and optionally the second flange 140B) further includes a plurality of lateral slits 364. In these examples, the lateral slits 364 are defined at regular intervals along the first flange 140A, although they need not be. Each lateral slit 364 extends from proximate the first edge 104 to proximate the first sidewall 114A in the lateral direction 110, and includes an outer end 366 proximate the first edge 104 and an inner end 368 proximate the first sidewall 114A. In some examples, the outer end 366 extends to the first edge 104 such that a lateral slit opening 370 is defined at the first edge 104. In other examples, the outer end 366 is separated from the first edge 104, and the lateral slit opening 370 is omitted (see FIGS. 31 and 32). When the outer end 366 is separated from the first edge 104, a bridging portion 881 of the first flange 140A exists between the outer end 366 of the lateral slit 364 and the first edge 104 (see FIGS. 31 and 32).

Figure 13:
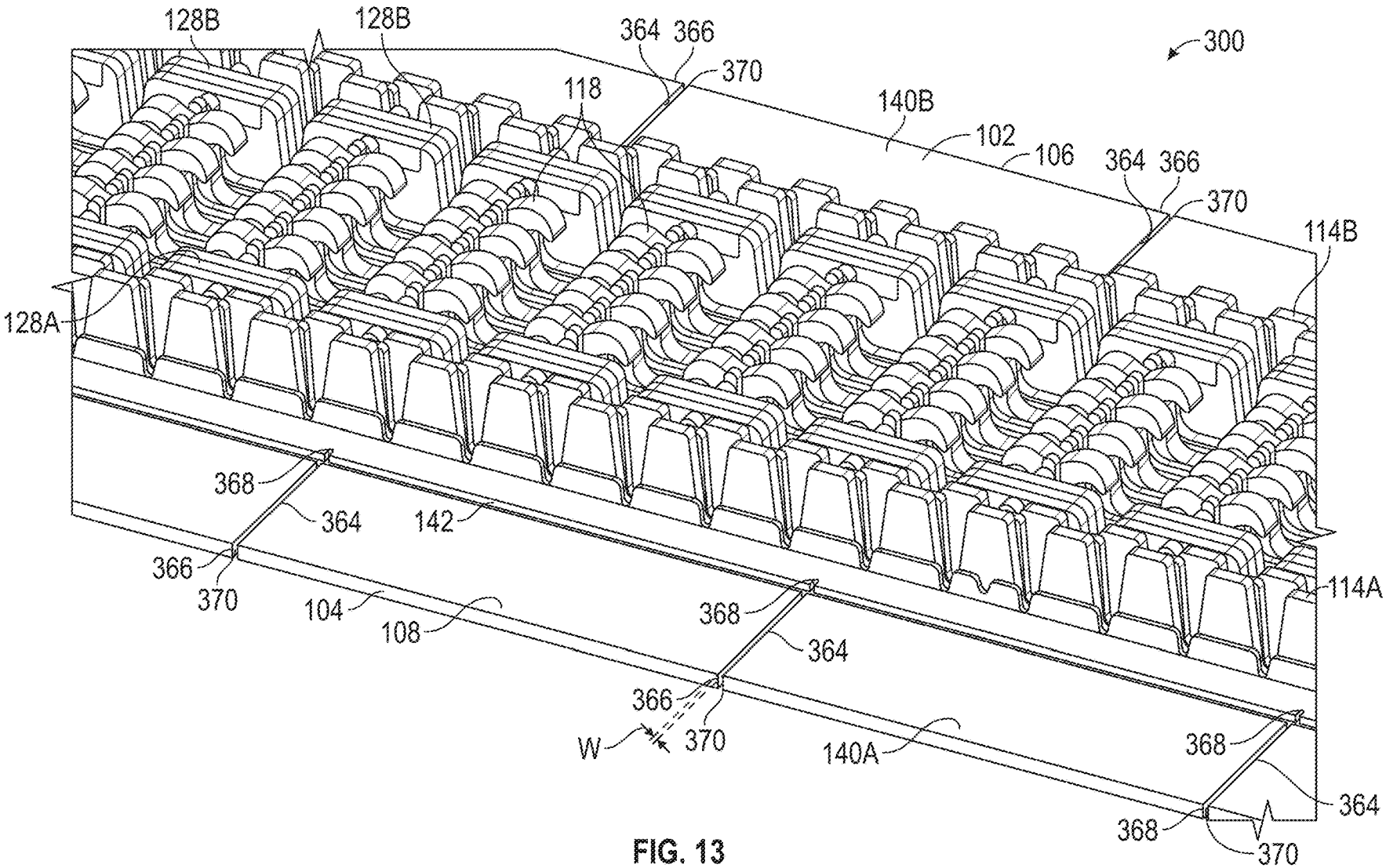
FIG. 13 is a top perspective view of a segment of a fastening tape according to aspects of the present disclosure.
Figure 14:
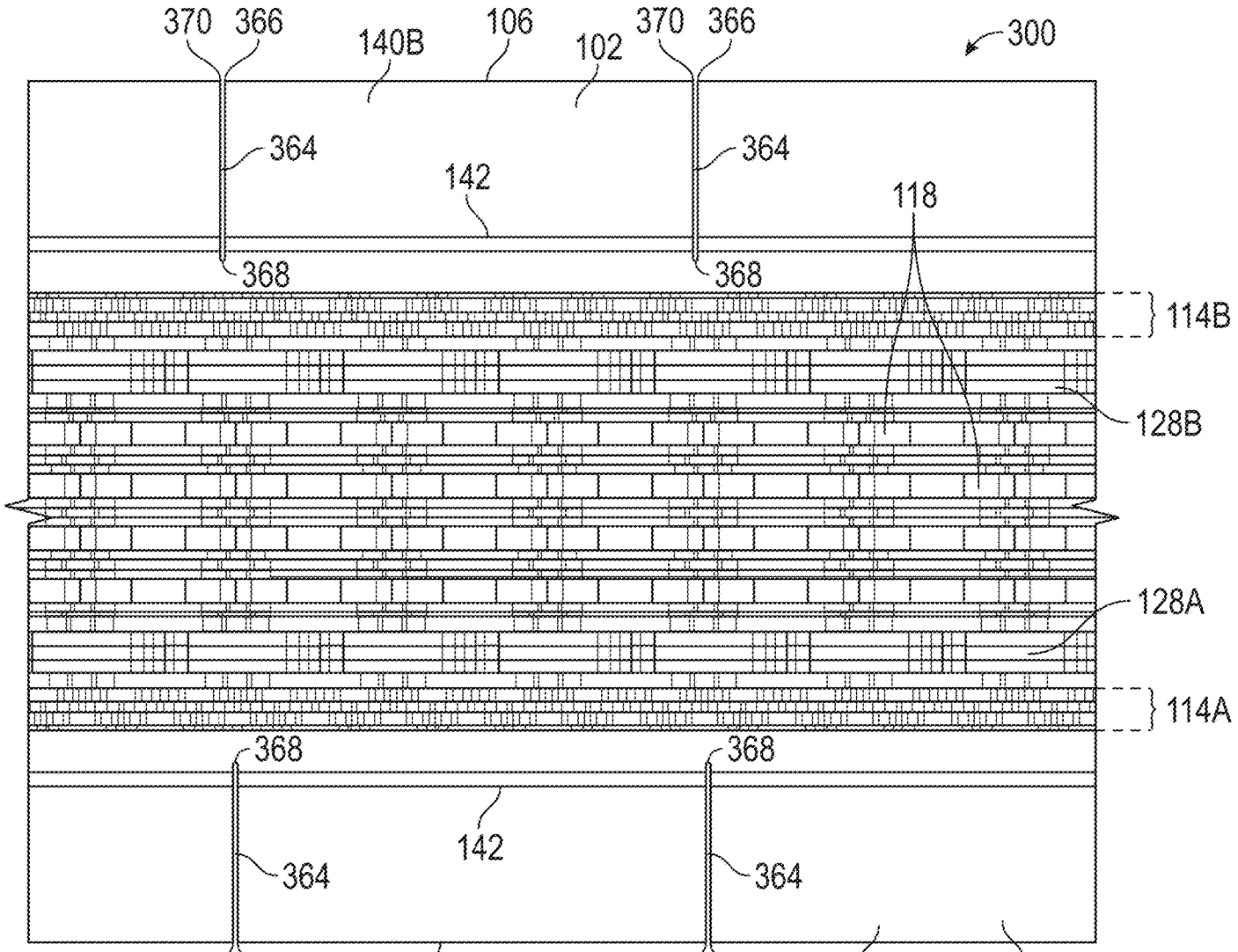
FIG. 14 is a top view of the segment of fastening tape of FIG. 13.
Figure 15:
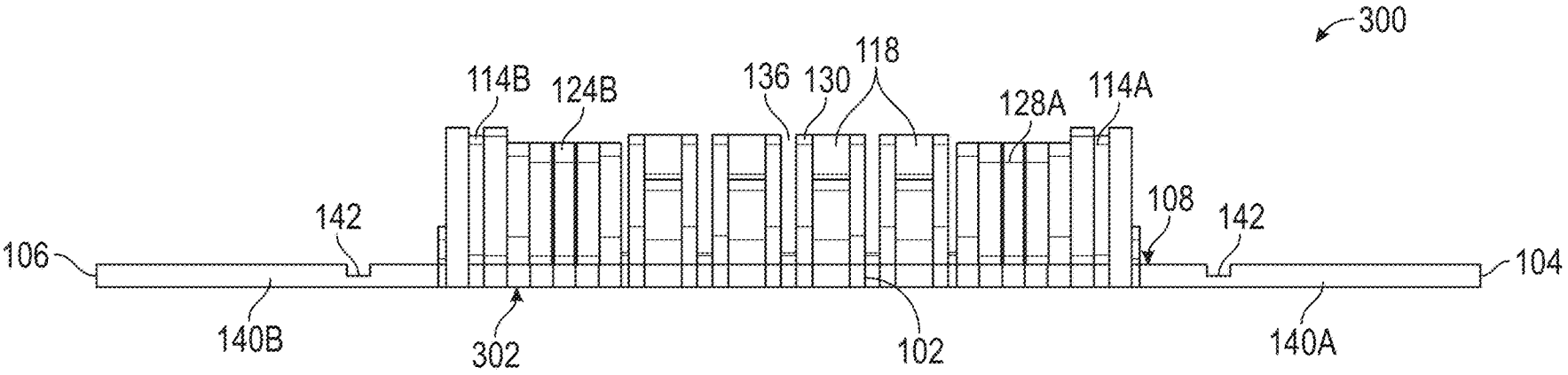
FIG. 15 is an end view of the segment of fastening tape of FIG. 13.

As illustrated in FIGS. 13 and 14, the first groove 142 intersects each of the lateral slits 364, although it need not. In some examples, the first groove 142 intersects each of the lateral slits 364 between the outer end 366 and the inner end 368 (see FIGS. 13 and 14). In other examples, the first groove 142 intersects each of the lateral slits 364 at the inner end 368. In various cases, the lateral slits 364 are substantially perpendicular to the first groove 142, although they need not be. As illustrated in FIGS. 13 and 14, each lateral slit 364 has a slit width W, which is less than the flange width in various examples. In some examples, the lateral slits 364 of the first flange 140A are aligned with the lateral slits 364 of the second flange 140B in the lateral direction 110 (see FIG. 14). In other examples, the lateral slits 364 of the first flange 140A are offset with respect to the lateral slits 364 of the second flange 140B in the lateral direction 110.

Figure 16:
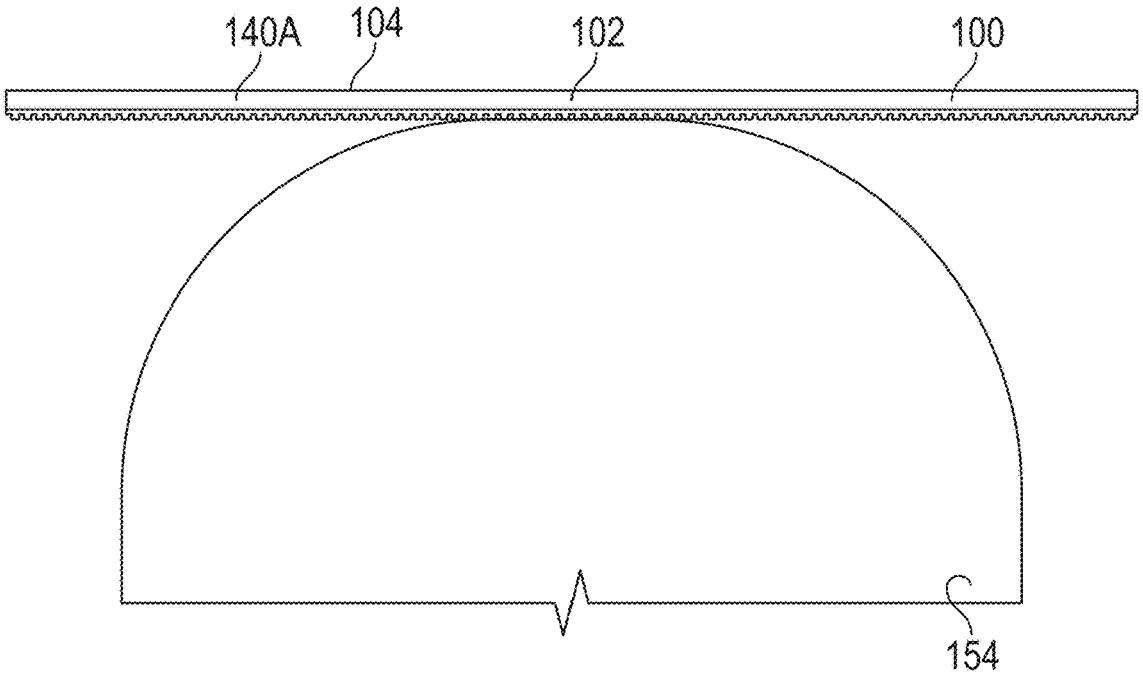
FIG. 16 is a side view of the segment of fastening tape of FIG. 1 on a convex trench.
Figure 17:
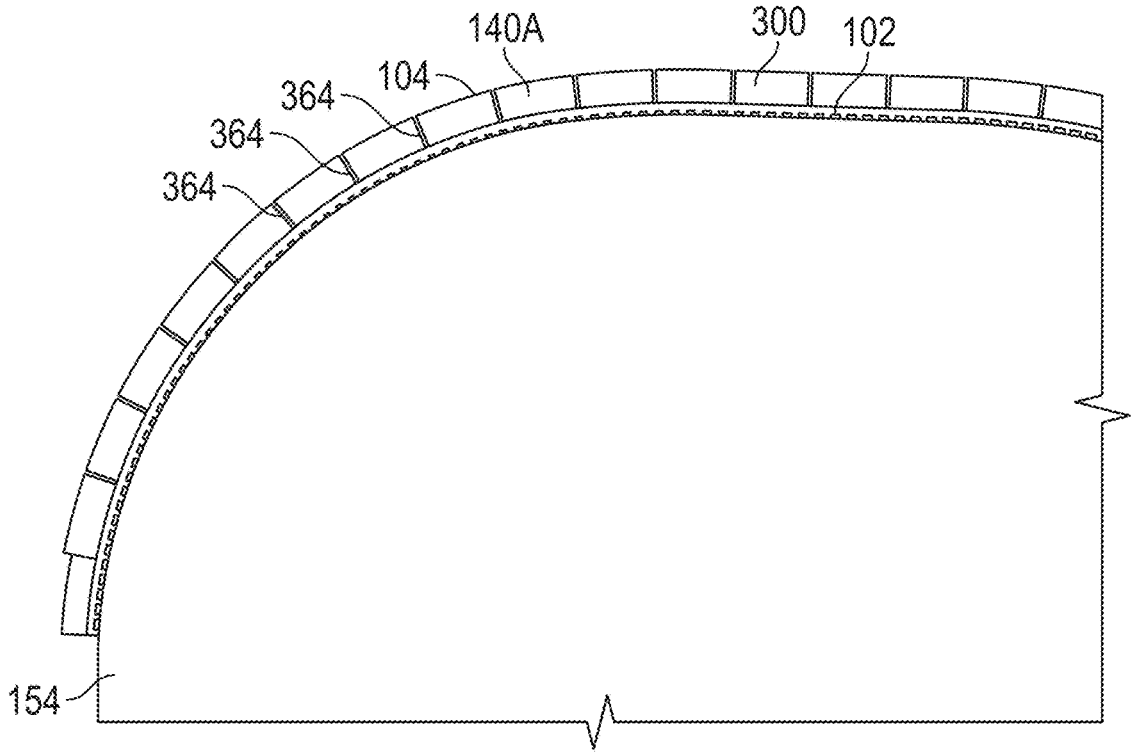
FIG. 17 is a side view of the segment of fastening tape of FIG. 13 on a convex trench.

When included, the lateral slits 364 can provide flexibility to the fastening tape 100 in the longitudinal direction 112 such that the fastening tape 300 better conforms to various-shaped trench surfaces. For example, as illustrated in FIG. 16, in some forming processes, the trench 154 may be a convex trench or have various other non-linear shapes. As illustrated in FIG. 16, the fastening tape 100 without lateral slits 364 may have difficulty conforming to the shape of the trench 154. On the other hand, as illustrated in FIG. 17, because the lateral slits 364 provide flexibility in the longitudinal direction 112, the fastening tape 300 is able to better conform to the surface of the convex trench 154.

Figure 18:
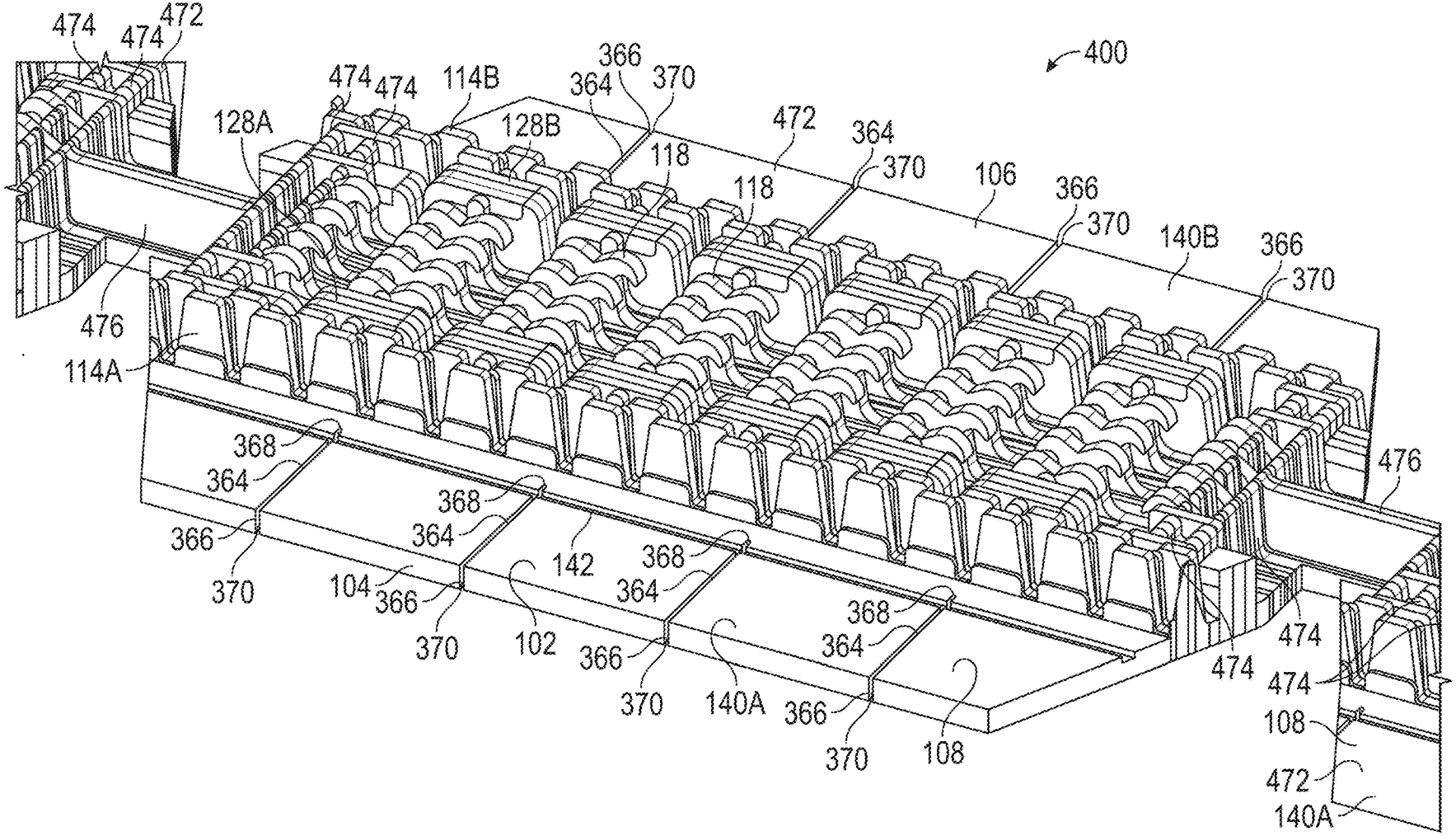
FIG. 18 is a top perspective view of a segment of fastening tape according to aspects of the present disclosure.
Figure 19:
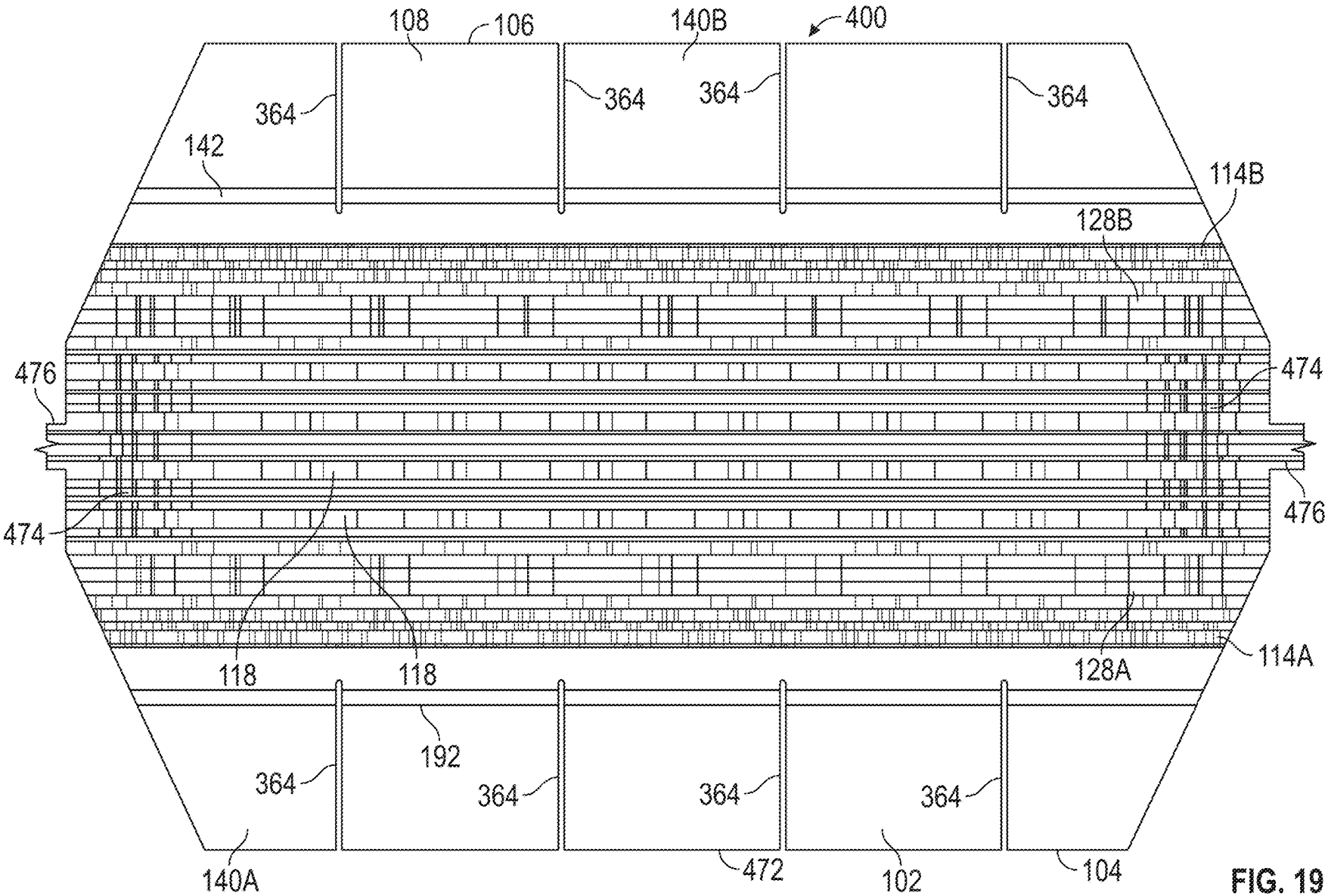
FIG. 19 is a top view of the segment of fastening tape of FIG. 18.
Figure 20:
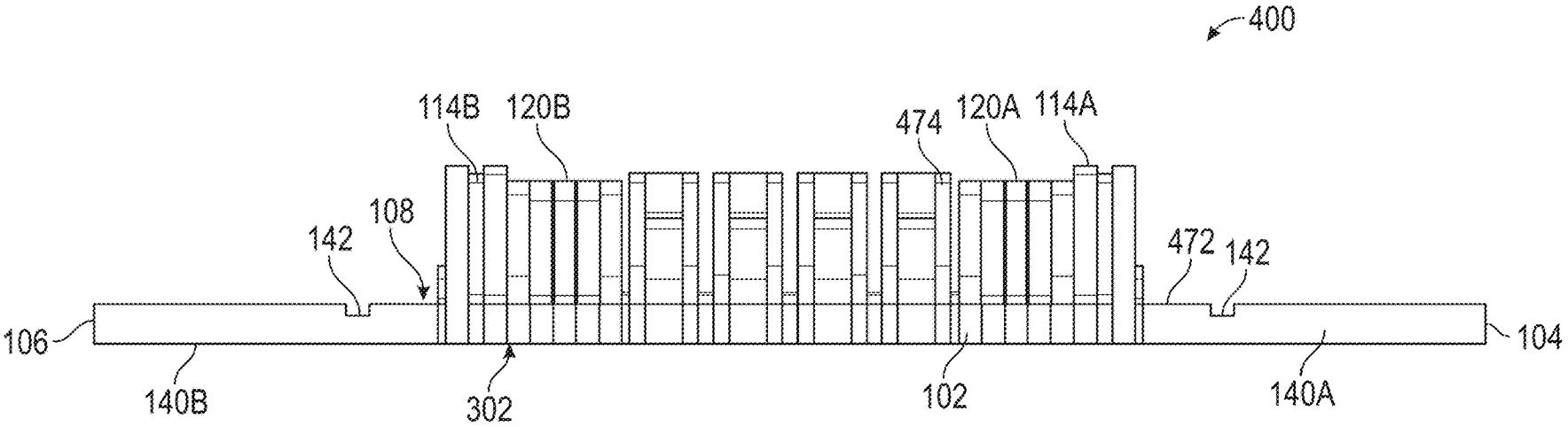
FIG. 20 is an end view of the segment of fastening tape of FIG. 18.

FIGS. 18-20 illustrate another example of a fastening tape 400 having a plurality of joined fastening tape segments 472. Each fastening tape segment 472 is constructed similar to the fastening tape 300. As illustrated, each fastening tape segment 472 also has barrier walls 474 extending in the upward direction from the top surface 108. As illustrated, the fastening tape segments 472 are connected to one another by a flexible element 476.

Figure 21:
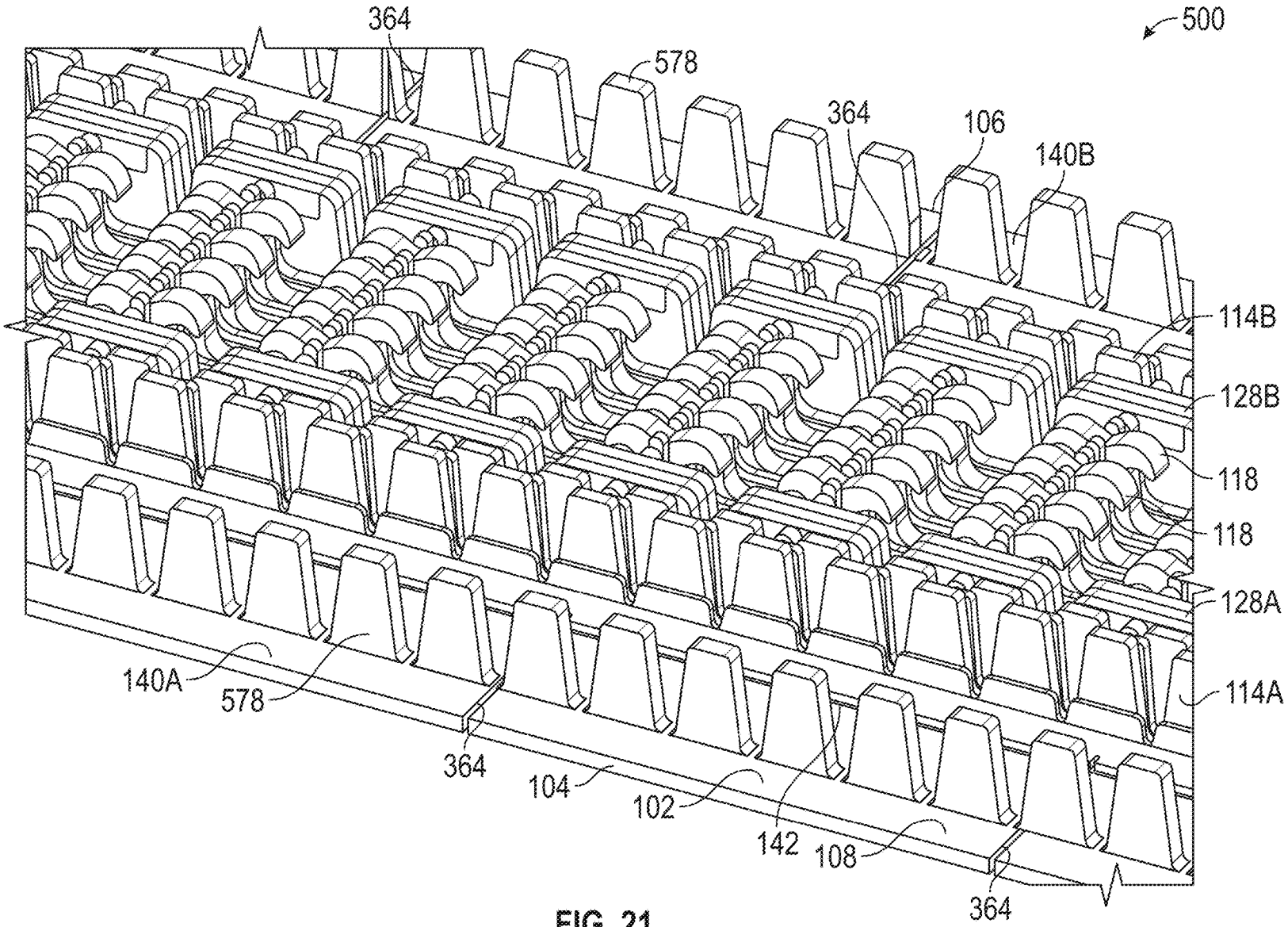
FIG. 21 is a top perspective view of a segment of fastening tape according to aspects of the present disclosure.
Figure 22:
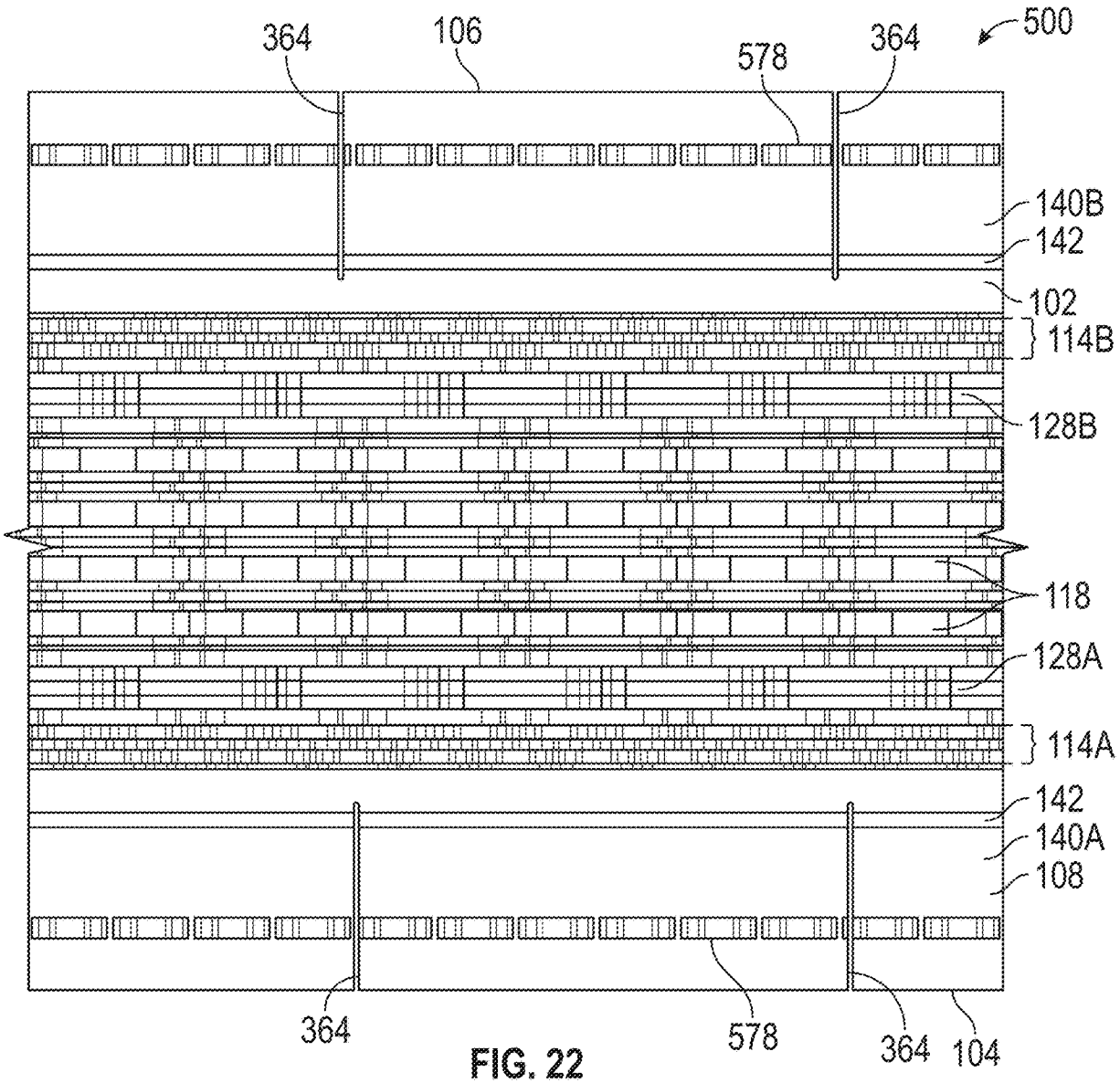
FIG. 22 is a top view of the segment of fastening tape of FIG. 21.
Figure 23:
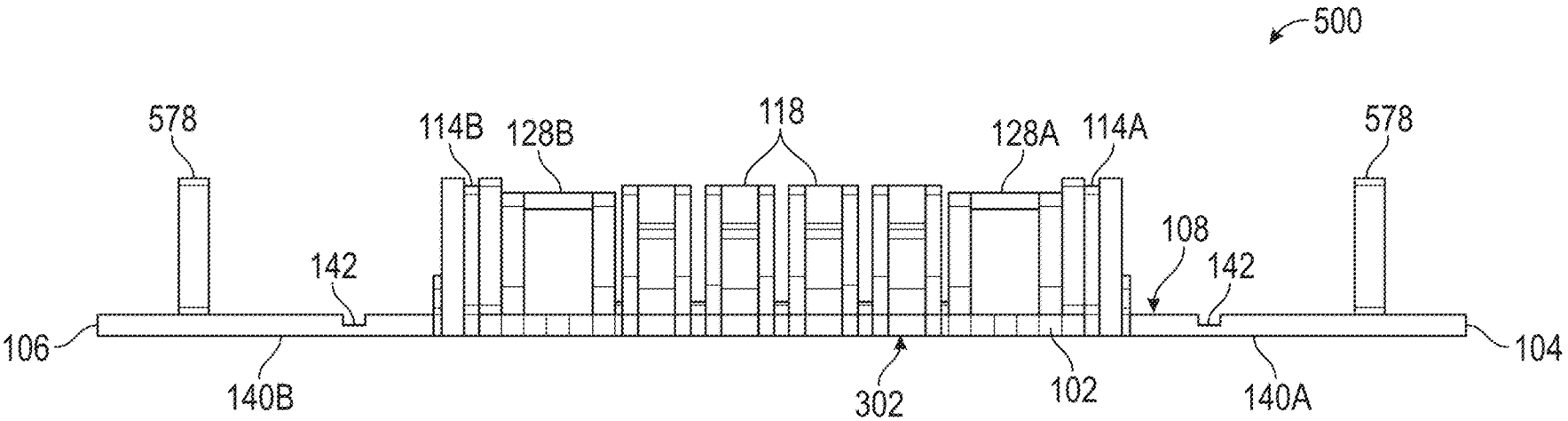
FIG. 23 is an end view of the segment of fastening tape of FIG. 21.
Figure 24:
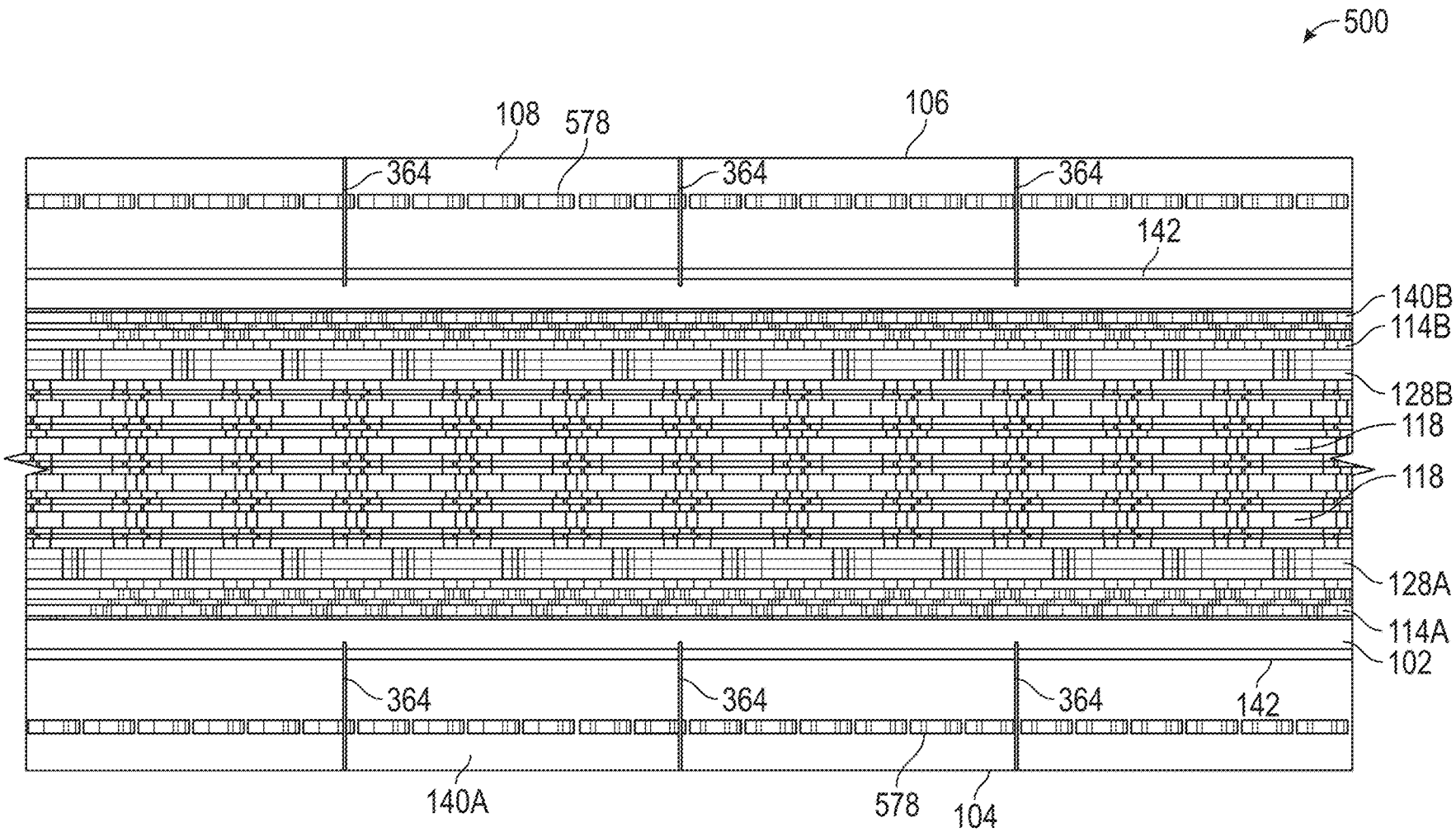
FIG. 24 is another top view of the segment of fastening tape of FIG. 21.

FIGS. 21-24 illustrate an example of a fastening tape 500 that is substantially similar to the fastening tape 300, except that the first flange 140A of the fastening tape 400 (and optionally the second flange 140B) further includes a protrusion 578. As illustrated, the protrusion 578 extends in the upward direction from the top surface 108, and extends along the top surface 108 in the longitudinal direction 112. The protrusion 578 is positioned between the first sidewall 114A and the first edge 104. In some examples, the protrusion 578 is positioned between the first groove 142 and the first edge 104. As illustrated in FIGS. 21, 22, and 24, the lateral slits 364 are transverse to the protrusion 578. In some cases, the lateral slits 364 may intersect the protrusion 578 or extend between components of the protrusion 578.

In various examples, a distance from the first sidewall 114A to the protrusion 578 is greater than a height of the first sidewall 114A, although it need not be. A height of the protrusion 578 may be about the same as the height of the first sidewall 114A, less than the height of the first sidewall 114A, or greater than the height of the first sidewall 114A.

In the illustrated example, the protrusion 578 includes a plurality of plateaus and valleys. The plateaus and valleys may be present at regular or irregular intervals. The protrusion 578 can have various-shaped profiles and is not limited to the illustrated arrangement. In some cases, the protrusion 578 does not have a plurality of plateaus and valleys. In some examples, similar to the first sidewall 114A, the protrusion 578 may include a number of outer wall components. The protrusion 578 is arranged to provide support to the first flange 140A during a molding process and increase the hook to foam strength of the fastening tape 500.

Figure 25:
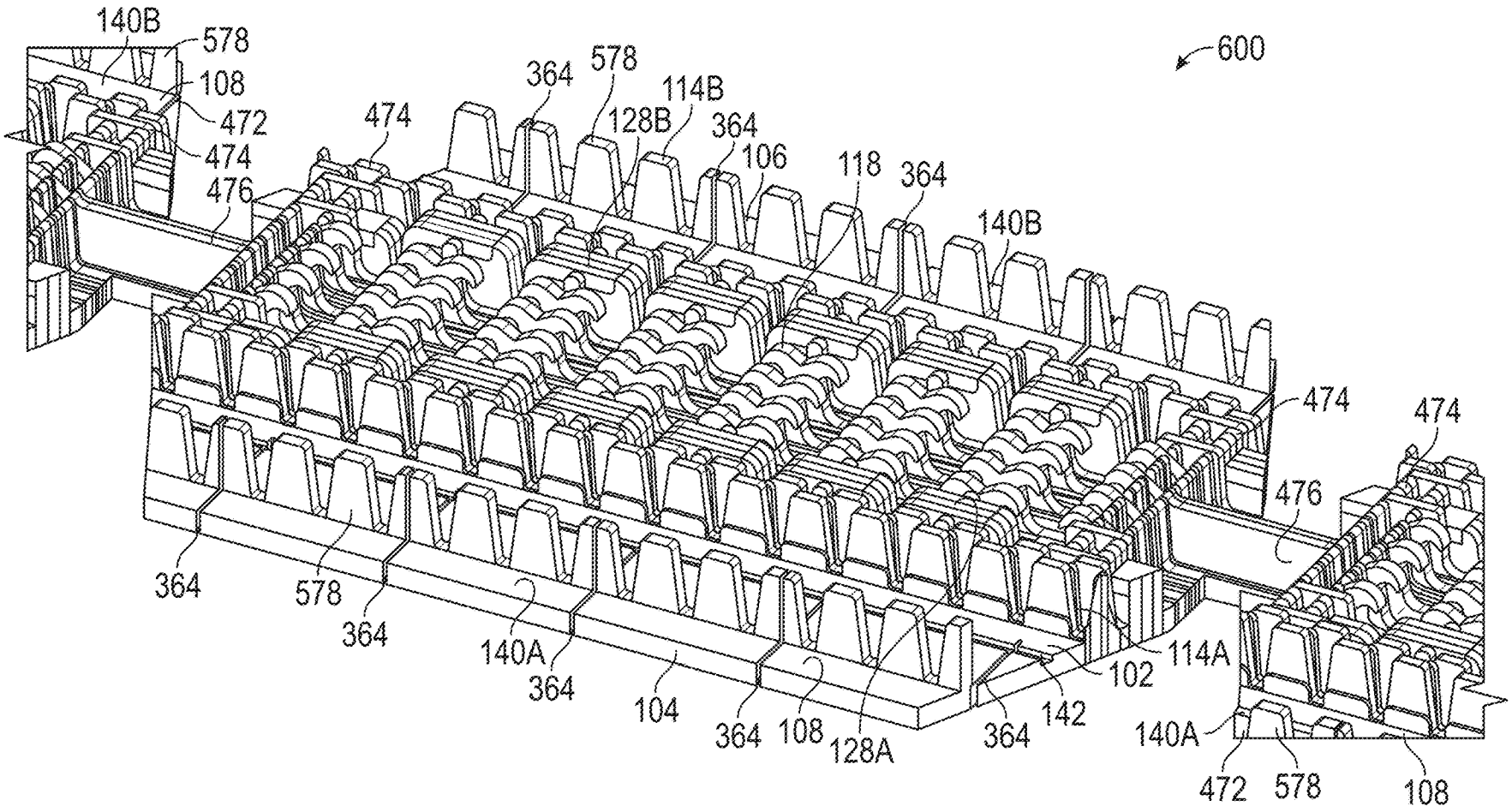
FIG. 25 is a top perspective view of a segment of fastening tape according to aspects of the present disclosure.
Figure 26:
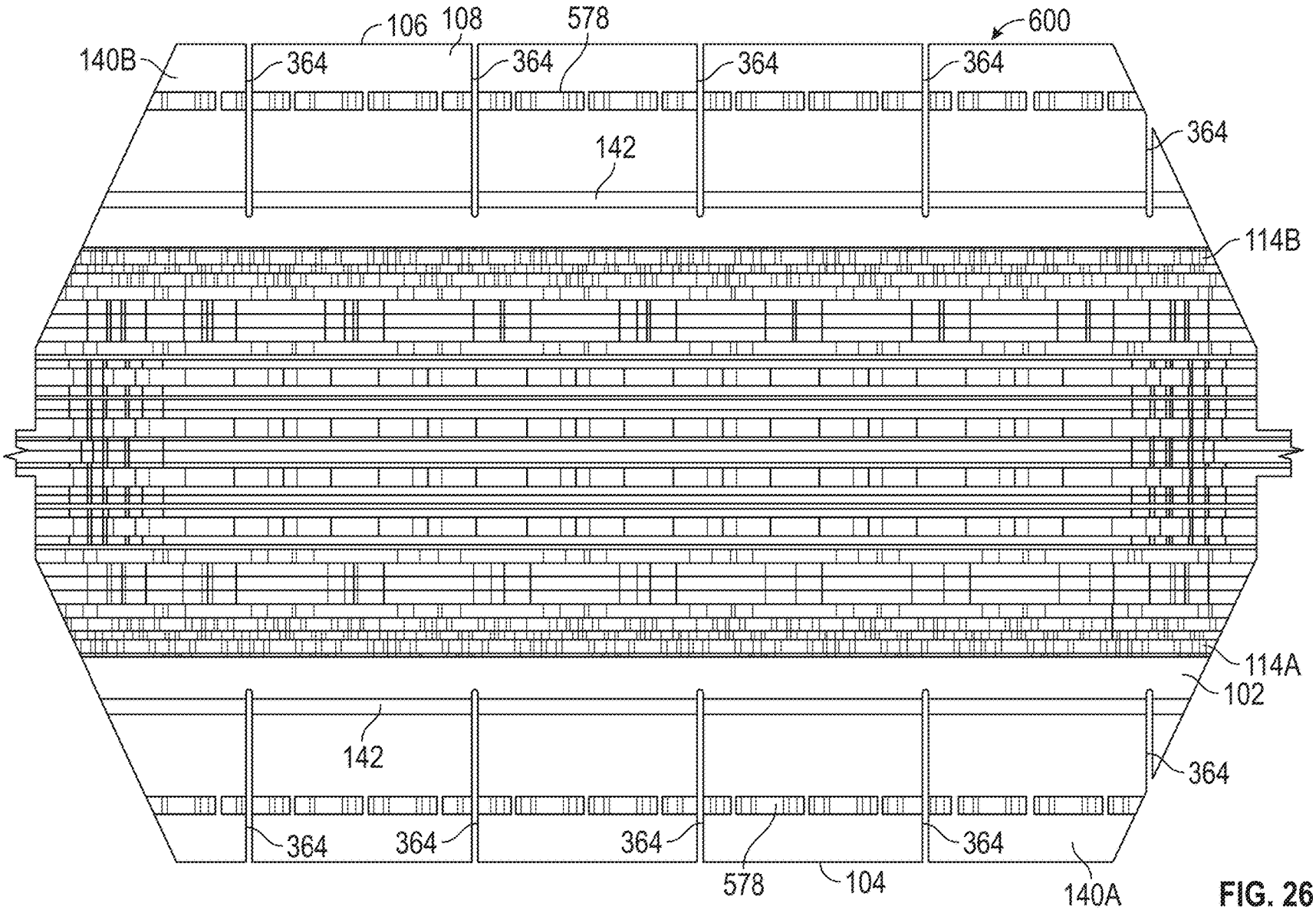
FIG. 26 is a top view of the segment of fastening tape of FIG. 25.
Figure 27:
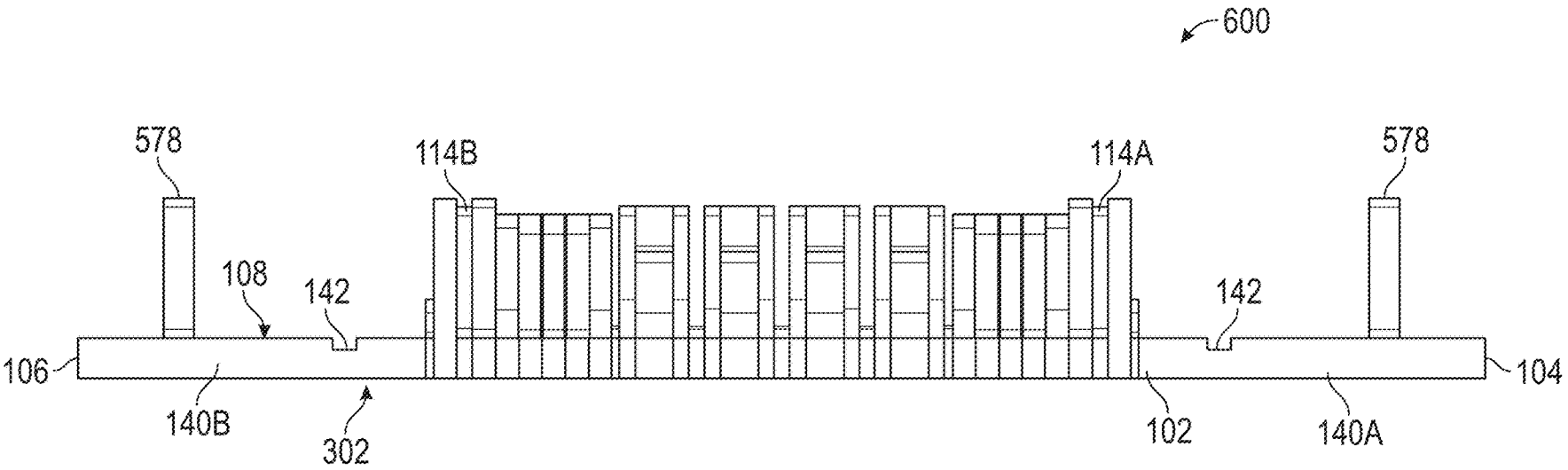
FIG. 27 is an end view of the segment of fastening tape of FIG. 27.

FIGS. 25-27 illustrate a fastening tape 600 that is similar to the fastening tape 400 in that the fastening tape 600 includes fastening tape segments 472 connected to one another by the flexible element 476. Each fastening tape segment 472 of the fastening tape 600 has a configuration similar to the fastening tape 500.

Figure 28:
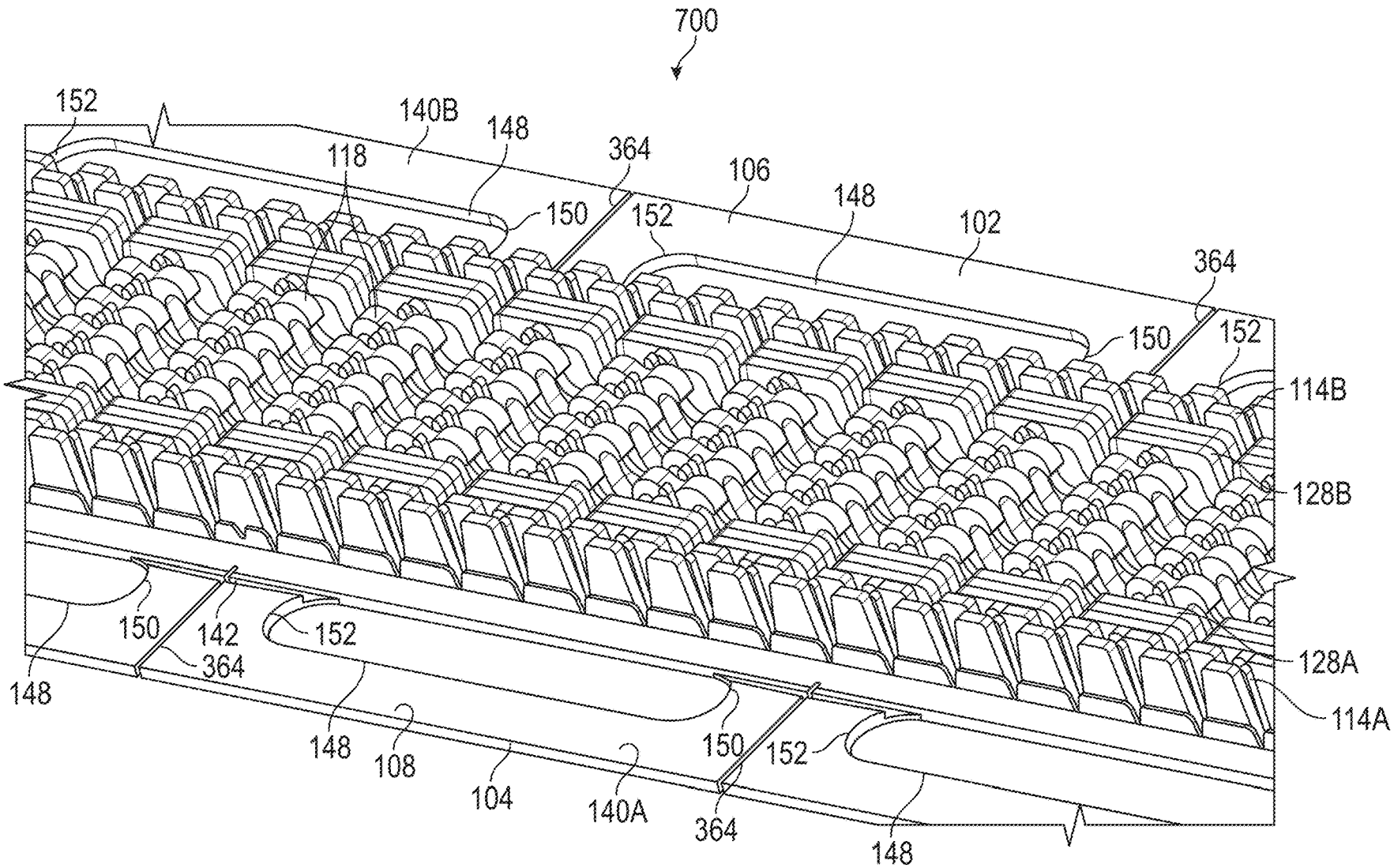
FIG. 28 is a top perspective view of a segment of fastening tape according to aspects of the present disclosure.
Figure 29:
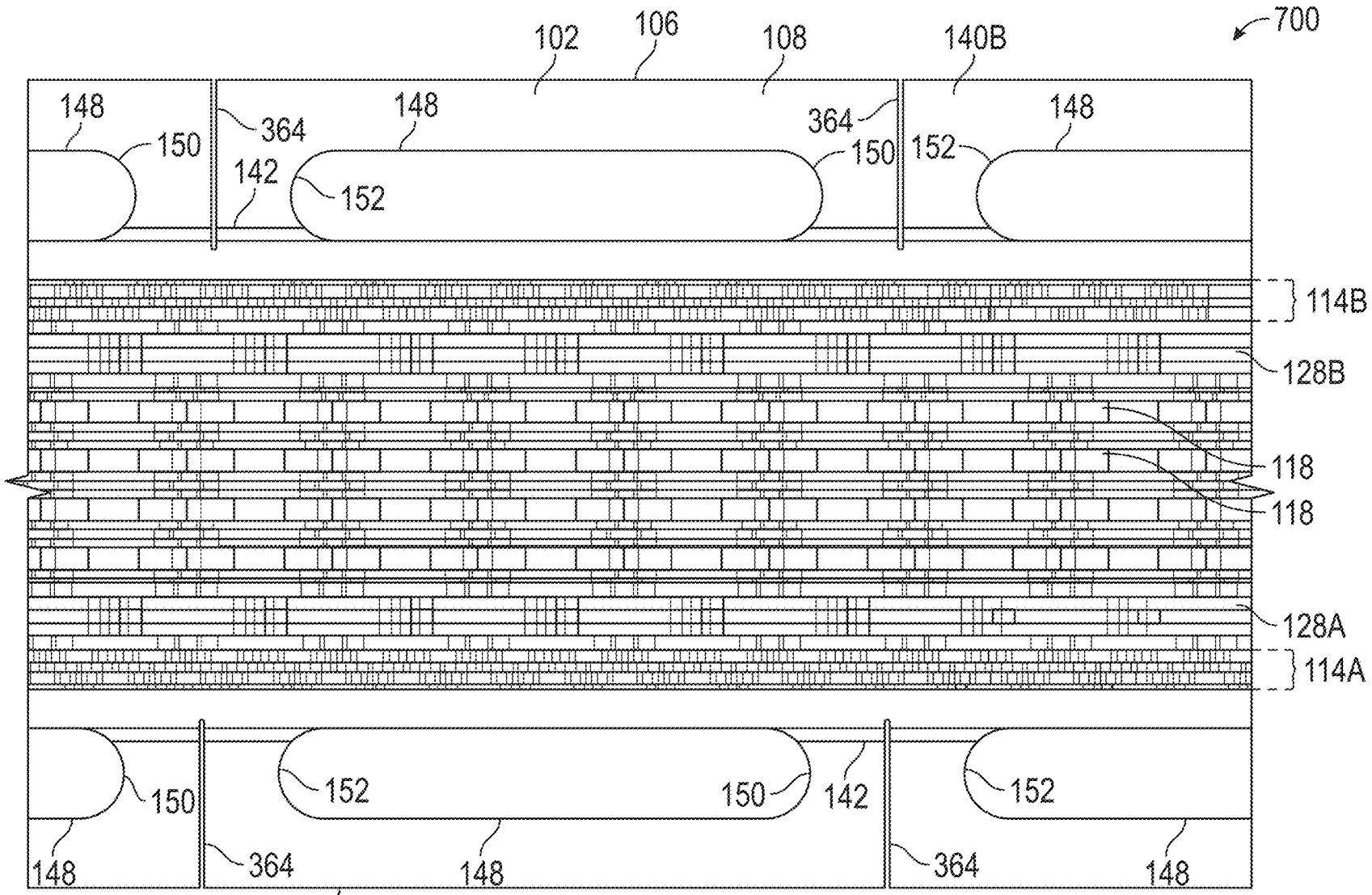
FIG. 29 is a top view of the segment of fastening tape of FIG. 28.
Figure 30:
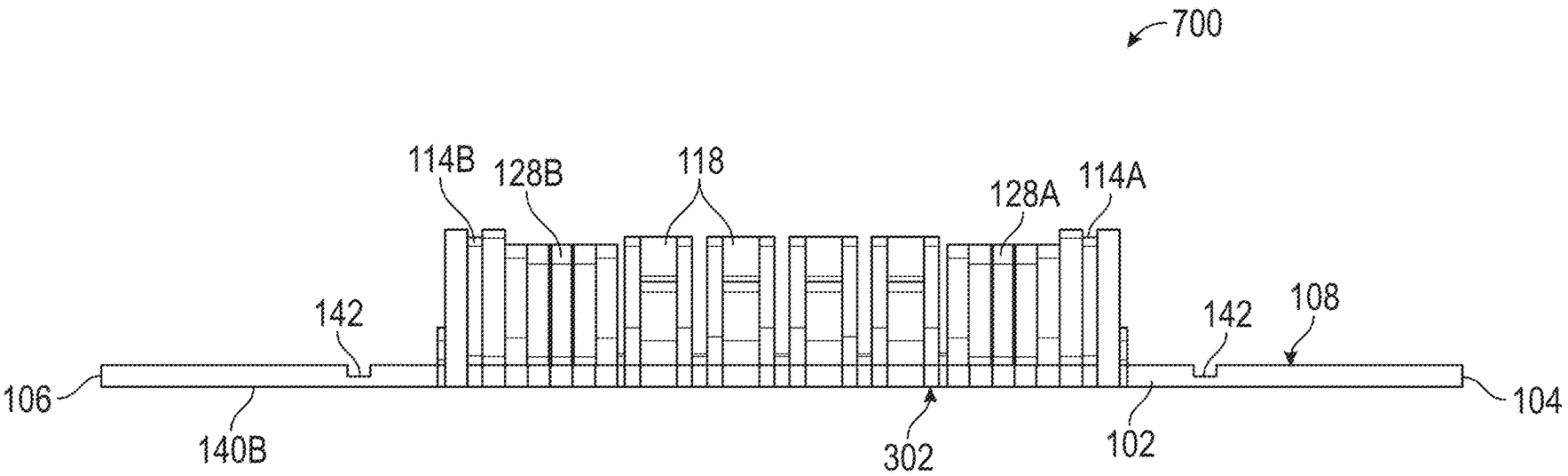
FIG. 30 is an end view of the segment of fastening tape of FIG. 28.

FIGS. 28-30 illustrate a fastening tape 700 that is substantially similar to the fastening tape 300 except that the fastening tape 700 further includes the plurality of apertures 148. As illustrated, each of the lateral slits 364 extends between adjacent apertures 148.

Figure 31:
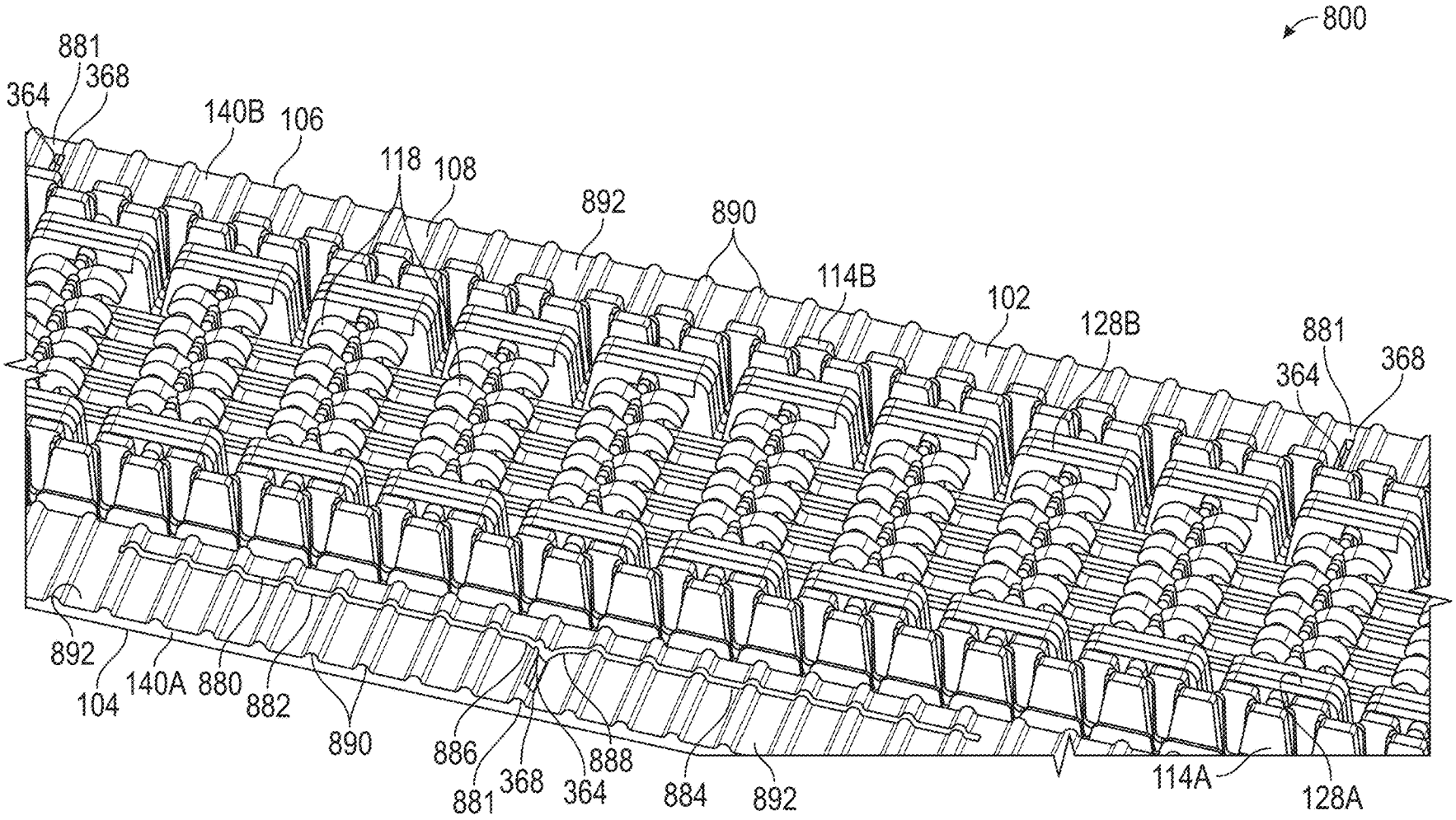
FIG. 31 is a top perspective view of a segment of fastening tape according to aspects of the present disclosure.
Figure 32:
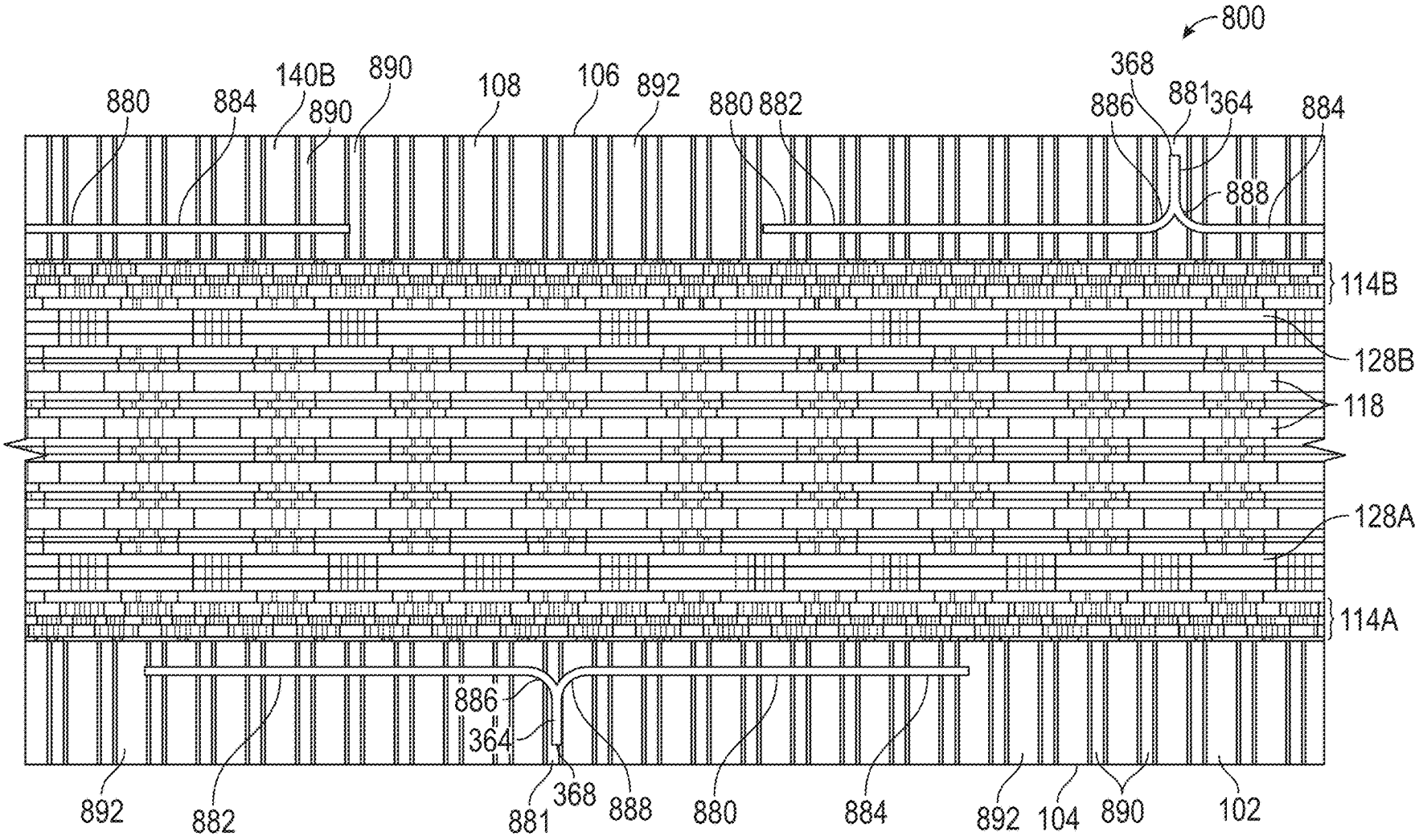
FIG. 32 is a top view of the segment of fastening tape of FIG. 31.
Figure 33:
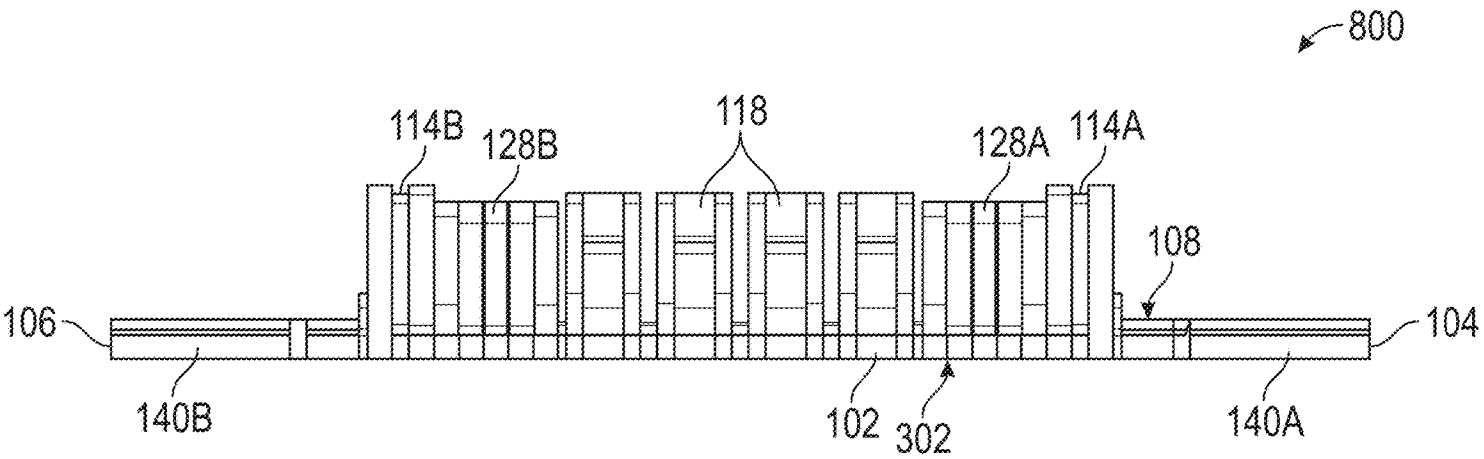
FIG. 33 is an end view of the segment of fastening tape of FIG. 31.

FIGS. 31-34 illustrate an example of a fastening tape 800 that is similar to the fastening tape 300 in that the fastening tape 800 includes the plurality of lateral slits 364. As illustrated in FIGS. 31 and 32, the outer ends 366 of the lateral slits 364 are spaced apart from the first edge 104 such that the lateral slits 364 do not extend to the first edge 104. In these examples, the bridging portion 881 of the first flange 140A exists between the outer end 366 of the lateral slit 364 and the first edge 104. In other examples, the outer ends 366 are at the first edge 104 such that the lateral slit openings 370 are defined (see FIG. 35).

Compared to the fastening tape 300, the fastening tape 800 does not include the first groove 142, but instead includes a plurality of longitudinal slits 880, where each longitudinal slit 880 intersects a corresponding lateral slit 364. In some examples, when both the first flange 140A and the second flange 140B include the longitudinal slits 880 and the lateral slits 364, the longitudinal slits 880 and the lateral slits 364 of the first flange 140A may be aligned with the longitudinal slits 880 and the lateral slits 364 of the second flange 140B in the lateral direction 110. In other examples, the longitudinal slits 880 and the lateral slits 364 of the first flange 140A are offset with respect to the longitudinal slits 880 and the lateral slits 364 of the second flange 140B in the lateral direction 110.

In some examples, the longitudinal slit 880 is substantially perpendicular to the corresponding lateral slit 364, although it need not be. In various examples, each longitudinal slit 880 optionally includes a first slit portion 882 and a second slit portion 884, where the first slit portion 882 is on one side of the lateral slit 364 and the second slit portion 884 is on the other side of the lateral slit 364 in the longitudinal direction 112. In certain examples, the lateral slit 364 includes a first radiused portion 886 intersecting the first slit portion 882 and a second radiused portion 888 intersecting the second slit portion 884. In various other examples, the lateral slit 364 may intersect the longitudinal slit 880 at various other angles or configurations. In some cases, the lateral slit 364 does not include radiused portions 886, 888 and instead intersects the longitudinal slit 880 at a right angle (see FIG. 36) or at various other angles.

As illustrated in FIG. 31, in various examples, a plurality of ribs 890 extend in the lateral direction 110 between the first sidewall 114A and the first edge 104. In some examples, the plurality of longitudinal slits 880 intersect at least some of the plurality of ribs 890. The plurality of ribs 890 may reinforce the thickness of the first flange 140A. The second flange 140B may also include a plurality of ribs 890 if desired. If included on both flanges 140A, 140B, the ribs 890 of the first flange 140A may be aligned with or offset from the ribs 890 of the second flange 140B.

Figure 34:
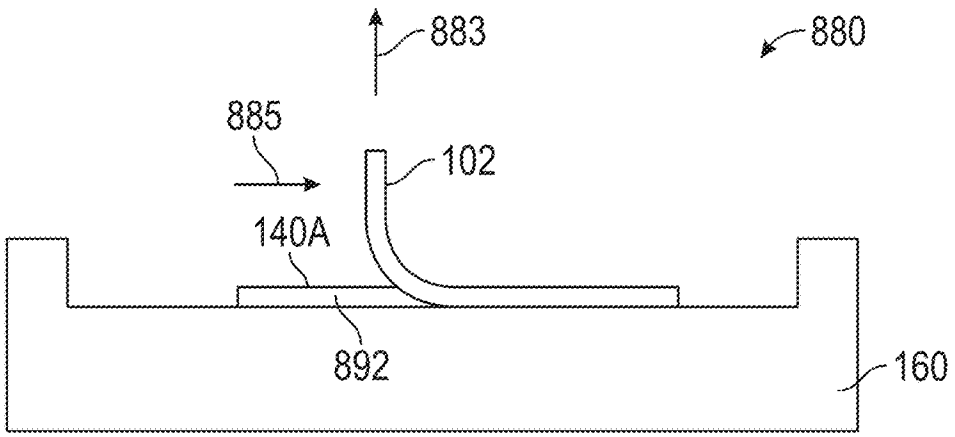
FIG. 34 is a side view of the segment of fastening tape of FIG. 31 positioned on a layer of foam and subjected to a pull force.

Referring to FIG. 34, the longitudinal slits 880 and the lateral slits 364 may be provided to create fins 892 when a pull force 883 is applied to the fastening tape 800. In the fastening tape 800, each fin 892 is the portion of the first flange 140A between adjacent lateral slits 364. When the pull force 883 is applied to the body 102 of the fastening tape 800 that includes the fasteners 118 and the magnetic material 128A, 128B (fasteners 118 and magnetic material 128A, 128B are not illustrated in FIG. 34), the portion (corresponding to the above-mentioned bridging portion 881) of the first flange 140A between the outer end 366 of the lateral slit 364 and the first edge 104 breaks to form the fin 892. As illustrated in FIG. 34, when the fastening tape 800 is pulled, the fins 892 may remain engaged with the foam 160 at multiple points of contact with the foam 160 over a larger surface area compared to fastening tapes without the fins 892. These points of contact with the foam 160 over a larger surface area created by the fins 892 creates a shear force 885 from the pull force 883, which increases the hook to foam strength. In various examples, offsetting the longitudinal slits 880 and the lateral slits 364 of the first flange 140A with respect to the longitudinal slits 880 and the lateral slits 364 of the second flange 140B in the lateral direction 110 may provide a fastening tape 800 with a lower shear force 885 at one area compared to fastening tapes with the longitudinal slits 880 and lateral slits 364 of the first flange 140A and the second flange 140B aligned in the lateral direction 110. This lower shear force 885 may help reduce tearing that would otherwise occur if the shear force 885 is too great.

In some examples, the lateral slit 364 intersects the longitudinal slit 880 at about the middle of the longitudinal slit 880 such that the lateral slit 364 and the longitudinal slit 880 form fins 892 that are T-shaped. However, in various other examples, the lateral slit 364 may intersect the longitudinal slit 880 at various other locations along the length of the longitudinal slit 880 to form fins 892 having various other shapes. As one non-limiting example, the lateral slit 364 may intersect the longitudinal slit 880 at one of the ends of the longitudinal slit 880 to form fins 892 that are L-shaped rather than T-shaped.

Figure 35:
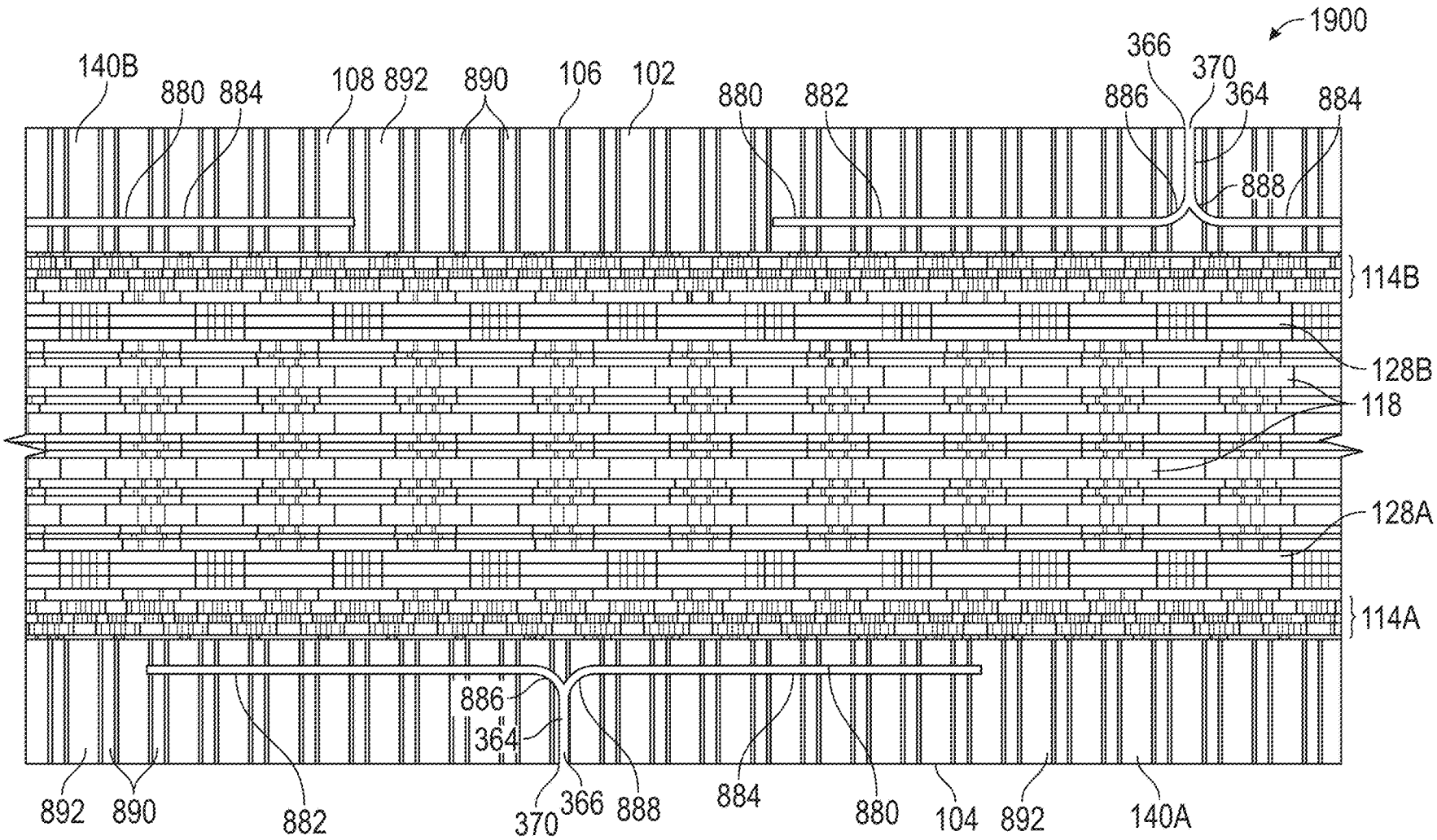
FIG. 35 is a top view of a segment of fastening tape according to aspects of the present disclosure.

FIG. 35 illustrates a fastening tape 1900 that is substantially similar to the fastening tape 800. For example, the fastening tape 1900 does not include the first groove 142, but instead includes a plurality of longitudinal slits 880. Compared to the fastening tape 800, in the fastening tape 1900 the outer ends 366 of the lateral slits 364 are at the first edge 104 to define the lateral slit openings 370. In this example, the fins 892 are pre-formed, as there is no portion of the first flange 140A between the outer end 366 of the lateral slit 364 and the first edge 104 to break to form the fin 892.

Figure 36:
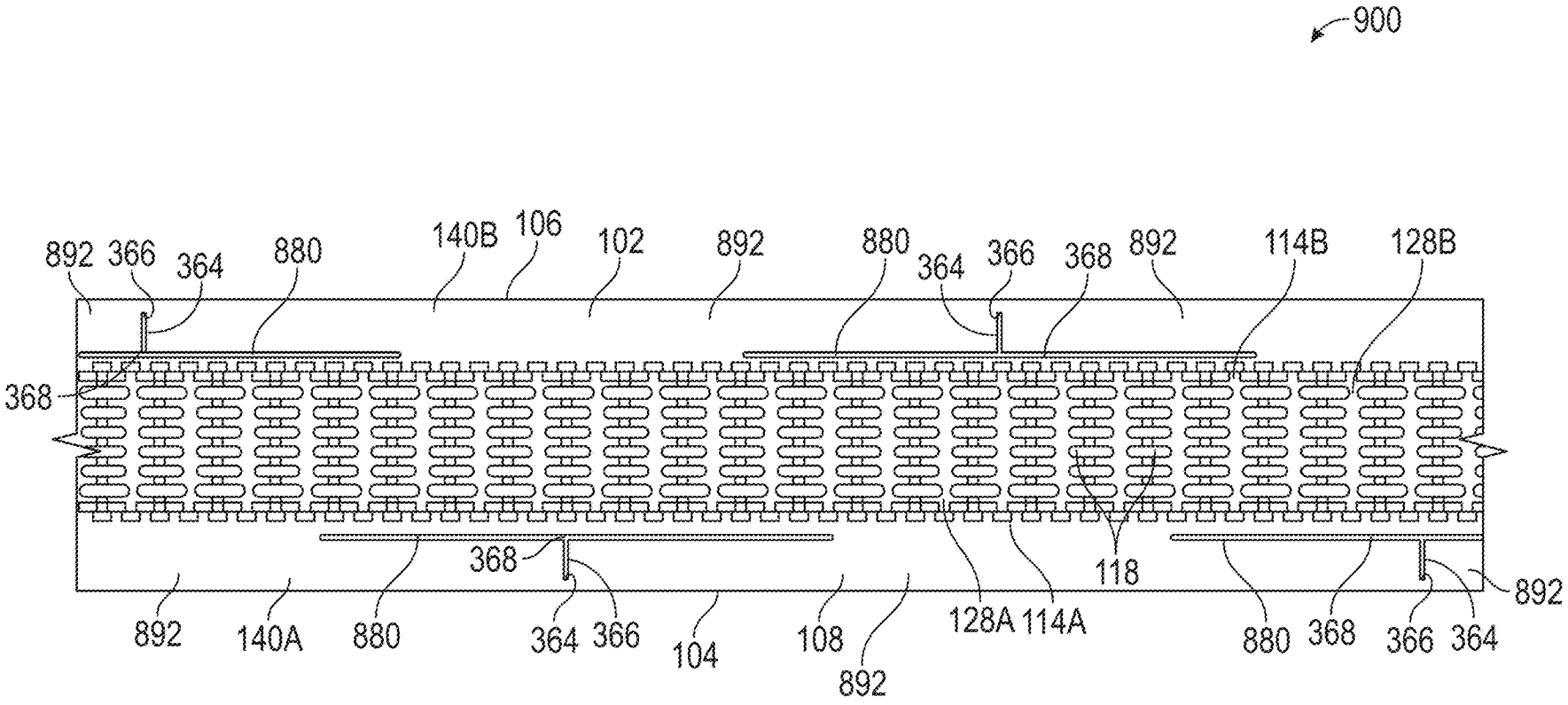
FIG. 36 is a top view of a segment of fastening tape according to aspects of the present disclosure.

FIG. 36 illustrates a fastening tape 900 that is substantially similar to the fastening tape 800. For example, the fastening tape 1900 does not include the first groove 142, but instead includes a plurality of longitudinal slits 880. Compared to the fastening tape 800, in the fastening tape 900 the radiused portions 886 and 888 of the lateral slit 364 are omitted. In this example, the longitudinal slit 880 intersects the inner end 368 of the lateral slit 364; however, in various other examples, the longitudinal slit 880 intersects the lateral slit 364 between the inner end 368 and the outer end 366.

Figure 37:
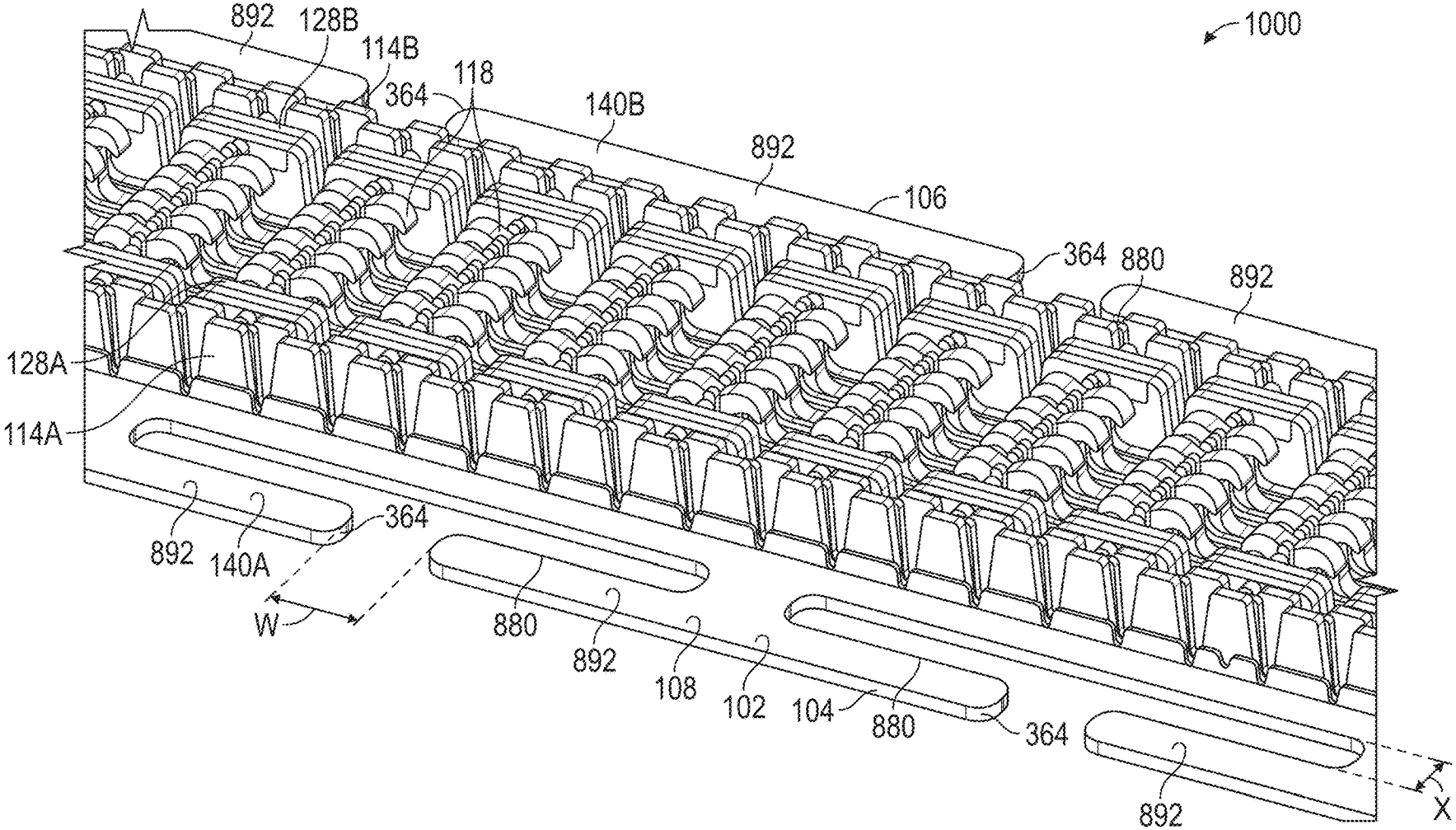
FIG. 37 is a top perspective view of a segment of fastening tape according to aspects of the present disclosure.
Figure 38:
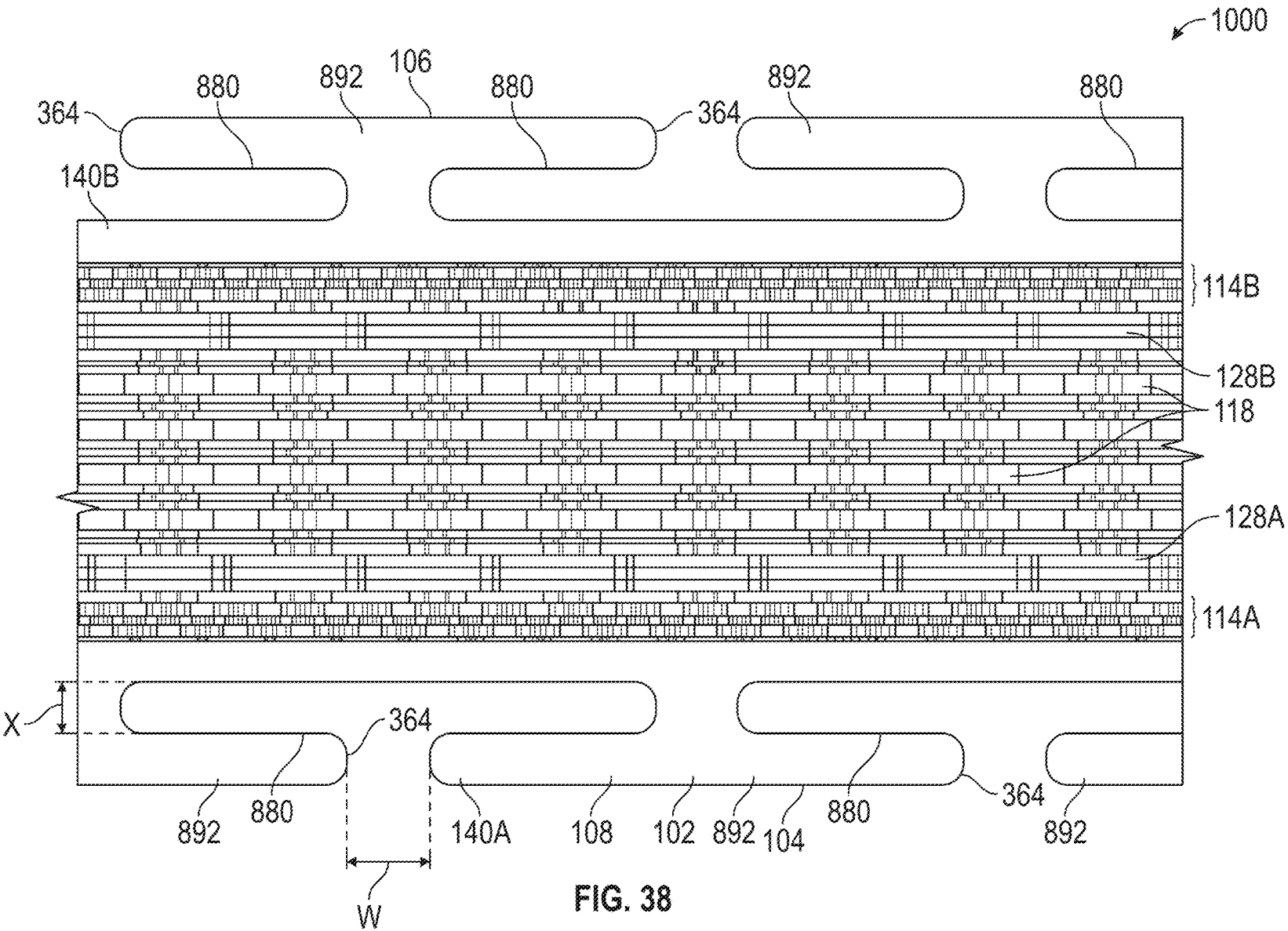
FIG. 38 is a top view of the segment of fastening tape of FIG. 37.
Figure 39:
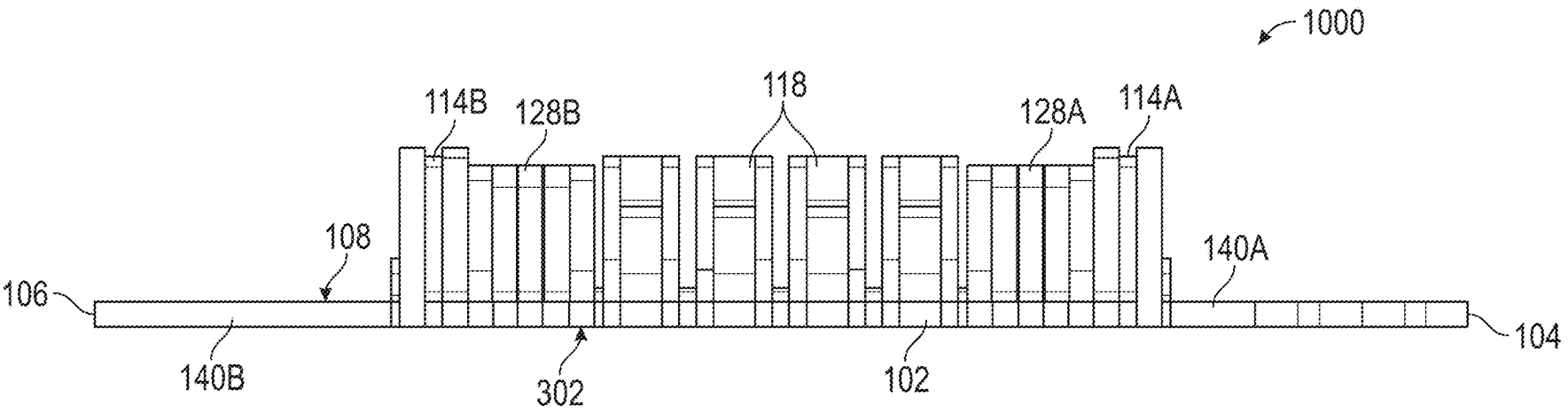
FIG. 39 is an end view of the segment of fastening tape of FIG. 37.

FIGS. 37-39 illustrate a fastening tape 1000 that is substantially similar to the fastening tape 800. For example, the fastening tape 1900 does not include the first groove 142, but instead includes a plurality of longitudinal slits 880. Compared to the fastening tape 800, in the fastening tape 1000 the width W of the lateral slit 364 is increased and a length X of the longitudinal slit 880 is increased compared to the fastening tape 800. Similar to the fastening tape 900, in the fastening tape 1000, the fins 892 are pre-formed.

Figure 40:
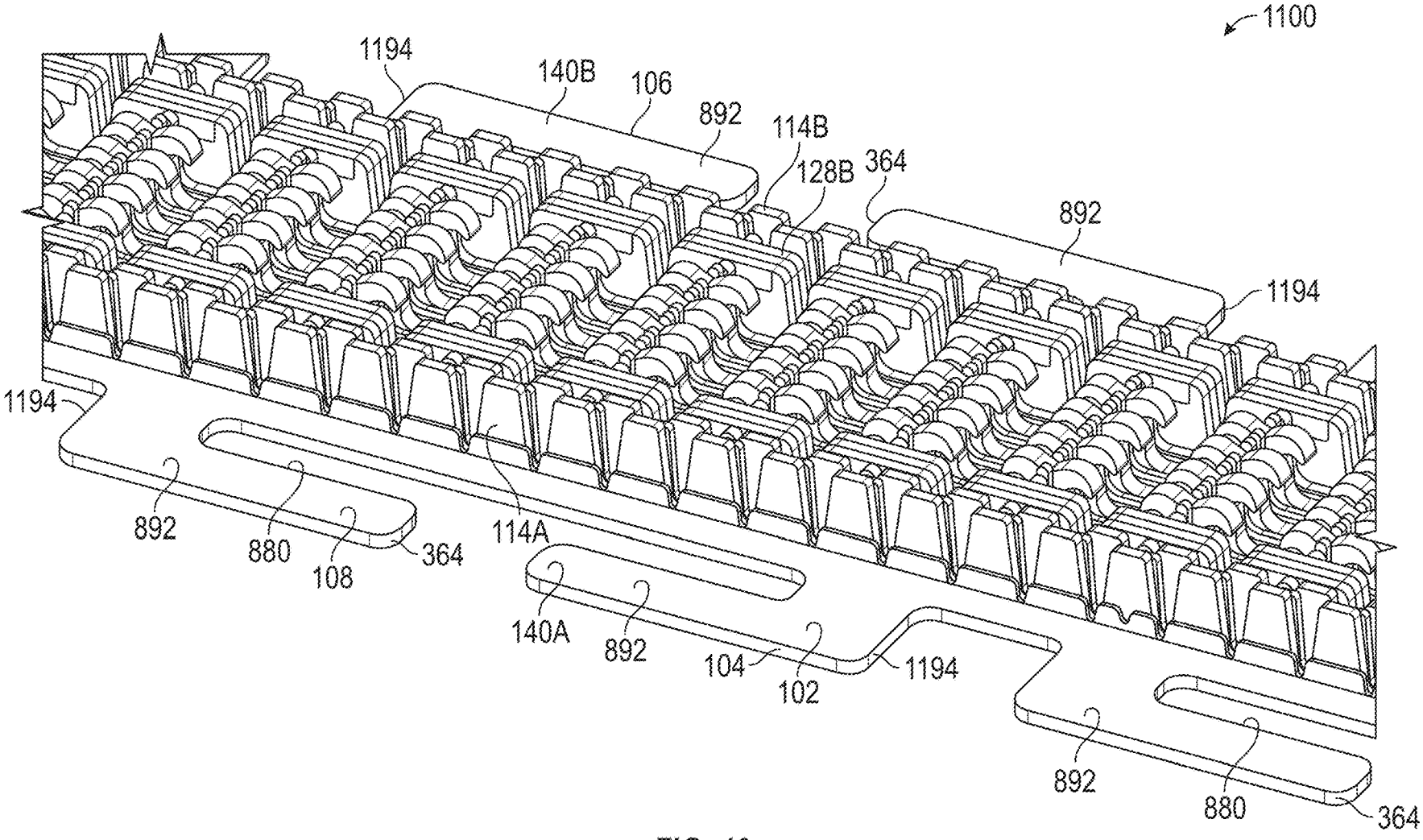
FIG. 40 is a top perspective view of a segment of fastening tape according to aspects of the present disclosure.
Figure 41:
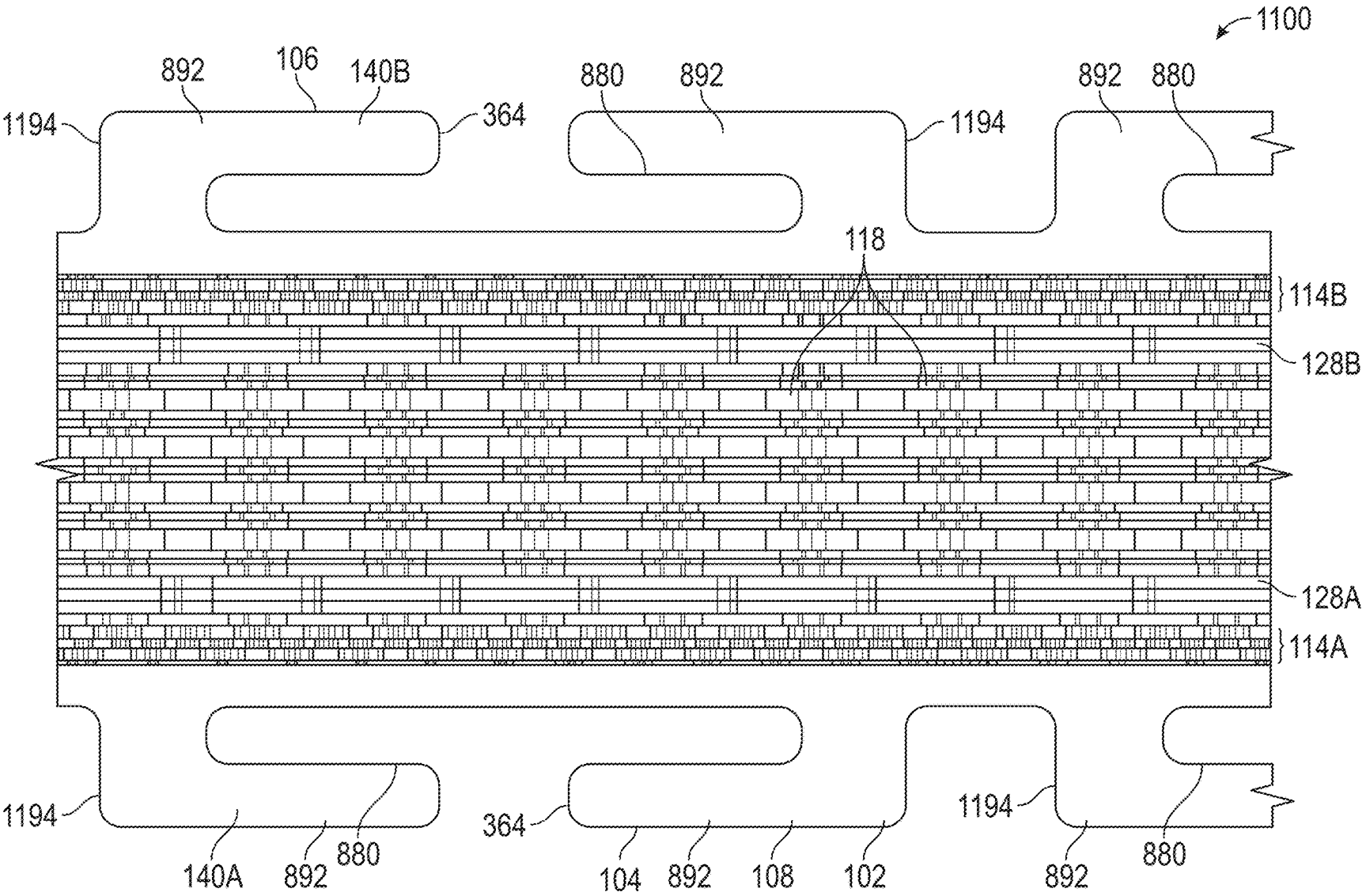
FIG. 41 is a top view of the segment of fastening tape of FIG. 40.
Figure 42:
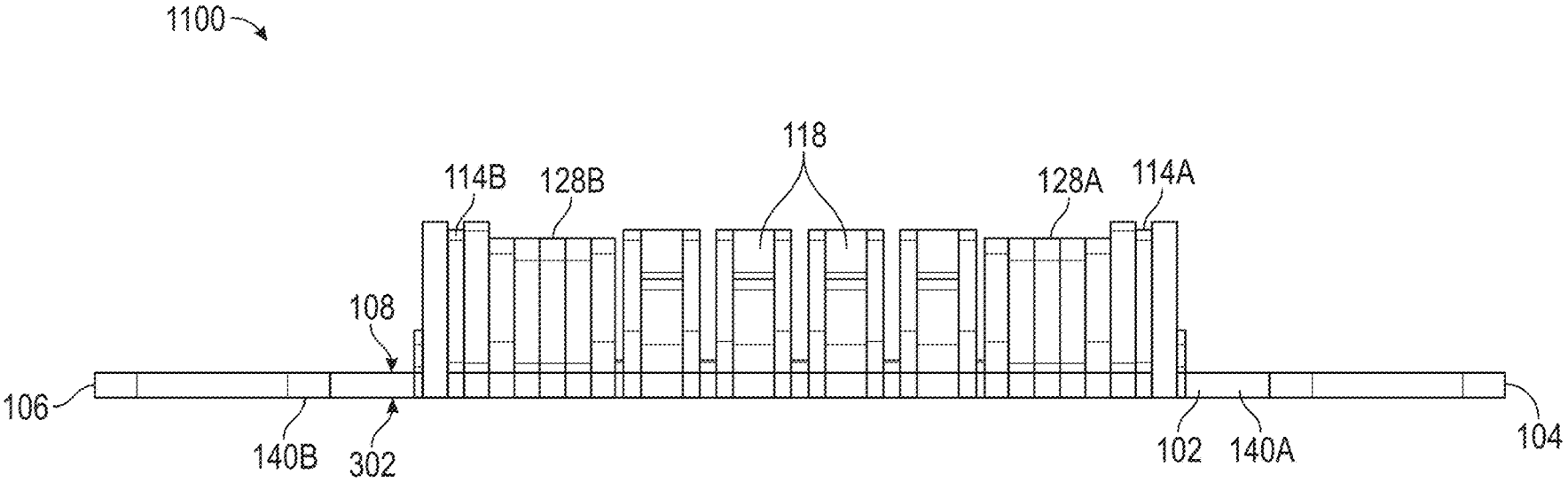
FIG. 42 is an end view of the segment of fastening tape of FIG. 40.

FIGS. 40-42 illustrate a fastening tape 1100 that is substantially similar to the fastening tape 1000. For example, the fastening tape 1900 does not include the first groove 142, but instead includes a plurality of longitudinal slits 880. Compared to the fastening tape 1100, in the fastening tape 1000 the first flange 140A of the fastening tape 1100 (and optionally the second flange 140B) further includes a plurality of spacing notches 1194 between adjacent lateral slits 364. As illustrated, the spacing notches 1194 extend from the first edge 104 to proximate the first sidewall 114A. Similar to the fastening tape 900, in the fastening tape 1100, the fins 892 are pre-formed. In various cases, the spacing notches 1194 further space the fins 892 along the fastening tape 1100 and may further improve adhesion between the fastening tape 1100 and the foam. As illustrated in FIGS. 40 and 41, the spacing notches 1194 help form the fins 892 that are L-shaped compared to the T-shaped fins 892 of the fastening tape 1000.

Figure 43:
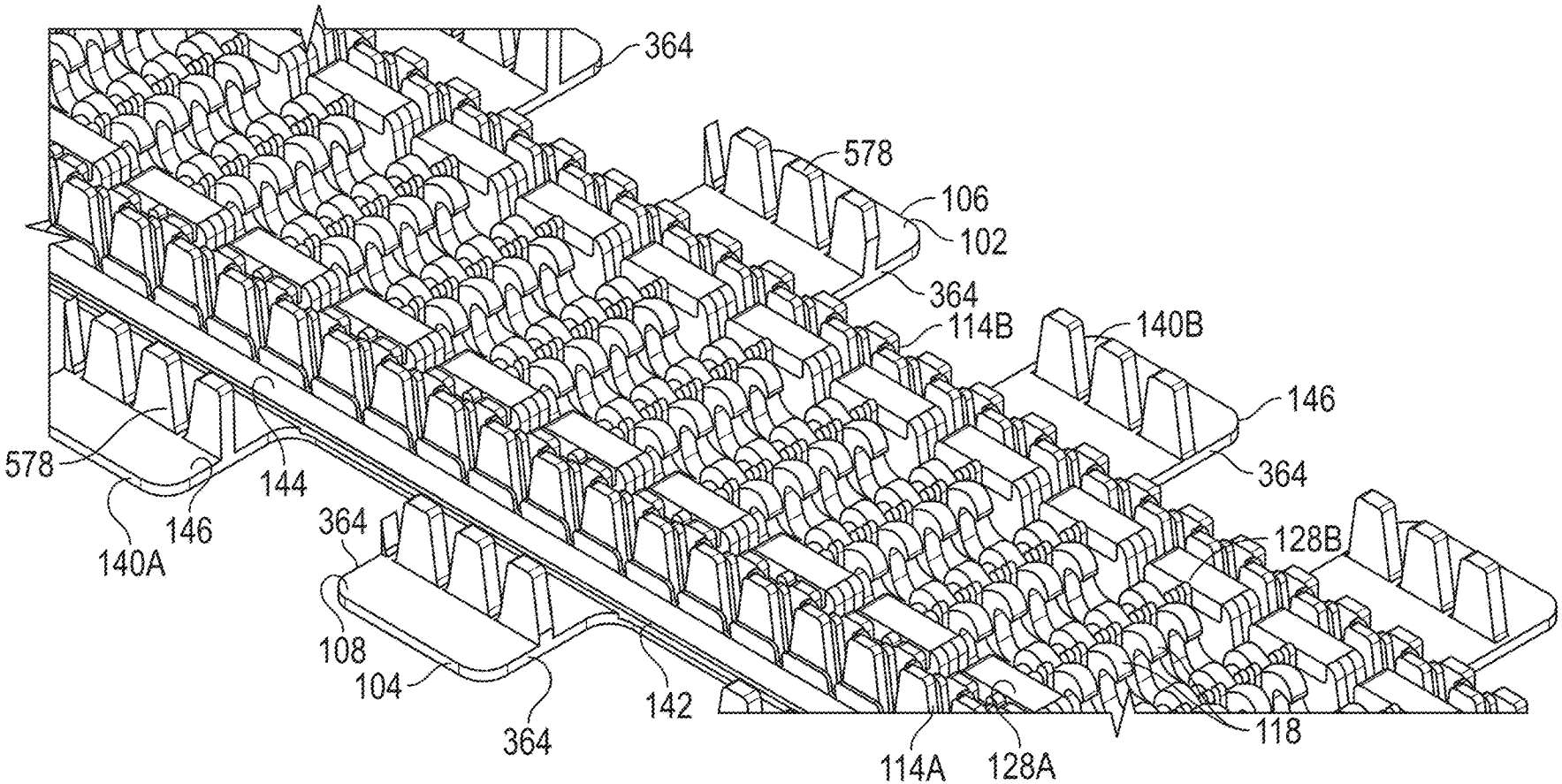
FIG. 43 is a top perspective view of a segment of fastening tape according to aspects of the present disclosure.
Figure 44:
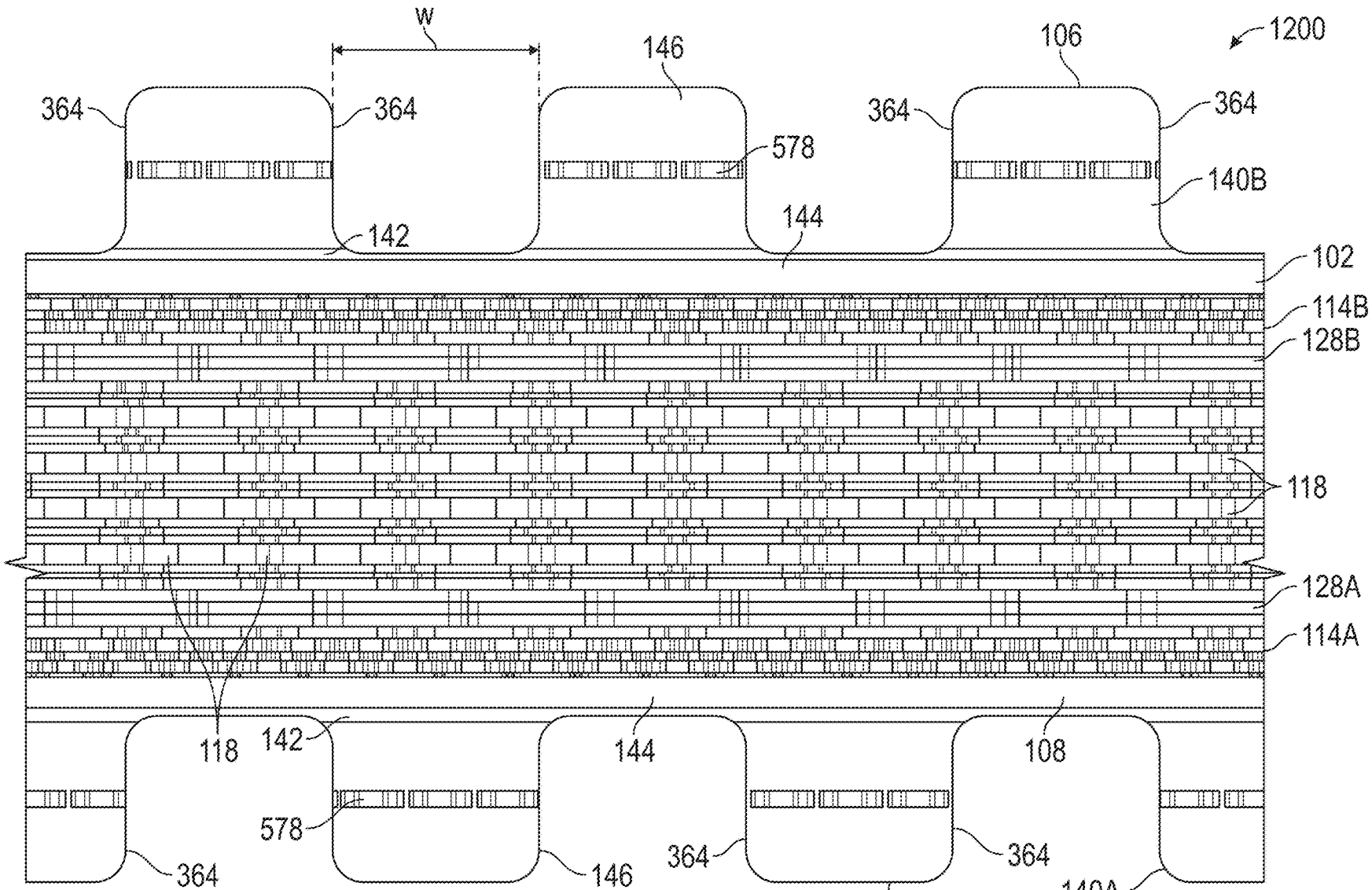
FIG. 44 is a top view of the segment of fastening tape of FIG. 43.
Figure 45:
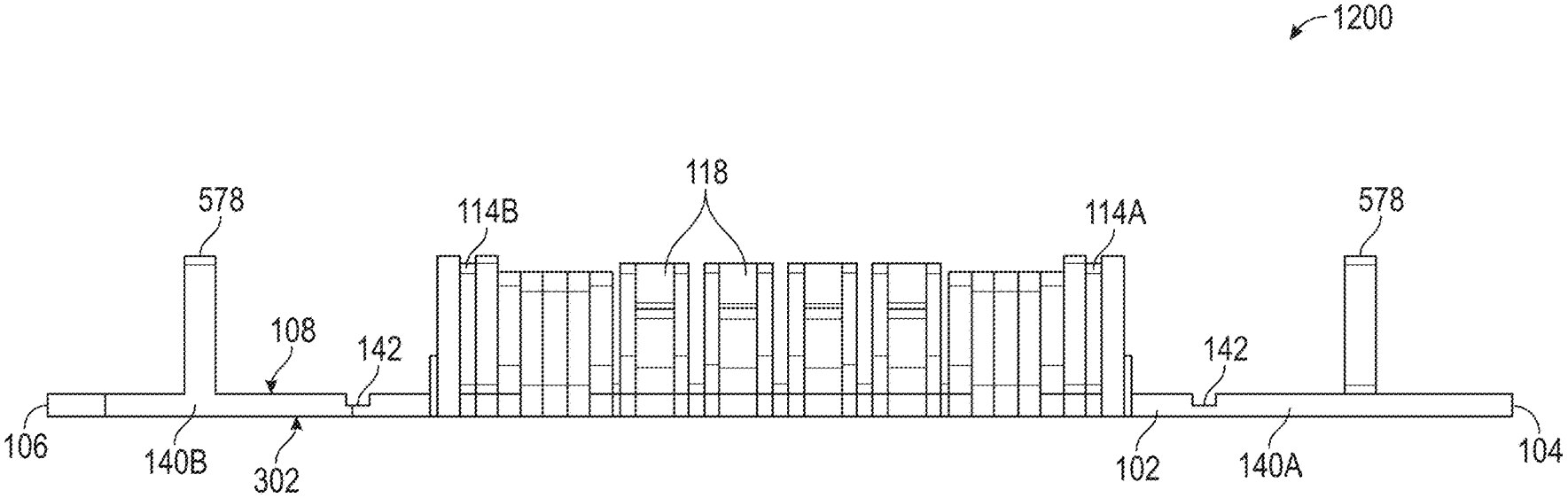
FIG. 45 is an end view of the segment of fastening tape of FIG. 43.

FIGS. 43-45 illustrate a fastening tape 1200 that is similar to the fastening tape 500 except that the width W of the lateral slit 364 (FIG. 44) is increased compared to the fastening tape 500. In some examples, and the lateral slits 364 of the first flange 140A are offset from the lateral slits 364 of the second flange 140B. In various examples, the width W of the lateral slit 364 of the fastening tape 1200 is approximately the same as a distance between adjacent edges of adjacent slits 364 of the fastening tape 1200, although it need not be. In addition, the lateral slits 364 of the first flange 140A are offset from the lateral slits 364 of the second flange 140B such that a zig-zag pattern is formed. In other examples, similar to the fastening tape 500, the lateral slits 364 on the first flange 140A and second flange 140B may be aligned.

Figure 46:
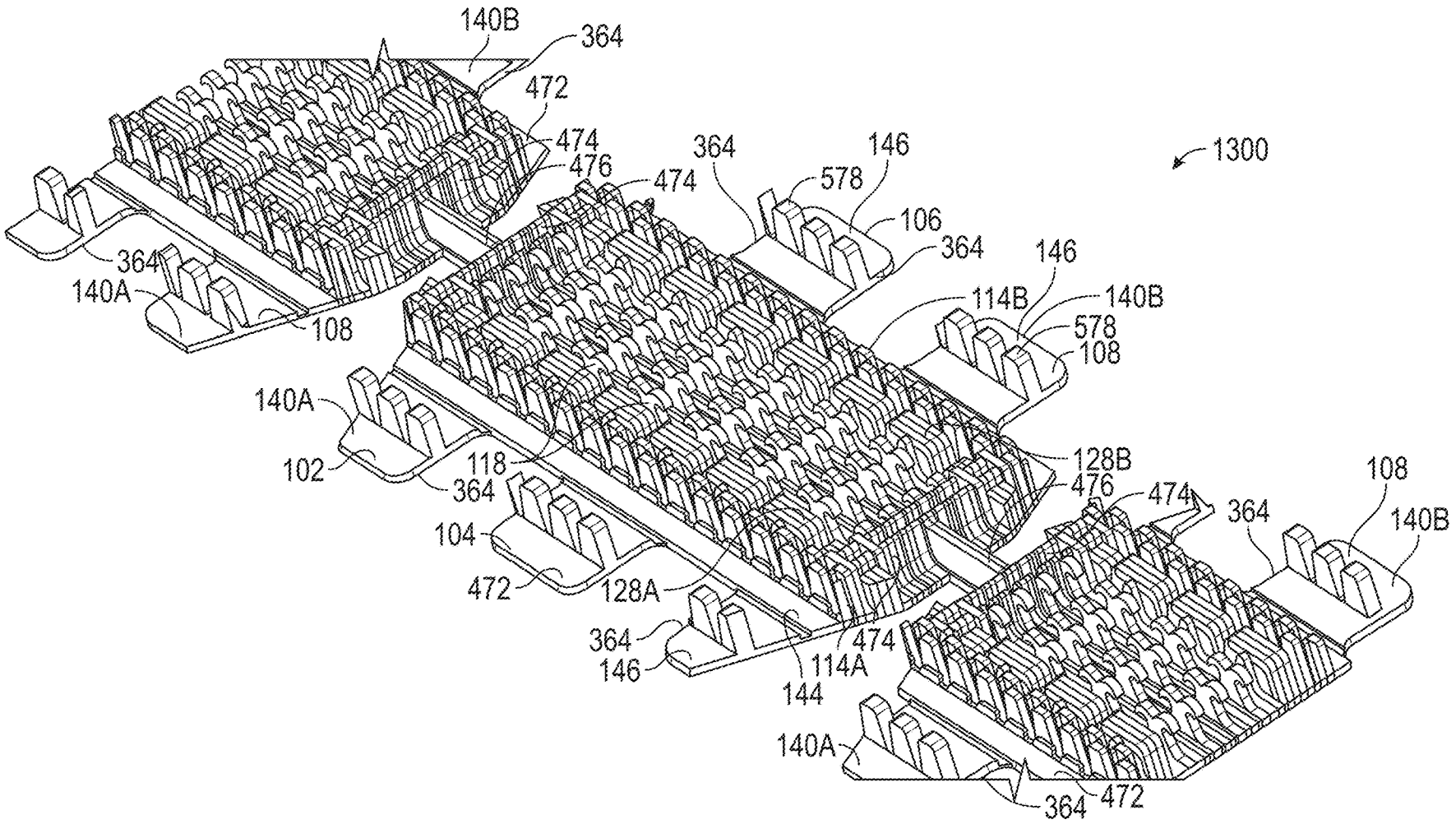
FIG. 46 is a top perspective view of a segment of fastening tape according to aspects of the present disclosure.
Figure 47:
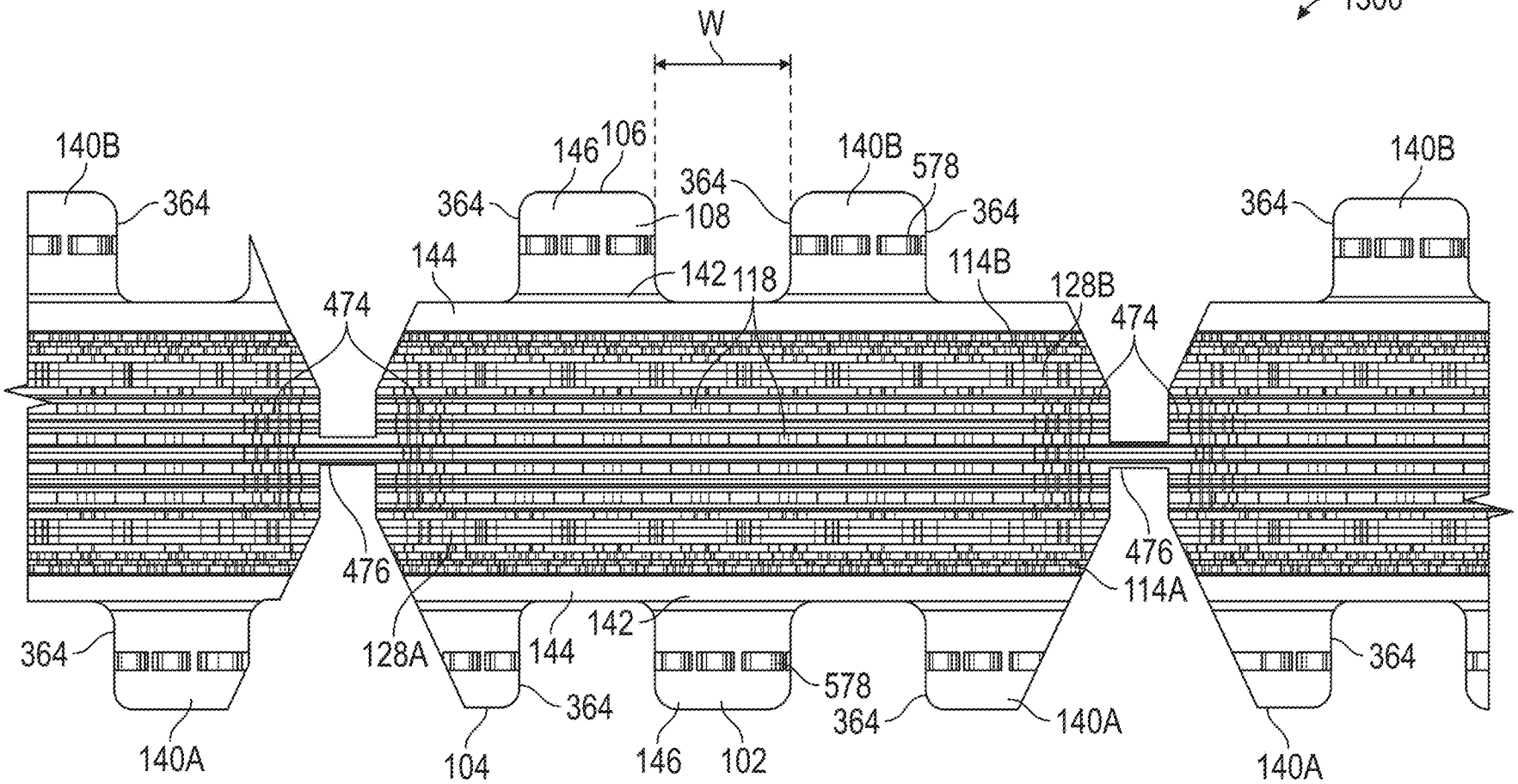
FIG. 47 is a top view of the segment of fastening tape of FIG. 46.
Figure 48:
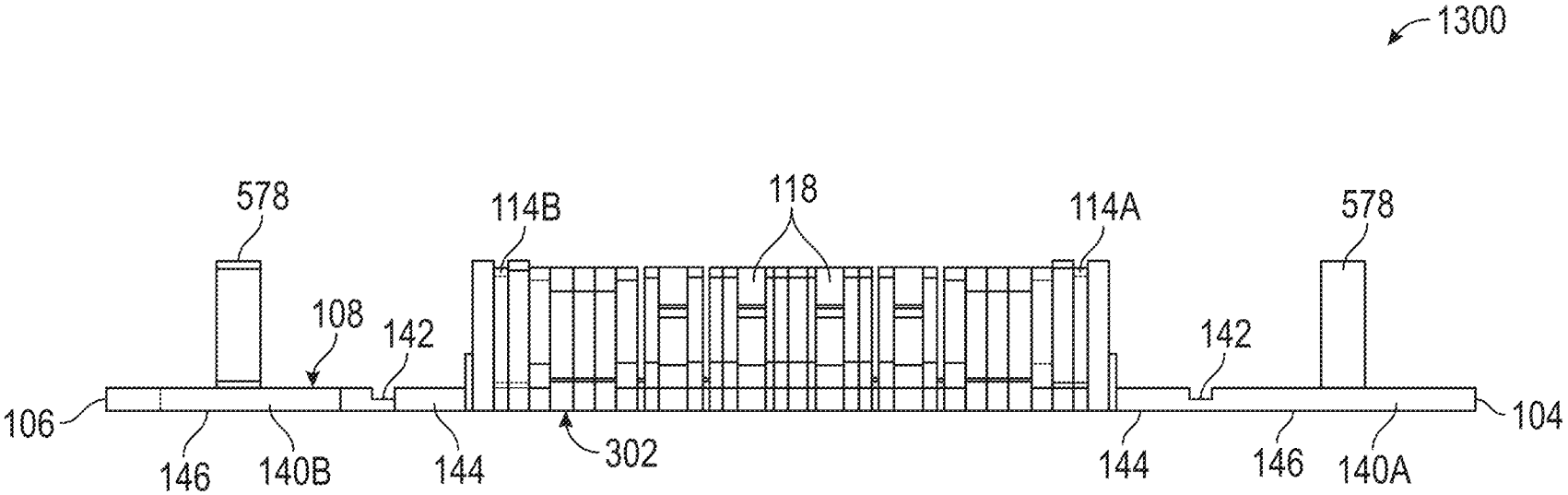
FIG. 48 is an end view of the segment of fastening tape of FIG. 46.

FIGS. 46-48 illustrate a fastening tape 1300 that is similar to the fastening tape 600 and includes fastening tape segments 472 connected to one another by the flexible element 476. Each fastening tape segment 472 of the fastening tape 1300 has a configuration similar to the fastening tape 1200. However, compared to the fastening tape 600, the width W of the lateral slits 364 of the fastening tape 1300 is increased. In various examples, the width W of the lateral slits 364 (FIG. 47) of the fastening tape 1300 is approximately the same as a distance between adjacent edges of adjacent lateral slits 364 of the fastening tape 1300, although it need not be. Additionally, the lateral slits 364 of the first flange 140A of the fastening tape 1300 are offset from the lateral slits 364 of the second flange 140B of the fastening tape 1300 such that a zig-zag pattern is formed. In other examples, similar to the fastening tape 600, the lateral slits 364 on the first flange 140A and second flange 140B may be aligned.

Figure 49:
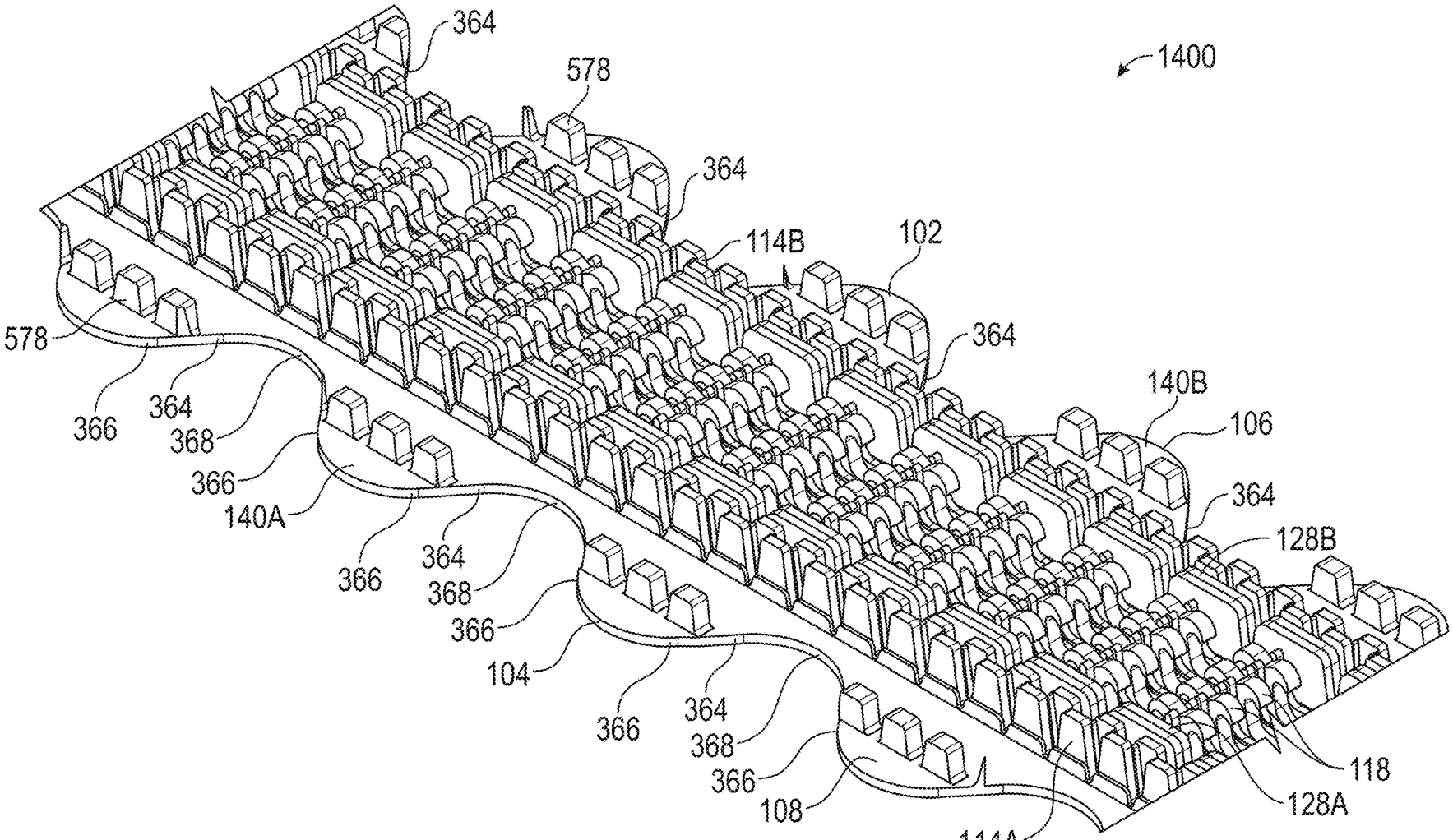
FIG. 49 is a top perspective view of a segment of fastening tape according to aspects of the present disclosure.
Figure 50:
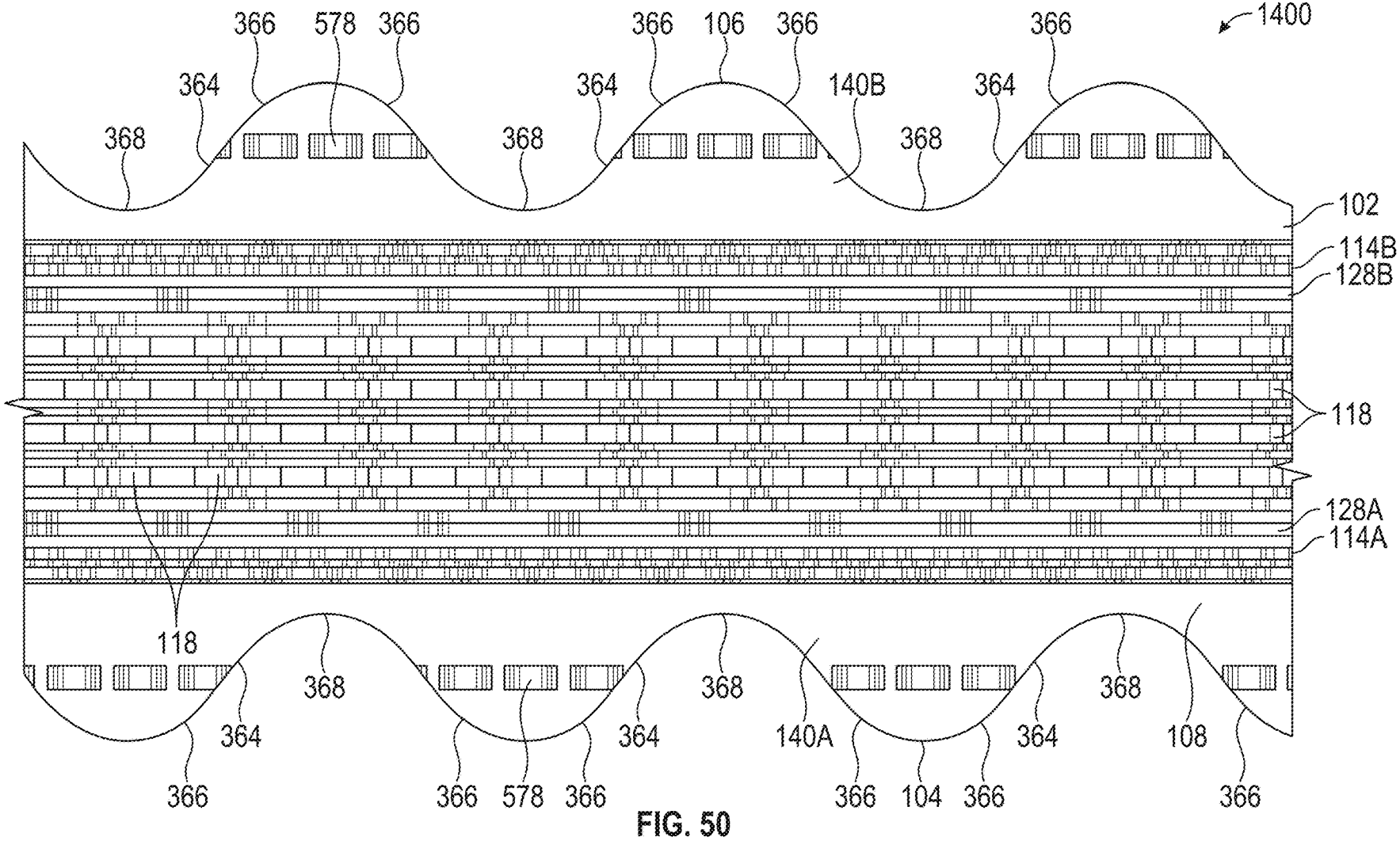
FIG. 50 is a top view of the segment of fastening tape of FIG. 49.

FIGS. 49 and 50 illustrate a fastening tape 1400 that is similar to the fastening tape 1200 except that the shape of the lateral slit 364 is changed and the first groove 142 is not formed. In some examples, the protrusion 578 is arranged between the first edge 104 and the first sidewall 114A at a position close to the first edge 104 relative to the inner end 368 of the lateral slit 364. In some examples, the protrusion 578 is arranged between the second edge 106 and the second sidewall 114B at a position close to the second edge 106 relative to the inner end 368 of the lateral slit 364. In some examples, the height of the protrusion 578 is the same as the height of the first sidewall 114A and the second sidewall 114B or less than the height of the first sidewall 114A and the second sidewall 114B. In some examples, the lateral slit 364 is shaped such that the first edge 104 and the second edge 106 are formed into wave-shapes. Specifically, the inner end 368 and the outer end 366 are formed into arc-shapes.

According to the fastening tape 1400, as the lateral slit 364 is formed, the first flange 140A and the second flange 140B have flexibility and thus it is possible to improve the tracking capability with respect to the trench 154. According to the fastening tape 1400, as the height of the protrusion 578 is the same as the height of the first sidewall 114A and the second sidewall 114B or less than the height of the first sidewall 114A and the second sidewall 114B, it is possible to suppress the foam from intruding into the fastening area. According to the fastening tape 1400, as the protrusion 578 protrudes in a direction same as extending direction of the fasteners 118, it is possible to suppress the fastening tapes from being tangled in each other and thus it becomes easy to handle the fastening tapes. According to the fastening tape 1400, as the first edge 104 and the second edge 106 are formed into wave-shapes, it is possible to suppress the fastening tapes from being tangled in each other and thus it becomes easy to handle the fastening tapes.

Figure 51:
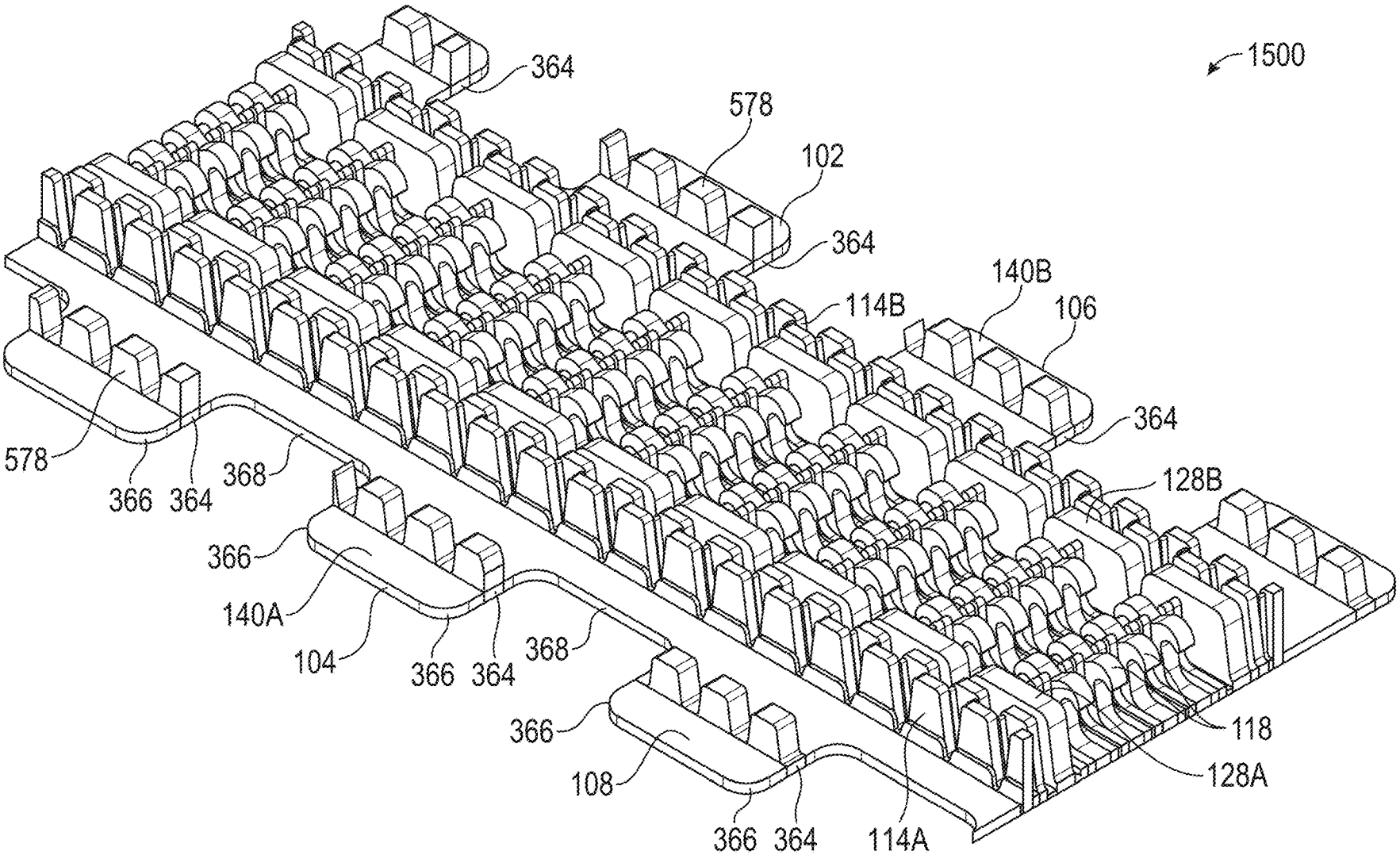
FIG. 51 is a top perspective view of a segment of fastening tape according to aspects of the present disclosure.
Figure 52:
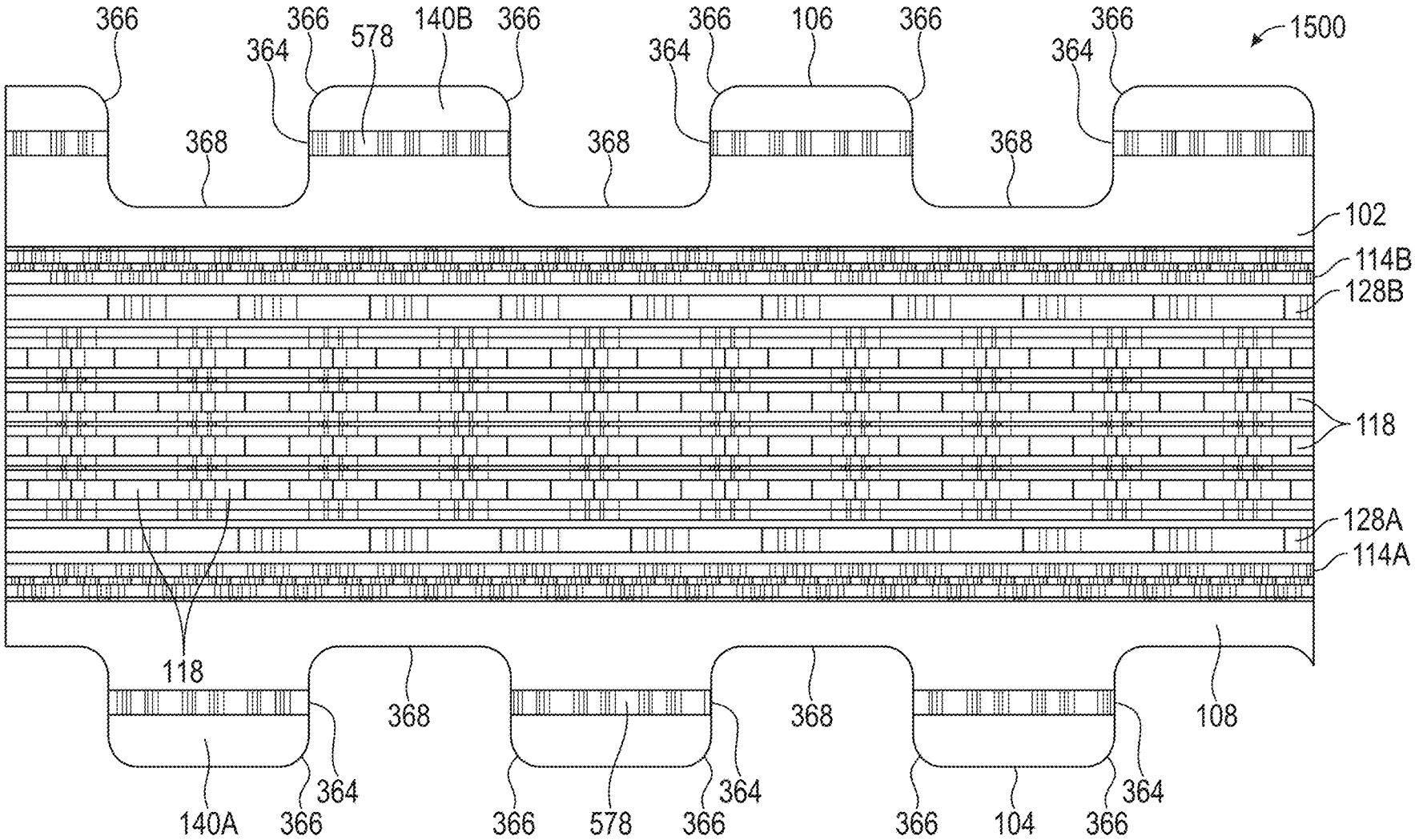
FIG. 52 is a top view of the segment of fastening tape of FIG. 51.

FIGS. 51 and 52 illustrates a fastening tape 1500 that is similar to the fastening tape 1200 except that the first groove 142 is not formed. In some examples, the protrusion 578 is arranged between the first edge 104 and the first sidewall 114A at a position close to the first edge 104 relative to the inner end 368 of the lateral slit 364. In some examples, the protrusion 578 is arranged between the second edge 106 and the second sidewall 114B at a position close to the second edge 106 relative to the inner end 368 of the lateral slit 364. In some examples, the height of the protrusion 578 is the same as the height of the first sidewall 114A and the second sidewall 114B or less than the height of the first sidewall 114A and the second sidewall 114B.

According to the fastening tape 1500, as the lateral slit 364 is formed, the first flange 140A and the second flange 140B have flexibility and thus it is possible to improve the tracking capability with respect to the trench 154. According to the fastening tape 1500, as the height of the protrusion 578 is the same as the height of the first sidewall 114A and the second sidewall 114B or less than the height of the first sidewall 114A and the second sidewall 114B, it is possible to suppress the foam from intruding into the fastening area. According to the fastening tape 1500, as the protrusion 578 protrudes in a direction same as extending direction of the fasteners 118, it is possible to suppress the fastening tapes from being tangled in each other and thus it becomes easy to handle the fastening tapes.

A collection of exemplary embodiments, including at least some explicitly enumerated as "ECs" (Example Combinations), providing additional description of a variety of embodiment types in accordance with the concepts described herein are provided below. These examples are not meant to be mutually exclusive, exhaustive, or restrictive; and the invention is not limited to these example embodiments but rather encompasses all possible modifications and variations within the scope of the issued claims and their equivalents.

EC 1. A fastening tape comprising: a body including a first edge, a second edge opposite the first edge, a bottom surface extending between the first edge and the second edge, and a top surface extending between the first edge and the second edge, the body defining a lateral direction from the first edge to the second edge and a longitudinal direction transverse to the lateral direction; a first sidewall extending in an upward direction from the top surface of the body and positioned between the first edge and the second edge; and a second sidewall extending in the upward direction from the top surface of the body and positioned between the first sidewall and the second edge; a plurality of fasteners extending in an upward direction from the top surface of the body and positioned between the first sidewall and the second sidewall and arranged in rows extending in the lateral direction of the body; a first groove defined in the top surface and extending in the longitudinal direction between the first sidewall and the first edge, the first groove defining a first folding portion arranged between the first groove and the first edge and a first non-folding portion arranged between the first groove and the first sidewall; a second groove defined in the top surface and extending in the longitudinal direction between the second sidewall and the second edge, the second groove defining a second folding portion arranged between the second groove and the second edge and a second non-folding portion arranged between the second groove and the second sidewall; a first flange between the first sidewall and the first edge and comprising a plurality of first lateral slits extending from proximate the first edge to proximate the first sidewall in the lateral direction; and a second flange between the second sidewall and the second edge and comprising a plurality of second lateral slits extending from proximate the second edge to proximate the second sidewall in the lateral direction, wherein the first folding portion is positionable relative to the first non-folding portion, wherein the second folding portion is positionable relative to the second non-folding portion, wherein a width of each first lateral slit of the plurality of first lateral slits is approximately the same as a distance between adjacent edges of adjacent first lateral slits, and wherein a width of each second lateral slit of the plurality of lateral second slits is approximately the same as a distance between adjacent edges of adjacent second lateral slits.

EC 2. The fastening tape of any of the preceding or subsequent example combination, wherein each first lateral slit of the plurality of first lateral slits extends from the first edge to proximate the first sidewall, and wherein each second lateral slit of the plurality of second lateral slits extends from the second edge to proximate the second sidewall.

EC 3. The fastening tape of any of the preceding or subsequent example combination, wherein the second lateral slits are offset from the first lateral slits in the lateral direction.

EC 4. The fastening tape of any of the preceding or subsequent example combination, wherein the first lateral slits are aligned with the second lateral slits in the lateral direction.

EC 5. The fastening tape of any of the preceding or subsequent example combination, wherein the first groove intersects each first lateral slit of the plurality of first lateral slits.

EC 6. The fastening tape of any of the preceding or subsequent example combination, wherein the first groove intersects each first lateral slit of the plurality of first lateral slits between the outer end and the inner end of each first lateral slit.

EC 7. The fastening tape of any of the preceding or subsequent example combination, further comprising a first protrusion extending in the upward direction from the top surface of the body and located between the first edge and the first groove, wherein the first protrusion intersects each first lateral slit of the plurality of first lateral slits.

EC 8. The fastening tape of any of the preceding or subsequent example combination, wherein the outer end of each first lateral slit is at or near the first edge.

EC 9. The fastening tape of any of the preceding or subsequent example combination, wherein the first lateral slit is substantially perpendicular to the first groove.

EC 10. The fastening tape of any of the preceding or subsequent example combination, wherein the fastening tape comprises a plurality fastening tape segments connected to one another by flexible elements.

EC 11. The fastening tape of any of the preceding or subsequent example combination, further comprising at least one magnetic portion extending in the longitudinal direction.

EC 12. A fastening tape comprising: a body including a first edge, a second edge opposite the first edge, a bottom surface extending between the first edge and the second edge, and a top surface extending between the first edge and the second edge, the body defining a lateral direction from the first edge to the second edge and a longitudinal direction transverse to the lateral direction; a first sidewall extending in an upward direction from the top surface of the body and positioned between the first edge and the second edge; and a second sidewall extending in the upward direction from the top surface of the body and positioned between the first sidewall and the second edge; a plurality of fasteners extending in an upward direction from the top surface of the body and positioned between the first sidewall and the second sidewall and arranged in rows extending in the lateral direction of the body; a first groove defined in the top surface and extending in the longitudinal direction between the first sidewall and the first edge, the first groove defining a first folding portion arranged between the first groove and the first edge and a first non-folding portion arranged between the first groove and the first sidewall; a second groove defined in the top surface and extending in the longitudinal direction between the second sidewall and the second edge, the second groove defining a second folding portion arranged between the second groove and the second edge and a second non-folding portion arranged between the second groove and the second sidewall; a first flange between the first sidewall and the first edge and comprising a plurality of first lateral slits extending from proximate the first edge to proximate the first sidewall in the lateral direction; and a second flange between the second sidewall and the second edge and comprising a plurality of second lateral slits extending from proximate the second edge to proximate the second sidewall in the lateral direction, wherein the first folding portion is positionable relative to the first non-folding portion, wherein the second folding portion is positionable relative to the second non-folding portion, and wherein the second lateral slits are offset from the first lateral slits in the lateral direction.

EC 13. The fastening tape of any of the preceding or subsequent example combination, wherein a width of each first lateral slit of the plurality of first lateral slits is approximately the same as a distance between adjacent edges of adjacent first lateral slits, and wherein a width of each second lateral slit of the plurality of lateral second lateral slits is approximately the same as a distance between adjacent edges of adjacent second lateral slits.

EC 14. The fastening tape of any of the preceding or subsequent example combination, wherein each first lateral slit of the plurality of first lateral slits extends from the first edge to proximate the first sidewall, and wherein each second lateral slit of the plurality of second lateral slits extends from the second edge to proximate the second sidewall.

EC 15. The fastening tape of any of the preceding or subsequent example combination, wherein the first groove intersects each first lateral slit of the plurality of first lateral slits.

EC 16. The fastening tape of any of the preceding or subsequent example combination, further comprising a first protrusion extending in the upward direction from the top surface of the body and located between the first edge and the first groove, wherein the first protrusion intersects each first lateral slit of the plurality of first lateral slits.

EC 17. The fastening tape of any of the preceding or subsequent example combination, wherein the outer end of each first lateral slit is at or near the first edge.

EC 18. The fastening tape of any of the preceding or subsequent example combination, wherein the intersection of the first lateral slit is substantially perpendicular to the first groove.

EC 19. The fastening tape of any of the preceding or subsequent example combination, wherein the fastening tape comprises a plurality fastening tape segments connected to one another by flexible elements.

EC 20. The fastening tape of any of the preceding or subsequent example combination, further comprising at least one magnetic portion extending in the longitudinal direction.

EC 21. A fastening tape comprising: a body including a first edge, a second edge opposite the first edge, a bottom surface extending between the first edge and the second edge, and a top surface extending between the first edge and the second edge, the body defining a lateral direction from the first edge to the second edge and a longitudinal direction transverse to the lateral direction; a first sidewall extending in an upward direction from the top surface of the body and positioned between the first edge and the second edge; and a second sidewall extending in the upward direction from the top surface of the body and positioned between the first sidewall and the second edge; a plurality of fasteners extending in an upward direction from the top surface of the body and positioned between the first sidewall and the second sidewall and arranged in rows extending in the lateral direction of the body; a first groove defined in the top surface and extending in the longitudinal direction between the first sidewall and the first edge, the first groove defining a first folding portion arranged between the first groove and the first edge and a first non-folding portion arranged between the first groove and the first sidewall; a second groove defined in the top surface and extending in the longitudinal direction between the second sidewall and the second edge, the second groove defining a second folding portion arranged between the second groove and the second edge and a second non-folding portion arranged between the second groove and the second sidewall; a first flange between the first sidewall and the first edge and comprising a plurality of first lateral slits extending from proximate the first edge to proximate the first sidewall in the lateral direction; and a second flange between the second sidewall and the second edge and comprising a plurality of second lateral slits extending from proximate the second edge to proximate the second sidewall in the lateral direction, wherein the first folding portion is positionable relative to the first non-folding portion, wherein the second folding portion is positionable relative to the second non-folding portion, and wherein the second lateral slits are aligned with the first lateral slits in the lateral direction.

EC 22. The fastening tape of any of the preceding or subsequent example combination, wherein a width of each first lateral slit of the plurality of first lateral slits is approximately the same as a distance between adjacent edges of adjacent first lateral slits, and wherein a width of each second lateral slit of the plurality of second lateral slits is approximately the same as a distance between adjacent edges of adjacent second lateral slits.

EC 23. The fastening tape of any of the preceding or subsequent example combination, wherein each first lateral slit of the plurality of first lateral slits extends from the first edge to proximate the first sidewall, and wherein each second lateral slit of the plurality of second lateral slits extends from the second edge to proximate the second sidewall.

EC 24. The fastening tape of any of the preceding or subsequent example combination, wherein the first groove intersects each first lateral slit of the plurality of first lateral slits.

EC 25. The fastening tape of any of the preceding or subsequent example combination, wherein the first groove intersects each first lateral slit of the plurality of first lateral slits between the outer end and the inner end of each first lateral slit.

EC 26. The fastening tape of any of the preceding or subsequent example combination, further comprising a first protrusion extending in the upward direction from the top surface of the body and located between the first edge and the first groove, wherein the first protrusion intersects each first lateral slit of the plurality of first lateral slits.

EC 27. The fastening tape of any of the preceding or subsequent example combination, wherein the outer end of each first lateral slit is at or near the first edge.

EC 28. The fastening tape of any of the preceding or subsequent example combination, wherein the first lateral slit is substantially perpendicular to the first groove.

EC 29. The fastening tape of any of the preceding or subsequent example combination, wherein the fastening tape comprises a plurality fastening tape segments connected to one another by flexible elements.

EC 30. The fastening tape of any of the preceding or subsequent example combination, further comprising at least one magnetic portion extending in the longitudinal direction.

EC 31. The fastening tape of any of any of the preceding or subsequent example combination, wherein the first folding portion is at a substantially zero angle relative to the first non-folding portion.

EC 32. The fastening tape of any of the preceding or subsequent example combination, wherein the first folding portion is at a non-zero angle relative to the first non-folding portion.

EC 33. The fastening tape of any of the preceding or subsequent example combination, wherein the first folding portion is positioned at a 45° angle relative to the first non-folding portion.

EC 34. The fastening tape of any of the preceding or subsequent example combination, wherein the first folding portion is positioned at a 90° angle relative to the first non-folding portion.

EC 35. The fastening tape of any of the preceding or subsequent example combination, wherein an angle of the first folding portion relative to the first non-folding portion is approximately an angle of the second folding portion relative to the second non-folding portion.

EC 36. The fastening tape of any of the preceding or subsequent example combination, wherein an angle of the first folding portion relative to the first non-folding portion is different from an angle of the second folding portion relative to the second non-folding portion.

EC 37. A fastening tape comprising: a body including a first edge, a second edge opposite the first edge, and a top surface, wherein the body defines a lateral direction from the first edge to the second edge and a longitudinal direction transverse to the lateral direction; a plurality of fasteners arranged on the top surface of the body and between the first edge and the second edge; and a first flange arranged between the plurality of fasteners and the first edge, the first flange comprising: a first groove in the top surface of the body and extending in the longitudinal direction, wherein the first flange defines a first folding portion arranged between the first groove and the first edge and a first non-folding portion arranged between the first groove and the plurality of fasteners; and a plurality of first lateral slits extending in the lateral direction, wherein the first folding portion is positionable relative to the first non-folding portion, and wherein at least one first lateral slit of the plurality of lateral slits intersects the first groove.

EC 38. The fastening tape of any of the preceding or subsequent example combination, further comprising: a first sidewall arranged between the plurality of fasteners and the first groove of the first flange; a second sidewall arranged between the plurality of fasteners and the second edge; and a second flange arranged between the second sidewall and the second edge and comprising: a second groove in the top surface and extending in the longitudinal direction, wherein the second flange defines a second folding portion arranged between the second groove and the second edge and a second non-folding portion arranged between the second groove and the second sidewall; and a plurality of second lateral slits extending in the lateral direction, wherein the second folding portion is positionable relative to the second non-folding portion, and wherein at least one second lateral slit of the plurality of second lateral slits intersects the second groove.

EC 39. The fastening tape of any of the preceding or subsequent example combination, wherein each first lateral slit of the plurality of first lateral slits comprises an inner end and an outer end, and wherein the outer end of each first lateral slit is at the first edge such that each first lateral slit comprises a lateral slit opening at the first edge.

EC 40. The fastening tape of any of the preceding or subsequent example combination, wherein each first lateral slit of the plurality of first lateral slits comprises an inner end and an outer end, and wherein the outer end of each first lateral slit is separated from the first edge and the first flange comprises a bridging portion between the outer end of each first lateral slit and the first edge.

EC 41. The fastening tape of any of the preceding or subsequent example combination, wherein the first groove intersects each first lateral slit of the plurality of lateral slits.

EC 42. The fastening of any of the preceding or subsequent example combination, wherein the first groove intersects the at least one first lateral slit of the plurality of first lateral slits between an outer end and an inner end of the at least one first lateral slit.

EC 43. The fastening tape of any of the preceding or subsequent example combination, wherein the first flange further comprises a protrusion arranged between the first edge and the first groove, and wherein the protrusion intersects each first lateral slit of the plurality of first lateral slits.

EC 44. The fastening tape of any of the preceding or subsequent example combination, wherein the fastening tape comprises a plurality fastening tape segments connected to one another by flexible elements.

EC 45. A fastening tape comprising: a body comprising a first edge, a second edge opposite the first edge, and a top surface, wherein the body defines a lateral direction from the first edge to the second edge and a longitudinal direction transverse to the lateral direction; a plurality of fasteners arranged on the top surface of the body and between the first edge and the second edge; a flange arranged between the plurality of fasteners and the first edge, the flange comprising: a groove in the top surface of the body and extending in the longitudinal direction, wherein the flange defines a folding portion arranged between the groove and the first edge and a non-folding portion arranged between the groove and the plurality of fasteners; and a plurality of apertures, wherein at least one aperture of the plurality of apertures intersects the groove.

EC 46. The fastening tape of any of the preceding or subsequent example combination, wherein each aperture of the plurality of apertures is elongated in the longitudinal direction such that each aperture has a first end and a second end.

EC 47. The fastening tape of any of the preceding or subsequent example combination, wherein each aperture of the plurality of apertures intersects the groove.

EC 48. The fastening tape of any of the preceding or subsequent example combination, wherein the groove intersects the first end and the second end of each aperture of the plurality of apertures.

EC 49. The fastening tape of any of the preceding or subsequent example combination, wherein the groove intersects each aperture of the plurality of apertures at a position offset from the first end and the second end of each aperture.

EC 50. The fastening tape of any of the preceding or subsequent example combination, wherein the flange further comprises a plurality of lateral slits extending in the lateral direction, wherein each lateral slit is positioned between adjacent apertures, and wherein the groove intersects each lateral slit of the plurality of lateral slits.

EC. 51. The fastening tape of any of the preceding or subsequent example combination, wherein the groove is a first groove, and wherein the flange further comprises: a second groove in the top surface of the body and extending in the longitudinal direction, wherein the second groove is between the first groove and the plurality of fasteners such that the second groove does not intersect the plurality of apertures.

EC 52. A fastening tape comprising: a body comprising a first edge, a second edge opposite the first edge, and a top surface, wherein the body defines a lateral direction from the first edge to the second edge and a longitudinal direction transverse to the lateral direction; a plurality of fasteners on the top surface of the body and positioned between the first edge and the second edge; a flange arranged between the plurality of fasteners and the first edge, the flange comprising: a plurality of longitudinal slits extending in the longitudinal direction; and a plurality of lateral slits extending in the lateral direction, wherein each lateral slit of the plurality of lateral slits intersects a corresponding longitudinal slit of the plurality of longitudinal slits.

EC 53. The fastening tape of any of the preceding or subsequent example combination, wherein each longitudinal slit comprises a first slit portion and a second slit portion, and wherein each lateral slit comprises a first radiused portion intersecting the first slit portion and a second radiused portion intersecting the second slit portion of the corresponding longitudinal slit.

EC 54. The fastening tape of any of the preceding or subsequent example combination, wherein each lateral slit intersects the corresponding longitudinal slit at an intermediate position between a first end and a second end of the corresponding longitudinal slit.

EC 55. The fastening tape of any of the preceding or subsequent example combination, wherein each lateral slit of the plurality of lateral slits comprises an inner end and an outer end, and wherein the outer end of each lateral slit is at the first edge such that each lateral slit comprises a lateral slit opening at the first edge.

EC 56. The fastening tape of any of the preceding or subsequent example combination, wherein each lateral slit of the plurality of lateral slits comprises an inner end and an outer end, and wherein the outer end of each lateral slit is separated from the first edge and the flange comprises a bridging portion between the outer end of each lateral slit and the first edge.

EC 57. The fastening tape of any of the preceding or subsequent example combination, wherein the flange further comprises a plurality of spacing notches, and wherein each spacing notch is positioned between adjacent lateral slits of the plurality of lateral slits.

The above-described aspects are merely possible examples of implementations, merely set forth for a clear understanding of the principles of the present disclosure. Many variations and modifications can be made to the above-described embodiment(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims that follow, they are used only in a generic and descriptive sense, and not for the purposes of limiting the described invention, nor the claims that follow.

That which is claimed is:

1. A fastening tape comprising:

a body including a first edge, a second edge opposite the first edge, and a top surface, wherein the body defines a lateral direction from the first edge to the second edge and a longitudinal direction transverse to the lateral direction;

a plurality of fasteners arranged on the top surface of the body and between the first edge and the second edge; and a first flange arranged between the plurality of fasteners and the first edge, the first flange comprising:

a first groove in the top surface of the body and extending in the longitudinal direction, wherein the first flange defines a first folding portion arranged between the first groove and the first edge and a first non-folding portion arranged between the first groove and the plurality of fasteners; and a plurality of first lateral slits extending in the lateral direction, wherein the first folding portion is positionable relative to the first non-folding portion, and wherein at least one first lateral slit of the plurality of first lateral slits intersects the first groove.

2. The fastening tape of claim 1, further comprising:

a first sidewall arranged between the plurality of fasteners and the first groove of the first flange;

a second sidewall arranged between the plurality of fasteners and the second edge; and a second flange arranged between the second sidewall and the second edge and comprising:

a second groove in the top surface of the body and extending in the longitudinal direction, wherein the second flange defines a second folding portion arranged between the second groove and the second edge and a second non-folding portion arranged between the second groove and the second sidewall; and a plurality of second lateral slits extending in the lateral direction, wherein the second folding portion is positionable relative to the second non-folding portion, and wherein at least one second lateral slit of the plurality of second lateral slits intersects the second groove.

3. The fastening tape of claim 1, wherein each first lateral slit of the plurality of first lateral slits comprises an inner end and an outer end, and wherein the outer end of each first lateral slit is at the first edge such that each first lateral slit comprises a lateral slit opening at the first edge.

4. The fastening tape of claim 1, wherein the first groove intersects each first lateral slit of the plurality of first lateral slits.

5. The fastening tape of claim 1, wherein the first groove intersects the at least one first lateral slit of the plurality of first lateral slits between an outer end and an inner end of the at least one first lateral slit.

6. The fastening tape of claim 1, wherein the first flange further comprises a protrusion arranged between the first edge and the first groove, and wherein the protrusion intersects each first lateral slit of the plurality of first lateral slits.

7. The fastening tape of claim 1, wherein the fastening tape comprises a plurality fastening tape segments connected to one another by flexible elements.

8. A fastening tape comprising:

a body including a first edge, a second edge opposite the first edge, and a top surface, wherein the body defines a lateral direction from the first edge to the second edge and a longitudinal direction transverse to the lateral direction;

a plurality of fasteners arranged on the top surface of the body and between the first edge and the second edge;

a first flange arranged between the plurality of fasteners and the first edge; and a first sidewall arranged between the plurality of fasteners and the first flange, the first flange comprising:

a plurality of first lateral slits extending in the lateral direction, wherein each first lateral slit of the plurality of first lateral slits includes an inner end and an outer end, and wherein the first flange includes a protrusion arranged between the first edge and the first sidewall at a position close to the first edge relative to the inner end of each first lateral slit.

9. The fastening tape of claim 8, further comprising:

a second flange arranged between the plurality of fasteners and the second edge; and a second sidewall arranged between the plurality of fasteners and the second flange, the second flange comprising:

a plurality of second lateral slits extending in the lateral direction, wherein each second lateral slit of the plurality of second lateral slits includes an inner end and an outer end, and wherein the second flange includes a protrusion arranged between the second edge and the second sidewall at a position close to the second edge relative to the inner end of each second lateral slit.

10. The fastening tape of claim 9, wherein a height of the protrusion is the same as a height of the first sidewall and a height of the second sidewall or less than the height of the first sidewall and the height of the second sidewall.

11. The fastening tape of claim 9, wherein the second lateral slits are offset from the first lateral slits in the lateral direction.

12. The fastening tape of claim 9, wherein the first lateral slits and the second lateral slits are shaped such that the first edge and the second edge are formed into wave-shapes.

* * * * *